US005543279A

United States Patent [19]

Matsuda et al.

[11] Patent Number: 5,543,279

[45] Date of Patent: Aug. 6, 1996

[54] SILVER HALIDE LIGHT-SENSITIVE MATERIAL

[75] Inventors: Naoto Matsuda; Makoto Yamada; Michio Ono; Yasuhiro Ishiwata; Osamu Uchida, all of Kanagawa, Japan

[73] Assignee: Fuji Photo Film Co., Ltd., Kanagawa, Japan

[21] Appl. No.: 227,381

[22] Filed: Apr. 14, 1994

[30] Foreign Application Priority Data

Apr. 14, 1993 [JP] Japan ..... 5-109830
Mar. 16, 1994 [JP] Japan ..... 6-70202

[51] Int. Cl.[6] ..... G03C 8/22; G03C 7/305

[52] U.S. Cl. ..... 430/559; 430/223; 430/544; 430/563; 430/955; 430/957; 430/958

[58] Field of Search ..... 430/223, 544, 430/559, 563, 958, 955, 564, 957

[56] References Cited

U.S. PATENT DOCUMENTS 4,663,273 5/1987 Van de Sande et al. ..... 430/223
4,783,396 11/1988 Nakamura et al. ..... 430/223
4,871,654 10/1989 Vanmaele et al. ..... 430/223
4,891,304 1/1990 Nakamura ..... 430/223
5,350,666 9/1994 Motoki et al. ..... 430/544
5,403,703 4/1995 Mihayashi et al. ..... 430/544

*Primary Examiner*—Richard Schilling
*Attorney, Agent, or Firm*—Sughrue, Mion, Zinn, Macpeak & Seas

[57] ABSTRACT

A silver halide light-sensitive material containing a compound represented by formula (I):

(I)

wherein variables in the above formula (I) are defined in the specification. The silver halide light-sensitive material has a small fluctuation in sensitivity even when the processing temperature changes and has an improved color reproduction and an excellent discrimination and can achieve low Dmin and high Dmax.

5 Claims, No Drawings

SILVER HALIDE LIGHT-SENSITIVE MATERIAL

FIELD OF THE INVENTION

The present invention relates to a silver halide light-sensitive material, more specifically to a diffusible dye-providing compound used for the above light-sensitive material.

BACKGROUND OF THE INVENTION

A process for forming an image with a diffusion transfer type silver halide photographic light-sensitive material can be classified to two processes. One is a process in which a design is made so that diffusibility of a dye molecule itself is changed corresponding with a developing reaction of silver halide exposed, and the other is a process in which a design is made so that a diffusible dye is incorporated into a light-sensitive material as a dye-providing material immobilized by a ballast group and is released from the dye-providing material corresponding or inversely corresponding with the developing reaction of silver halide.

There are known as a process by which the diffusible dye is released from the dye-providing material, a process using a coupling reaction of an oxidation product of a developing agent with a dye-releasing coupler having the diffusible dye as a splitting group, a process using a diffusible dye-releasing redox compound having a nature that a bond between a diffusible dye portion and a redox primary nucleus portion immobilized by a ballast group is split, and a compound releasing a diffusible dye by an interaction with a silver ion. These diffusible dye-providing compounds can be classified to a negatively active compound which releases the diffusible dye corresponding with a development of silver halide by a relation with a silver developing reaction and a positively active compound which releases the dye diffusible dye inversely corresponding with the development. There are known as the examples of the negatively active compound in a diffusible dye-releasing redox compound, sulfonamide phenols disclosed in U.S. Pat. Nos. 3,928,312, 4,135,929, 4,053,312, 4,336,322, and 4,055,428, the compounds disclosed in JP-A-51-104,343 (the term "JP-A" as used herein means an unexamined published Japanese patent application) and 53-46,730, the compounds disclosed in JP-A-53-3,819, the compounds disclosed in JP-A-62-18,908 and 61-48,848, and hydrazides disclosed in Research Disclosure (1975), p. 22, and U.S. Pat. Nos. 3,844,785 and 4,684,604.

There are known well as the examples of the positive working compound, the BEND compounds disclosed in U.S. Pat. Nos. 4,139,379 and 4,139,389, and the Carquin compounds disclosed in British Patent 11,445. Further, a positive working redox compound disclosed in JP-A-62-215,270, in which a reaction to cleave a nitrogen-oxygen bond by one electron reduction is utilized, is a compound which is excellent in a storage stability and an alkali resistance and which is excellent as well in a reduction-dye releasing efficiency.

In a diffusion transfer type silver halide photographic light-sensitive material for which a diffusible dye-providing compound is used, a dye used has desirably a high molar absorption coefficient (hereinafter referred to merely as $\epsilon$), because the mole number of dye-providing compounds contained in a light-sensitive material is determined by an image density to be obtained, and use of a dye having a large $\epsilon$ can reduce the number of the dye-providing compound and further can reduce as well silver halide and a binder amount to allow to expect that the following merits are given:

(1) reduction of a cost because of reduction of a mole number of the materials used, (2) improvement in a sharpness due to thinning, and (3) shortening of time for forming a transferred image due to thinning.

However, the performances such as fastness to light, humidity and heat, a manufacturing cost and a transferability are required to a dye for forming an image, and a dye having a hight $\epsilon$ can not necessarily be employed. A dye having a high $\epsilon$ and satisfying the other various conditions has so far been researched, and separately therefrom, there is proposed a method for combining a plurality of preferred dyes to obtain the same results as those obtained as if the dye having a high $\epsilon$ was used. There are proposed in, for example, U.S. Pat. Nos. 4,663,273 and 4,871,654, the positive type dye-providing compounds with which an atomic group comprising plural dyes is transferred.

It is shown in the examples of U.S. Pat. Nos. 4,663,273 and 4,871,654 that use of the dye-providing compounds described in the patents can provide the same maximum densities as those obtained with the conventional compounds even with the reduced use amounts of the dye-providing compounds and the silver halide emulsions. Further, the same effect can be expected to the BEND which compound releases two dye portions, described in U.S. Pat. No. 4,139,389. However, it is only when the dye-providing compounds used reveal the characteristics satisfactory for forming an image that such an economical merit becomes meaningful.

The characteristic for forming an image is, for example, a discrimination of an image density between an exposed part and an unexposed part. In case of a positive type diffusion transfer light-sensitive material, while a sufficient density is provided at the unexposed part, a density increase by a dye has to be controlled as much as possible. In U.S. Pat. No. 4,871,654 described above, a minimum density at the exposed part as well as a maximum density at the unexposed part is shown but the minimum density does not necessarily reside at a satisfactory level. Particularly in a high temperature processing condition (particularly in case of obtaining an image by a heat development processing), it has been found that an increase in a minimum density markedly deteriorates a discrimination.

Further, a small fluctuation in a photographic performance due to a change in a processing time is important as well. In the case where the positive type dye-providing compounds described in the prior arts mentioned above are actually used for a diffusion transfer type light-sensitive material, it is susceptible to an influence caused by a change in the development processing conditions.

The light-sensitive materials shown in the examples of U.S. Pat. Nos. 4,663,273 and 4,871,654 are the models comprising a single emulsion layer but in an actual full color light-sensitive material, a multi-layer system having at least a blue-sensitive layer, a green-sensitive layer and a red-sensitive layer is employed. It is known in the multi-layer system that an image-forming reaction taking place in the respective layers often exerts an influence to the adjacent layers to deteriorate the photographic performances. Particularly, in a diffusion transfer series light-sensitive material which is subjected to a development with a diffusible electron transfer agent (ETA), it is known that oxidation of a reducing agent caused by an oxidation product of ETA generated at an exposed part and diffused to an adjacent layer results in causing such an adverse effect (crosstalk) that an image density in an unexposed adjacent layer is reduced. Coating of a reducing agent on an intermediate layer is tried as means for solving this problem as described in, for example, JP-A-5-34884 but the effect thereof is not necessarily satisfactory as far as a conventional dye-providing compound is used.

As described above, because of various problems they have, it used to be difficult to bring out an economical merit with the dye-providing compounds which release a portion consisting of two dyes or plural dyes.

Meanwhile, U.S. Pat. No. 4,783,396 which is particularly preferably used in a heat developing system provides a positive type dye-providing compound having an excellent discrimination in exposure—non-exposure but a problem on a crosstalk is not yet solved. Further, a compound in which a portion having two or more dyes combined is released from a positive type redox primary nucleus, which is a characteristic of the above patent, is not known and it is unknown what superiority on a photographic performance is involved in addition to a profitability.

SUMMARY OF THE INVENTION

Therefore, an object of the present invention is to provide a silver halide light-sensitive material which has a small fluctuation in a sensitivity even when the processing temperature changes and which has an improved color reproduction and an excellent discrimination and can achieve low Dmin and high Dmax.

The intensive investigations made by the present inventors have resulted in finding that only the use of the positive type dye-providing compound represented by the following formula (I), which is not concretely described in U.S. Pat. Nos. 4,663,273 and 4,871,654, can provide an expectable merit such as reduction of the dye-providing compound used and thinning of a layer and that in addition thereto, deterioration of a discrimination due to a fluctuation in a processing condition, which has so far been a problem, and a problem on a crosstalk can be improved.

Particularly important is that in the case where the compound represented by formula (I) was used, the discrimination was further improved than in the case were the compounds described in U.S. Pat. No. 4,783,396 were used and the crosstalk which used to be a problem was markedly reduced. This fact can not readily be anticipated from the combination of the inventions described in U.S. Pat. Nos. 4,663,273 and 4,783,396 and can be regarded as a surprising result which can not be expected from a usual knowledge.

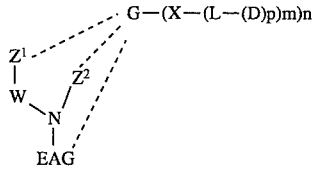

(I)

wherein EAG represents a group receiving an electron from a reducing substance; W represents an oxygen atom, a sulfur atom, or —$NR^1$— (in which $R^1$ represents an alkyl group or an aryl group); $Z^1$ and $Z^2$ each represents a simple bond or a substituent other than a hydrogen atom, and $Z^1$ and $Z^2$ may be combined with each other to form a ring; p represents an integer of 1 or more and m represents an integer of 2 or more and n represents an integer of 1 or 2; G represents a group having a nature that it is combined with any one of $Z^1$, $Z^2$ or EAG and the combination is cleaved after EAG receives an electron; X represents an alkyl group, an aryl group or a group obtained by removing m hydrogen atoms from a heterocyclic group; L represents a group combining X with D; D represents a photographically useful group; m ($L—(D)_p$) may be the same or different; when n is 2, n ($X—(L—(D)_p)_m$) may be the same or different; when p is 2 or more, p D may be the same or different; in the formula, a solid line represents a bond and broken lines represent that at least one of them is a bond.

DETAILED DESCRIPTION OF THE INVENTION

In view of the object of the present invention, at least one of plural D's in formula (I) is preferably a dye portion capable of forming an image or the precursor thereof, and two or more D's are more preferably the dyes or the precursors thereof.

$R^1$ in formula (I) represents an alkyl group (having 1 to 20 carbon atoms, for example, methyl, ethyl, propyl, cyclohexyl, 2-ethylhexyl, dodecyl, and hexadecyl) or an aryl group (having 6 to 20 carbon atoms, for example, phenyl and naphthyl), and $R^1$ may further have a substituent.

G, X and L in formula (I) will be described in detail. G represents a (n+1)valent linkage group which may have a timing function; X represents a (m+1)valent alkyl group (having 2 to 10 carbon atoms), a (m+1)valent aryl group (having 6 to 20 carbon atoms, for example, phenyl and naphthyl), or a (m+1)valent heterocyclic group (having 1 to 12 carbon atoms, for example, pyrrole, pyrazole, imidazole, pyrroline, pyrazoline, imidazoline, pyrrolidine, pyrazolidine, imidazolidine, indole, indoline, pyridine, pyrimidine, pyrazine, piperidine, tetrahydropyrimidine, morpholine, quinoline, quinoxaline, N-methylmorpholine, hydantoin, and triazine); and L represents a (p+1)valent linkage group, and these G, X, and L may further have substituents if possible.

In the case where G, X and L have a substituent, there can be enumerated as the preferred group, an alkyl group, an aralkyl group (an alkyl group and aralkyl group which may be substituted, for example, methyl, trifluoro-methyl, benzyl, chloromethyl, dimethylaminomethyl, ethoxycarbonylmethyl, aminomethyl, acetylaminomethyl, ethyl, carboxyethyl, allyl, 3,3,3-trichloropropyl, n-propyl, iso-propyl, n-butyl, iso-butyl, sec-butyl, t-butyl, n-pentyl, sec-pentyl, t-pentyl, cyclopentyl, n-hexyl, sec-hexyl, t-hexyl, cyclohexyl, n-octyl, sec-octyl, t-octyl,, n-decyl, n-undecyl, n-dodecyl, n-tetradecyl, n-pentadecyl, n-hexadecyl, sec-hexadecyl, t-hexadecyl, n-octadecyl, and t-octadecyl); an alkenyl group (an alkenyl group which may be substituted, for example, vinyl, 2-chlorovinyl, 1-methylvinyl, 2-cyanovinyl, and cyclohexene-1-yl);

an alkynyl group (an alkynyl group which may be substituted, for example, ethynyl, 1-propynyl, and 2-ethoxycarbonylethynyl);

an aryl group (an aryl group which may be substituted, for example, phenyl, naphthyl, 3-hydroxyphenyl, 3-chlorophenyl, 4-acetylaminophenyl, 2-methanesulfonyl-4-nitrophenyl, 3-nitrophenyl, 4-methoxyphenyl, 4-acetylaminophenyl, 4-methanesulfonylphenyl, and 2,4-dimethylphenyl);

a hetercyclic group (a hetercyclic group which may be substituted, for example, 1-imidazolyl, 2-furyl, 2-pyridyl, 5-nitro-2-pyridyl, 3-pyridyl, 3,5-dicyano-2-pyridyl, 5-tetrazolyl, 5-phenyl-1-tetrazolyl, 2-benzothiazolyl, 2-benzimidazolyl, 2-benzoxazolyl, 2-oxazoline-2-yl, and morpholino);

an acyl group (an acyl group which may be substituted, for example, acetyl, propionyl, butyloyl, iso-butyloyl, 2,2-dimethylpropionyl,benzoyl, 3,4-dichlorobenzoyl, 3-acetylamino-4-methylbenzoyl, 4-methylbenzoyl, and 4-methoxy-3-sulfobenzoyl);

a sulfonyl group (a sulfonyl group which may be substituted, for example, methanesulfonyl, ethanesulfonyl, chloromethanesulfonyl, propanesulfonyl, butanesulfonyl, benzenesulfonyl, and 4-toluenesulfonyl);

a carbamoyl group (a carbamoyl group which may be substituted, for example, carbamoyl, methylcarbamoyl, dimethylcarbamoyl, bis-(2-methoxyethyl)carbamoyl, diethylcarbamoyl, and cyclohexylcarbamoyl);

a sulfamoyl group (a sulfamoyyl group which may be substituted, for example, sulfamoyl, methylsulfamoyl, dimethysulfamoyl, diethylsulfamoyl, bis-(2-methoxyethyl)sulfamoyl, di-n-butylsulfamoyl, 3-ethoxypropylmethylsulfamoyl, and N-phenyl-N-methylsulfamoyl);

an alkoxy- or aryloxycarbonyl group (an alkoxy- or aryloxycarbonyl group which may be substituted, for example, methoxycarbonyl, ethoxycarbonyl, phenoxycarbonyl, and 2-methoxyethoxycarbonyl);

an alkoxy- or aryloxysulfonyl group (an alkoxy- or aryloxysulfonyl group which may be substituted, for example, methoxysulfonyl, ethoxysulfonyl, phenoxysulfonyl, and 2-methoxyethoxysulfonyl);

an alkoxy or arloxy group (an alkoxy or aryloxy group which may be substituted, for example, methoxy, ethoxy, methoxyethoxy, 2-chloroethoxy, phenoxy, and p-methoxyphenoxy);

an alkylthio or arylthio group (an alkylthio or arylthio group which may be substituted, for example, methylthio, ethylthio, n-butylthio, phenylthio, 4-chlorophenylthio, and 2-methoxyphenylthio);

an amino group (an amino group which may be substituted, for example, amino, methylamino, N,N-dimethoxyethoxyamino, and methylphenylamino);

an ammonio group (an ammonio group which may be substituted, for example, ammonio, trimethylammonio, phenyldimethylammonio, and dimethylbenzylammonio);

an acylamino group (an acylamino group which may be substituted, for example, acetylamino, 2-carboxy-benzoylamino, 3-nitrobenzoylamino, 3-diethylaminopropanoylamino, and acryloylamino);

an acyloxy group (an acyloxy group which may be substituted, for example, acetoxy, benzoyloxy, 2-butenoyloxy, and 2-methylpropanoyloxy);

a sulfonylamino group (a sulfonylamino group which may be substituted, for example, methanesulfonylamino, benzenesulfonylamino, and 2-methoxy-5-n-methyl-benzenesulfonylamino);

an alkoxycarbonylamino group (an alkoxycarbonylamino group which may be substituted, for example, methoxycarbonylamino, 2-methoxyethoxycarbonylamino, isobutoxycarbonylamino, benzyloxycarbonylamino, t-butoxycarbonylamino, and 2-cyanoethoxycarbonylamino);

an aryloxycarbonylamino group (an aryloxycarbonylamino group which may be substituted, for example, phenoxycarbonylamino and 2,4-nitrophenoxycarbonylamino);

an alkoxycarbonyloxy group (an alkoxycarbonyloxy group which may be substituted, for example, methoxycarbonyloxy, t-butoxycarbonyloxy, 2-benzenesulfonylethoxycarbonyloxy, and benzylcarbonyloxy);

an aryloxycarbonyloxy group (an aryloxy-carbonyloxy group which may be substituted, for example, phenoxycarbonyloxy, 3-cyanophenoxycarbonyloxy, 4-acetoxyphenoxycarbonyloxy, and 4-t-butoxycarbonylaminophenoxycarbonyloxy);

an aminocarbonylamino group (an aminocarbonylamino group which may be substituted, for example, methylaminocarbonylamino, morpholinocarbonylamino, N-ethyl-N-phenylaminocarbonylamino, and 4-methanesulfonylaminocarbonylamino);

an aminocarbonyloxy group (an aminocarbonyloxy group which may be substituted, for example, dimethylaminocarbonyloxy, pyrrolidinocarbonyloxy, and 4-dipropylaminophenylaminocarbonyloxy);

an aminosulfonylamino group (an aminosulfonylamino group which may be substituted, for example, diethylaminosulfonylamino, di-n-butylaminosulfonylamino, and phenylaminosulfonylamino);

a sulfonyloxy group (a sulfonyloxy group which may be substituted, for example, phenylsulfonyloxy, methanesulfonyloxy, chloromethanesulfonyloxy, and 4-chlorophenylsulfonyloxy); and a carboxyl group, a sulfo group, a cyano group, a nitro group, a hydroxyl group, and a halogen atom. Of them, there can be enumerated as more preferred groups, an alkoxy group, a halogen atom, an amino group, an acylamino group, a calbamoyl group, a sulfonylamino group, a sulfamoyl group, and a carboxyl group.

(G-1) to (G-11) are enumerated as a preferred example of G:

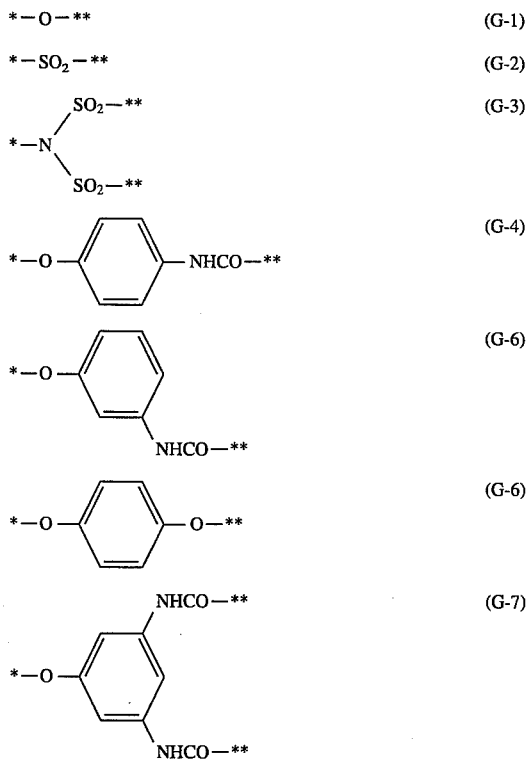

-continued
(G-8)
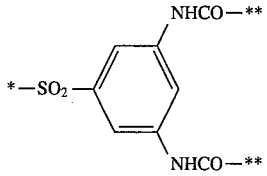
(G-9)
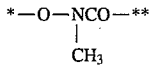
(G-10)
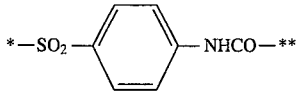
(G-11)
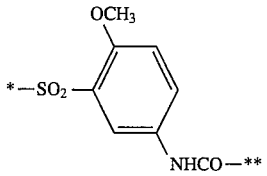
of (G-1) to (G-11), further preferred G is (G-1), (G-2), (G-4), (G-10), and (G-11), more preferably (G-1) and (G-4).
(X-1) to (X-15) are enumerated as a preferred example of X:
(X-1)
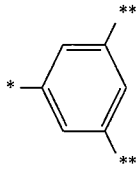
(X-2)
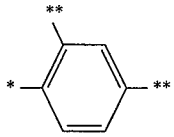
(X-3)
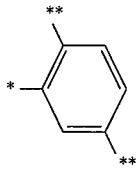
(X-4)
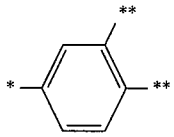
(X-5)
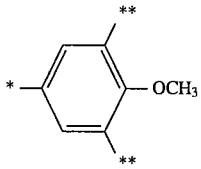
(X-6)
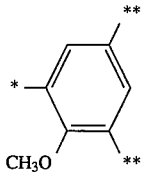
-continued
(X-7)
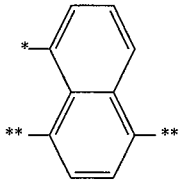
(X-8)
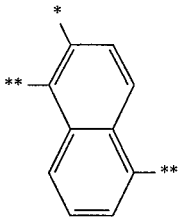
(X-9)
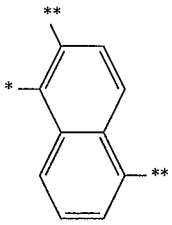
(X-10)
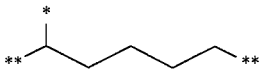
(X-11)
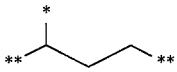
(X-12)
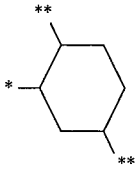
(X-13)
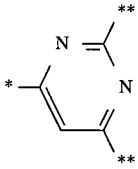
(X-14)
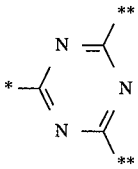
(X-15)
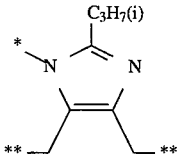
Of (X-1) to ((X-15), further preferred X is (X-1), (X-2), (X-3), (X-5), and (X-10), more preferably (X-1), (X-2) and (G-5).
There are enumerated as a preferred example of L, *—NH—**, *—CONH—**, *—$CH_2$NH—, —$SO_2$NH—, *—CO—**, *—$SO_2$—**, *—NHCO—

**, and *—$NHSO_2$—** (wherein the respective groups are linked to X via * and to D via **).

Of L's described above, further preferred are *—NH—** and *—CONH—**, more preferably *—NH—**.

G, X and L each described above can arbitrarily be selected to construct G—(X—(L—$(D)_p)_m)_n$, and (Q-1) to (Q-12) are enumerated as a preferred example of G—(X—(L—$(D)_p)_m)_n$:

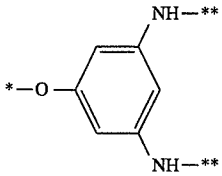
(Q-1)

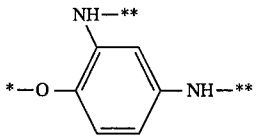
(Q-2)

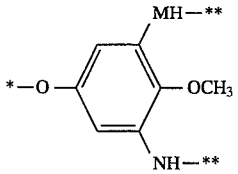
(Q-3)

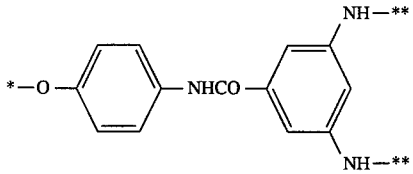
(Q-4)

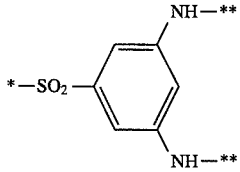
(Q-5)

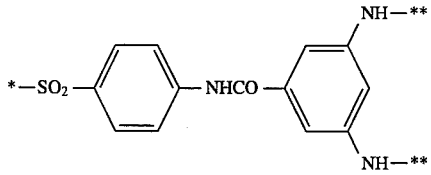
(Q-6)

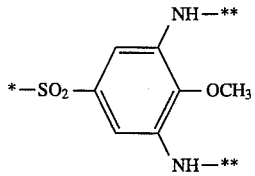
(Q-7)

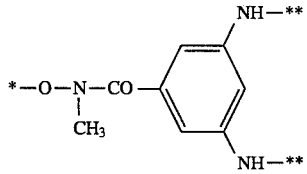
(Q-8)

-continued

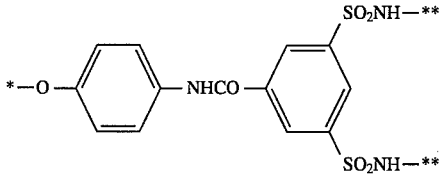
(Q-9)

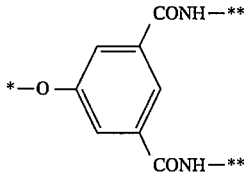
(Q-10)

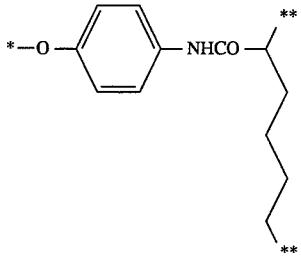
(Q-11)

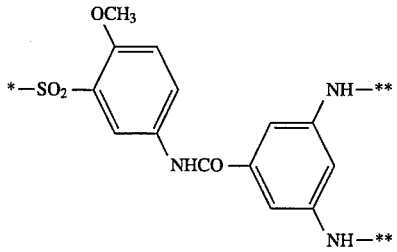
(Q-12)

Of (Q-1) to (Q-12), further preferred are (Q-1), (Q-2), (Q-3), (Q-4), (Q-8), and (Q-10), and more preferred are (Q-1), (Q-2), (Q-3), and (Q-4).

Of the compounds represented by formula (I), preferred one is the compound represented by formula (II):

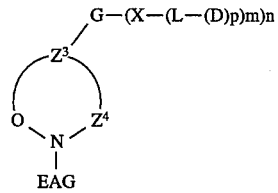
(II)

In formula (II), EAG, G, X, L, D, m, n, and p are as defined in formula (I); $Z^3$ represents an atomic group having a nature to break a $Z^3$-G bond after EAG receives a electron and an N—O bond is cleaved; and $Z^4$ —CO— or —$SO^2$— which is combined with $Z^3$ and N to form a heterocycle containing N—O.

Of the heterocyles formed by N, O, $Z^3$ and $Z^4$ in formula (II), those represented by (IV-1) to (IV-4) are enumerated as the preferred example thereof:

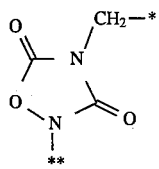
(IV-1)

-continued (IV-2)

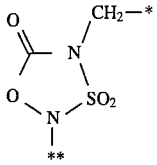

(IV-3)

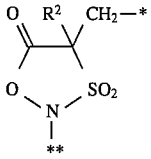

(IV-4)

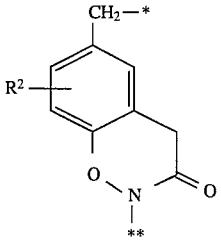

(IV-5)

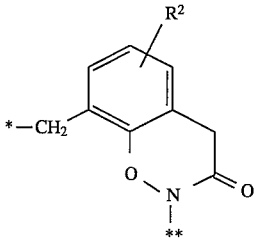

(IV-6)

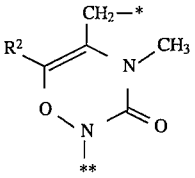

(IV-7)

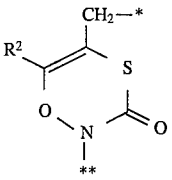

(IV-8)

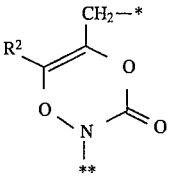

(IV-9)

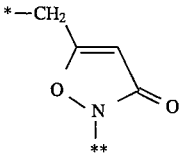

-continued (IV-10)

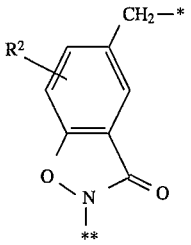

(IV-11)

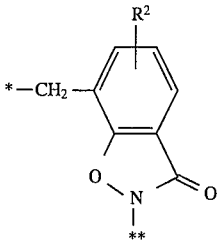

(IV-12)

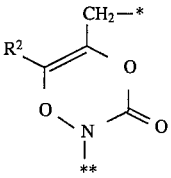

(IV-13)

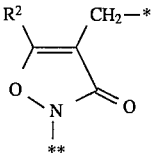

(IV-14)

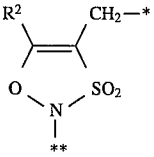

In (IV-1) to (IV-14), $R^2$ represents an alkyl group (having 1 to 40 carbon atoms, for example, methyl, ethyl, propyl, cyclohexyl, 2-ethylhexyl, dodecyl, and hexadecyl) or an aryl group (having 6 to 40 carbon atoms, for example, phenyl and naphthyl), and these groups may have the groups described above as the preferred substituents for $R^1$ if possible. * and ** represent the bonding positions with G and EAG, respectively.

Of the heterocycles represented by (IV-1) to (IV-14), (IV-1), (IV-10), (IV-11), (IV-13) and (IV-14) are enumerated as the further preferred examples.

Further, of the compounds represented by formula (II), the preferred one is the compound represented by formula (III):

(III)

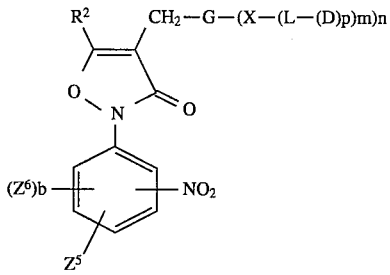

In formula (III), G, X, L, D, m, n, and p are as defined in formula (II); $R^2$ is as described in (IV-1) to (IV-14); $Z^5$ represents a carbamoyl group or a sulfamoyl group; $Z^6$ represents an alkyl group, an aryl group, an alkoxy group, an alkylthio group, an aryloxy group, an arylthio group, a halogen atom, a cyano group, or a nitro group; b represents an integer of 0 to 3; and a substitution position of the nitro group in the formula is the ortho position or the para position based on a nitrogen atom.

Formula (III) will be explained in further details. In the formula, $Z^5$ represents $—CO_2(R^3)R^4$ or $—SO_2N(R^3)R^4$, and $R^3$ and $R^4$ each represents an alkyl group or aryl group which has the same meaning as $R^2$ described above. $R^3$ and $R^4$ may be the same or different.

In formula (III), $Z^6$ represents an alkyl group (having 1 to 40 carbon atoms, for example, methyl, ethyl, propyl, cyclohexyl, 2-ethylhexyl, dodecyl, and hexadecyl), an aryl group (having 6 to 40 carbon atoms, for example, phenyl and naphthyl), an alkoxy group (having 1 to 40 carbon atoms, for example, methoxy, ethoxy, propoxy, cyclohexyloxy, 2-ethylhexyloxy, dodecyloxy, and hexadecyloxy), an alkylthio group (having 1 to 40 carbon atoms, for example, methylthio, ethylthio, propylthio, cyclohexylthio, 2-ethylhexylthio, dodecylthio, and hexadecylthio), an aryloxy group (having 6 to 40 carbon atoms, for example, phenoxy and naphthoxy), an arylthio group (having 6 to 40 carbon atoms, for example, phenylthio and naphthylthio), a halogen atom, a cyano group, or a nitro group. These groups may have the groups described as the substituents for $R^1$ if possible.

In formula (III), b represents an integer of 0 to 3, and when b is 2 or more, $Z^6$ may be the same or different. From a viewpoint of easiness of acquisition of raw materials and synthesis, b is preferably 0.

In formula (III), in the case where a substitution position of a nitro group based on a nitrogen atom is ortho, a substitution position of $Z^5$ is preferably para, and in the case where the substitution position of the nitro group based on the nitrogen atom is para, the substitution position of $Z^5$ is preferably ortho.

In formula (III), the sum of the carbon atoms contained in $R^2$, $Z^5$ and $Z^6$ including the substituents falls preferably in the range of 10 to 60, more preferably 20 to 30.

Next, D in formulas (I) to (IV) will be explained in detail. D is a photographically useful group and has a portion linking to X via L described above. For example, *—$SO_2$—, *—CO— or ***—NH— is enumerated as a preferred linking portion contained in a structure of D, and a *—L——$SO_2$— bond, a *—L—CO—bond or a *—L—NH— bond is formed with L described above to link X and D (in this case, * represents a linking position to X and *** represents a linking position to L).

There is enumerated as the example of D particularly effectively used in the present invention, a dye portion capable of forming an image or a group containing the precursor thereof, or a group containing an anti-fading agent. Next, the examples of the dyes and the anti-fading agent preferably used in the present invention will be enumerated. D represents a group obtained by introducing a linkage with L described above into these possible positions.

There can be enumerated as the dye, for example, an azo dye, an azomethine dye, an azopyrazolone dye, an indoaniline series dye, an indophenol dye, an anthraquinone series dye, a triarylmethane series dye, alizarin, a nitro series dye, a quinoline series dye, an indigo series dye, and a phthalocyanine series dye. Further, there can be enumerated a leuco product thereof, those the absorption wavelengths of which are temporarily shifted, and further a dye precursor such as a tetrazolium salt. Further, these dyes may form a chelating dye with suitable metal. These dyes are described in, for example, U.S. Pat. Nos. 3,880,658, 3,931,144, 3,932,380, 3,932,381, and 3,942,987. Of them, the cyan, magenta and yellow dyes are particularly important for forming a color image.

The examples of a yellow dye: the compounds described in U.S. Pat. Nos. 3,597,200, 3,309,199, 4,013,633, 4,245,028, 4,156,609, 4,139,383, 4,195,992, 4,148,641, 4,148,643, and 4,336,322, JP-A-51-114930 and 56-71072, and Research Disclosure 17630 (1978) and 16475 (1977).

The examples of a magenta dye: the compounds described in U.S. Pat. Nos. 3,453,107, 3,544,545, 3,932,380, 3,931,144, 3,932,308, 3,954,476, 4,233,237, 4,255,509, 4,250,246, 4,142,891, 4,207,104, and 4,287,292, and JP-A-52-106727, 53-23628, 55-36804, 56-73057, 56-71060, and 55-134.

The examples of a cyan dye: the compounds described in U.S. Pat. Nos. 3,482,972, 3,929,760, 4,013,635, 4,268,625, 4,171,220, 4,242,435, 4,142,891, 4,195,994, 4,147,544, and 4,148,642, British Patent 1,551,138, JP-A-54-99431, 52-8827, 53-47823, 53-143323, 54-99431, and 56-71061, European Patents (EPC) 53,037 and 53,040, and Research Disclosures 17630 (1978) and 16475 (1977).

The specific examples of a dye, a light absorption of which is temporarily shifted in a light-sensitive element as a kind of a dye precursor part are described in U.S. Pat. Nos. 4,310,612, T-999,003, 3,336,287, 3,579,334, and 3,982,946, British Patent 1,467,317, and JP-A-57-158638.

An antioxidant and a UV absorber can be enumerated as an anti-fading agent.

The antioxidant includes, for example, a chroman series compound, a coumaran series compound, a phenol series compound (for example, hindered phenols), a hydroquinone derivative, a hindered amine derivative, and a spiroindan series compound. Further, the compounds described in JP-A-61-159644 are effective as well.

The UV absorber includes a benzotriazole series compound (U.S. Pat. No. 3,533,794), a 4-thiazolidone series compound (U.S. Pat. No. 3,352,681), a benzophenone series compound (JP-A-46-2784), and in addition thereto, the compounds described in JP-A-54-48535, 62-136641, and 61-88256. Further, the UV absorbing polymers described in JP-A-62-260152 are effective as well.

Next, the specific compound examples of the present invention will be shown but the present invention will not be limited thereto. They are described in Table 1

TABLE 1
| Compound No. | Structure other than D | Structure of D |
|---|---|---|
| Y-1 | 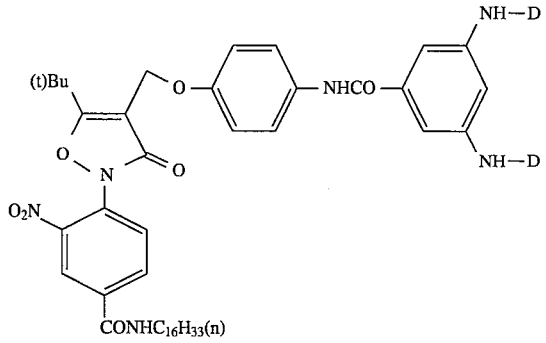 | 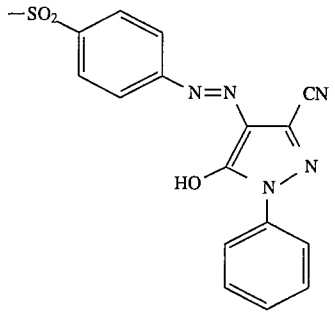 |
| Y-2 | 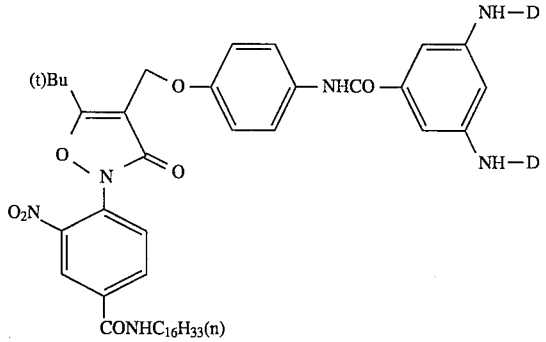 | 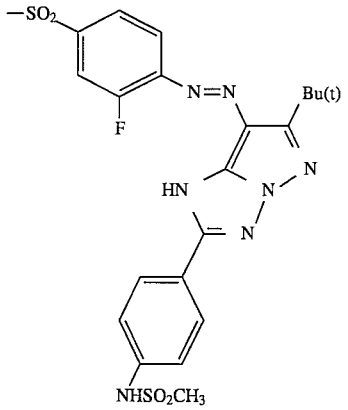 |
| Y-3 | 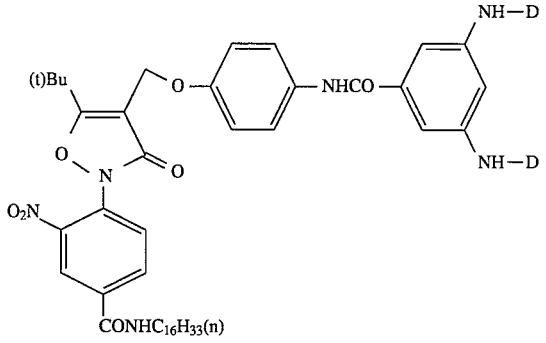 | 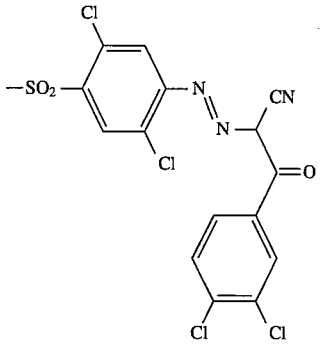 |
| Y-4 | 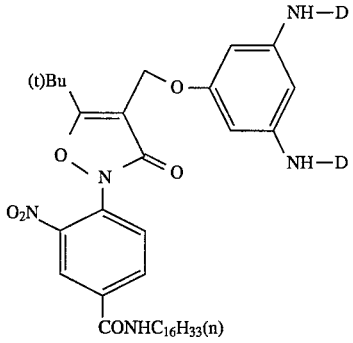 | 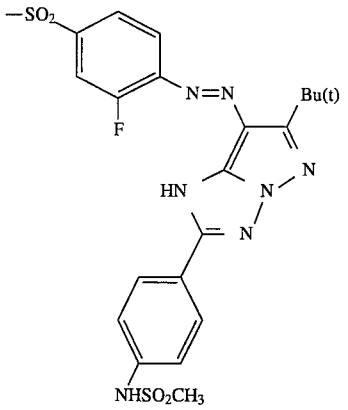 |

TABLE 1-continued
| Compound No. | Structure other than D | Structure of D |
|---|---|---|
| M-1 | 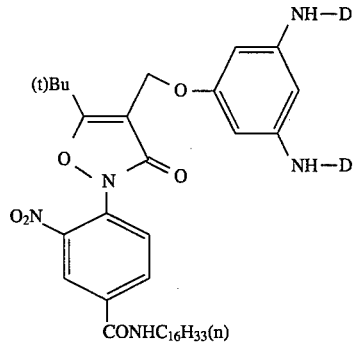 | 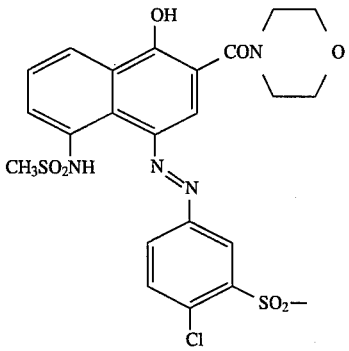 |
| C-1 | 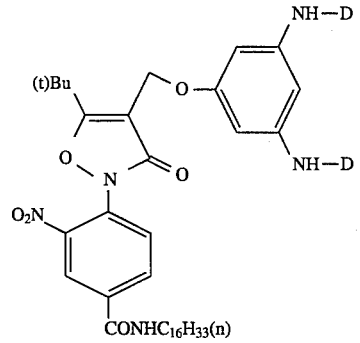 | 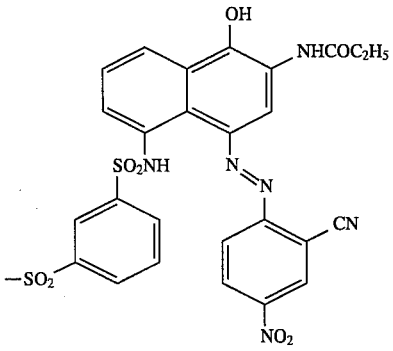 |
| C-2 | 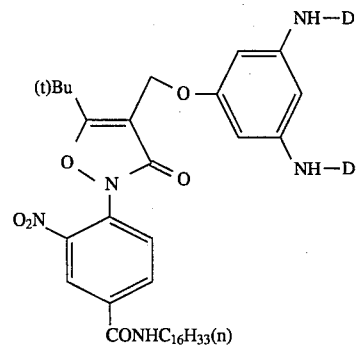 | 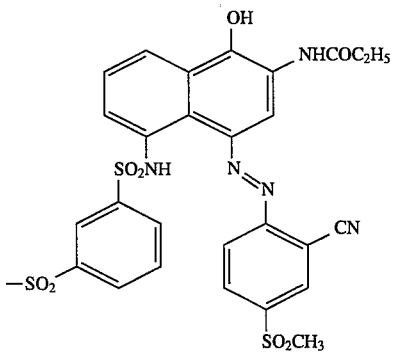 |
| Y-5 | 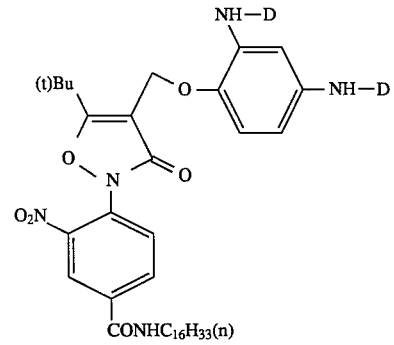 | 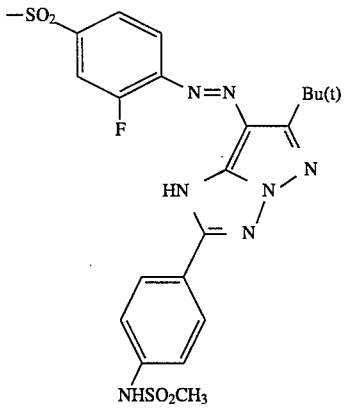 |

TABLE 1-continued
| Compound No. | Structure other than D | Structure of D |
|---|---|---|
| M-2 | 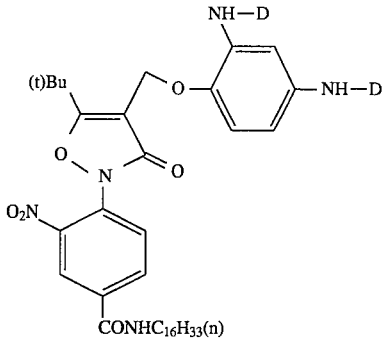 | 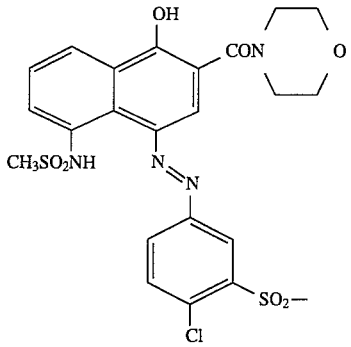 |
| C-3 | 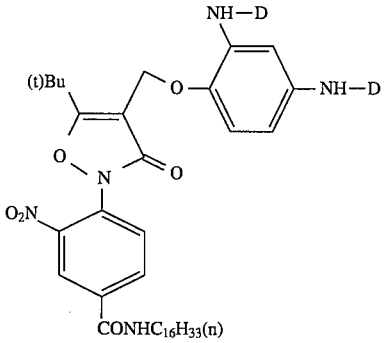 | 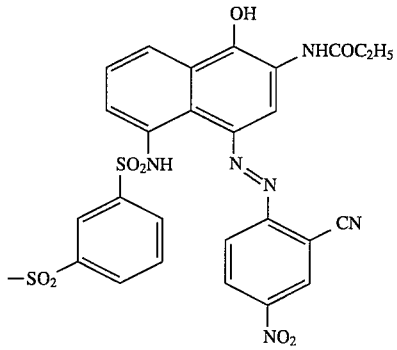 |
| C-4 | 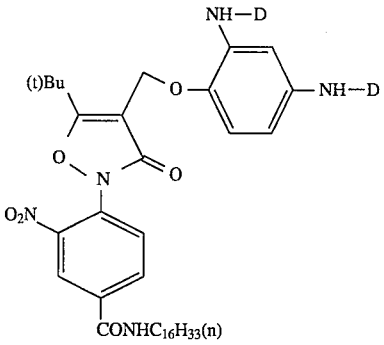 | 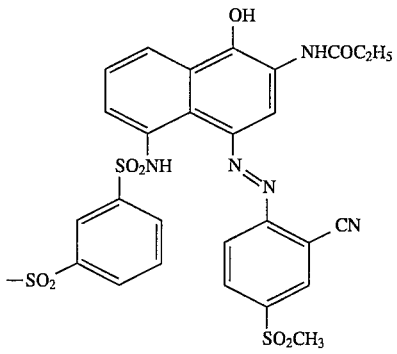 |
| M-3 | 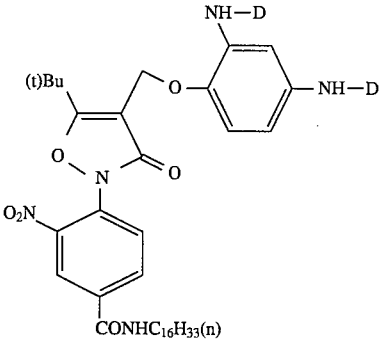 | 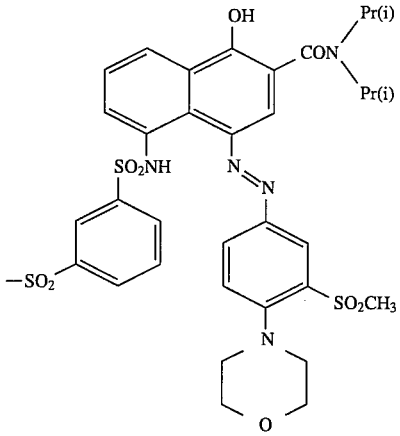 |

TABLE 1-continued
| Compound No. | Structure other than D | Structure of D |
|---|---|---|
| Y-6 | 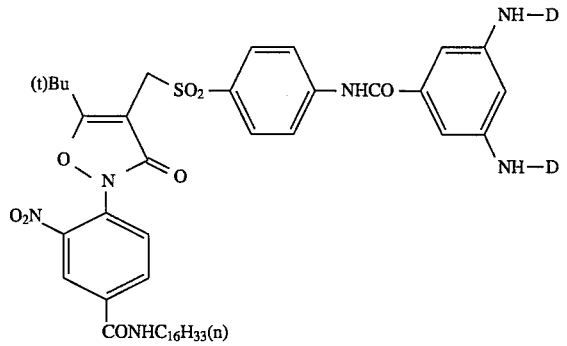 | 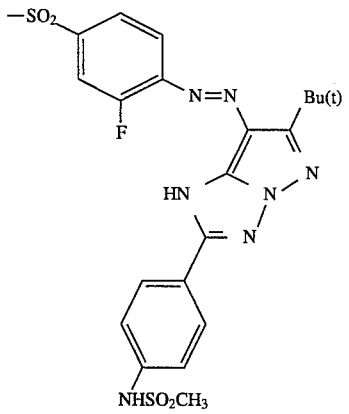 |
| M-4 | 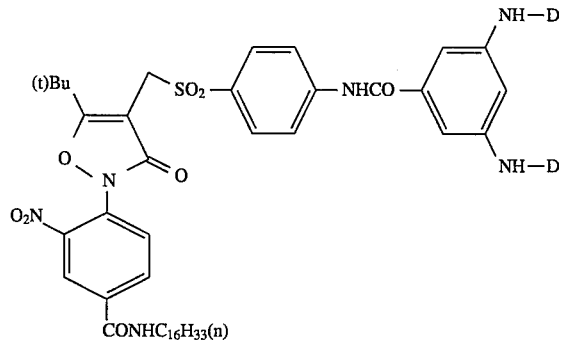 | 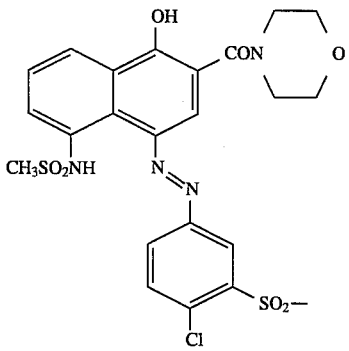 |
| C-5 | 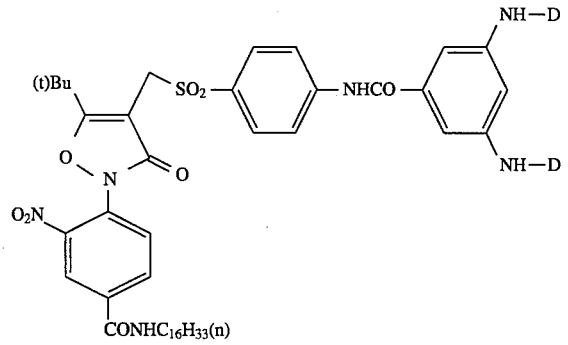 | 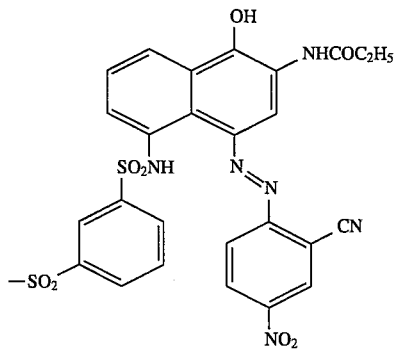 |
| C-6 | 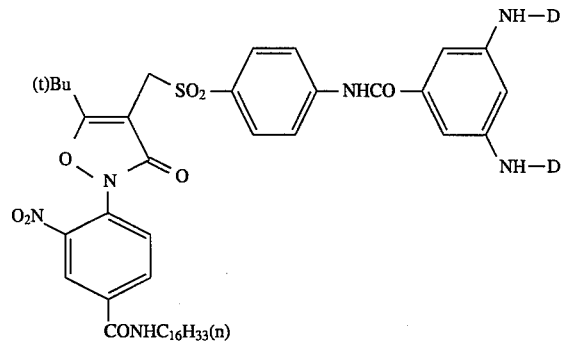 | 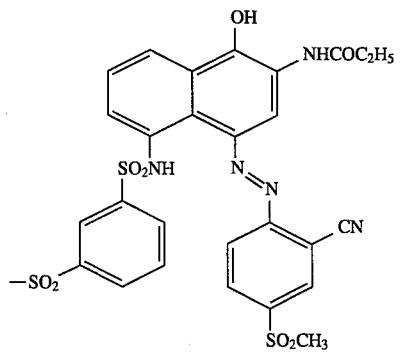 |

TABLE 1-continued
| Compound No. | Structure other than D | Structure of D |
|---|---|---|
| Y-7 | 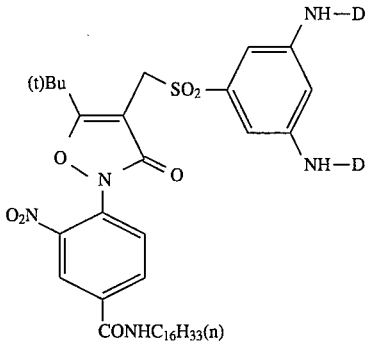 | 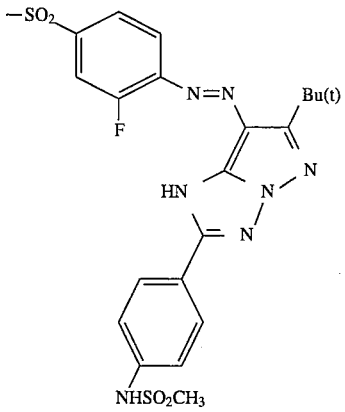 |
| M-5 | 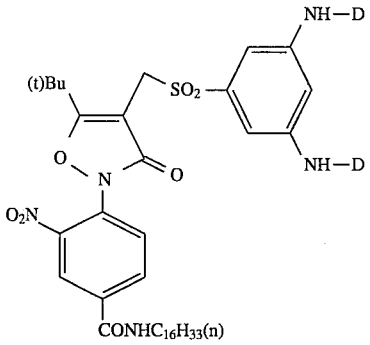 | 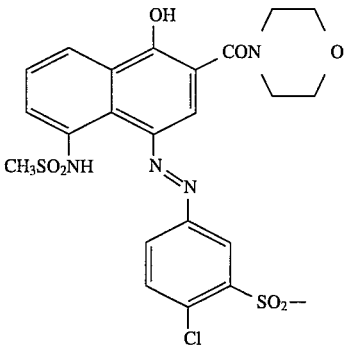 |
| C-7 | 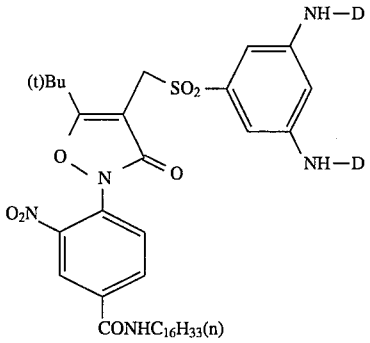 | 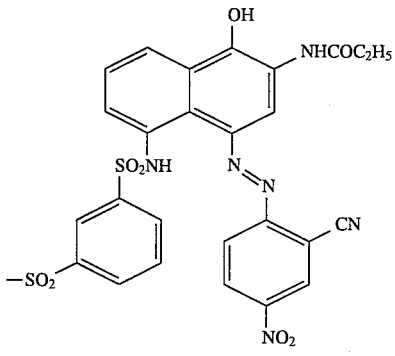 |
| C-8 | 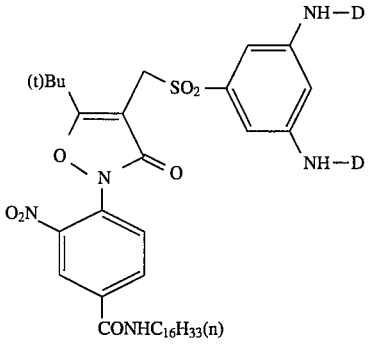 | 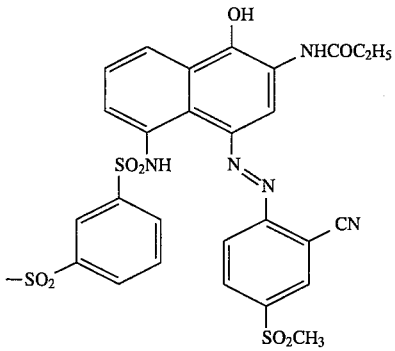 |

TABLE 1-continued
| Compound No. | Structure other than D | Structure of D |
|---|---|---|
| Y-8 | 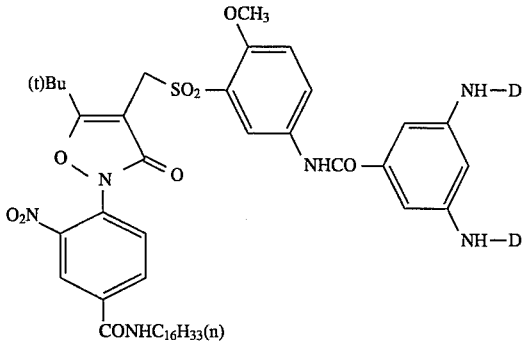 | 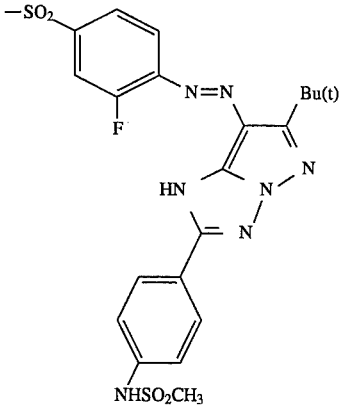 |
| M-6 | 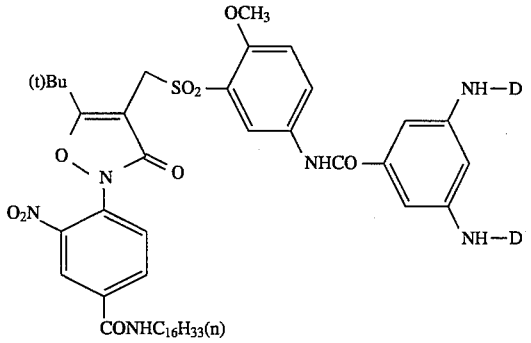 | 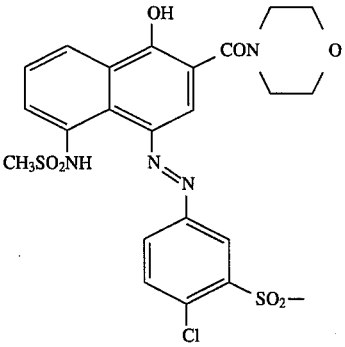 |
| C-9 | 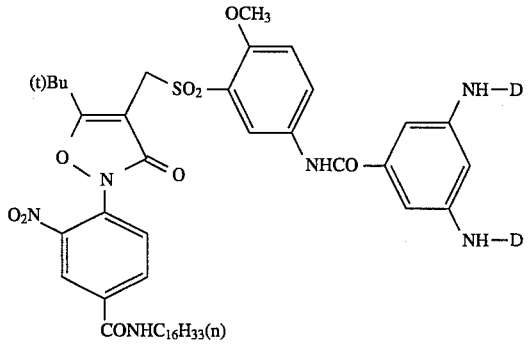 | 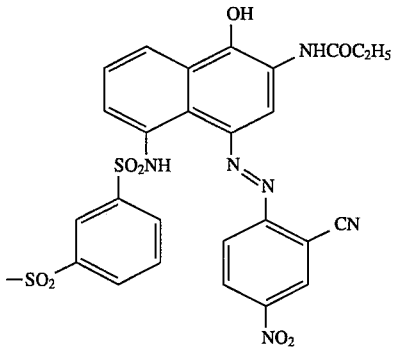 |
| C-10 | 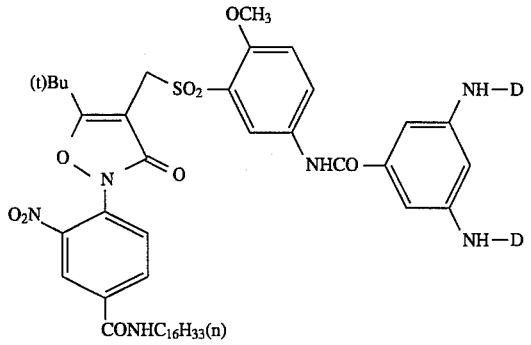 | 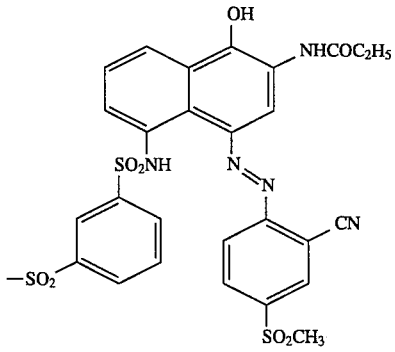 |

TABLE 1-continued
| Compound No. | Structure other than D | Structure of D |
|---|---|---|
| Y-9 | 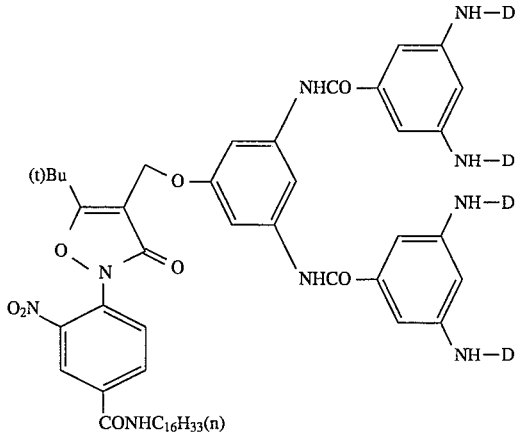 | 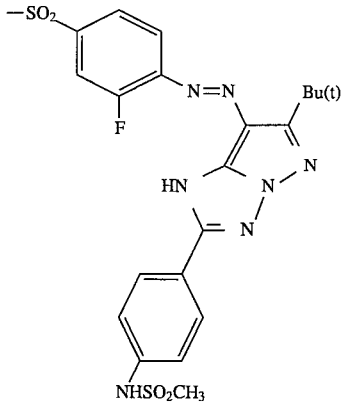 |
| M-7 | 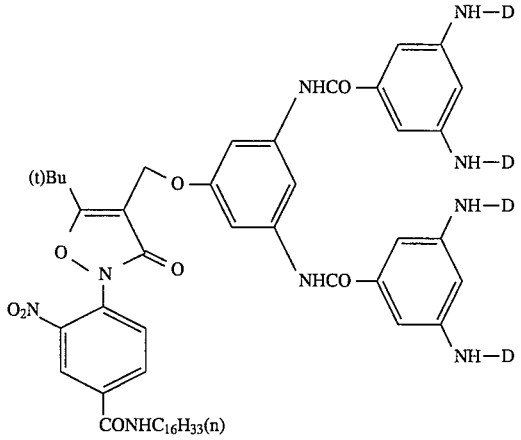 | 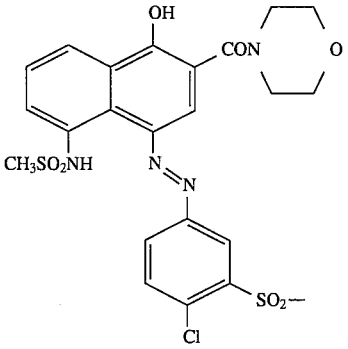 |
| C-11 | 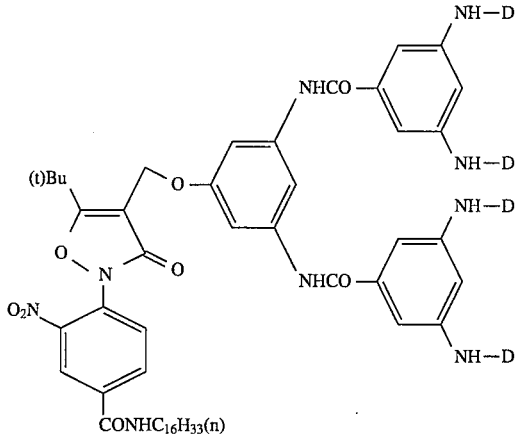 | 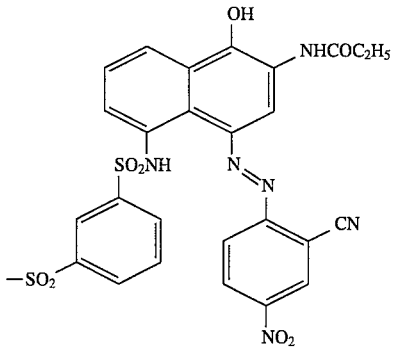 |

TABLE 1-continued
| Compound No. | Structure other than D | Structure of D |
|---|---|---|
| C-12 | 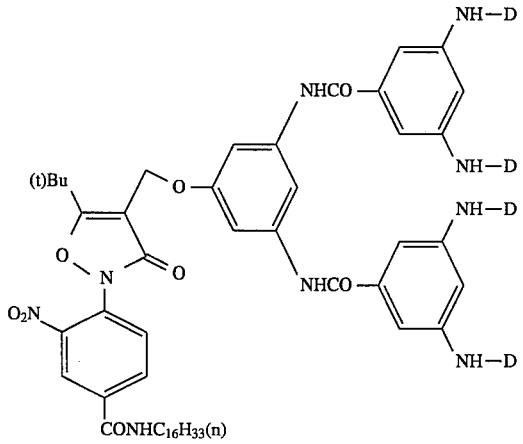 | 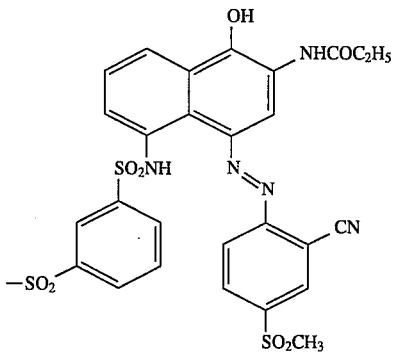 |
| Y-10 | 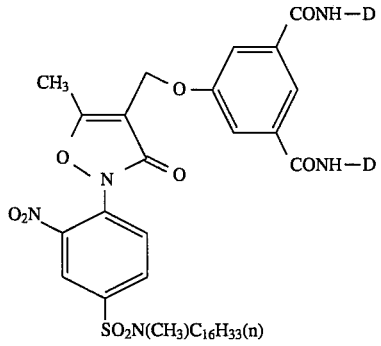 | 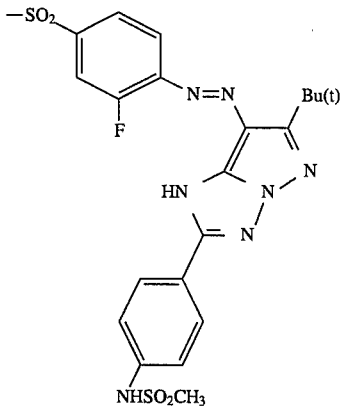 |
| M-8 | 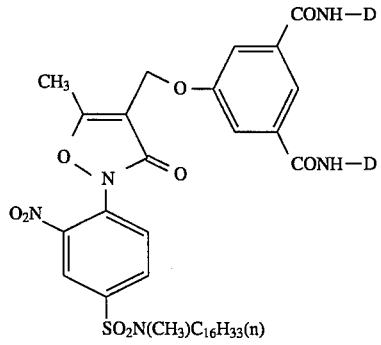 | 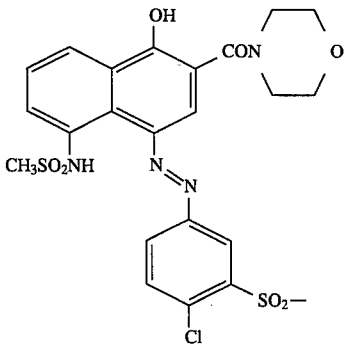 |
| C-13 | 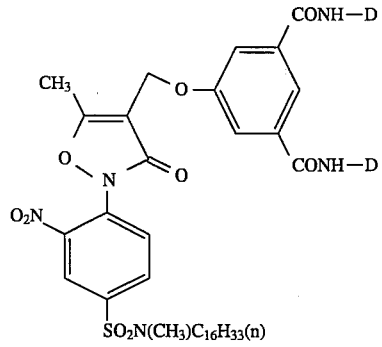 | 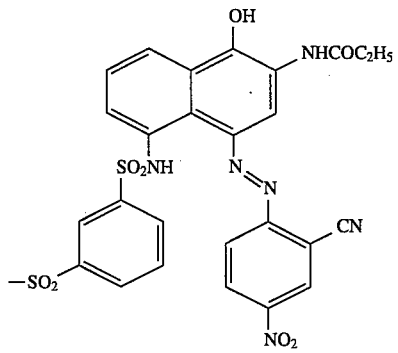 |

TABLE 1-continued
| Compound No. | Structure other than D | Structure of D |
|---|---|---|
| C-14 | 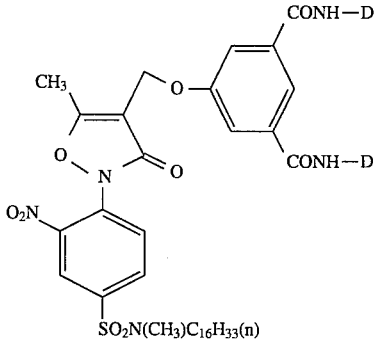 | 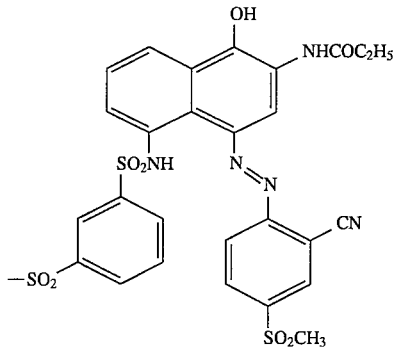 |
| Y-11 | 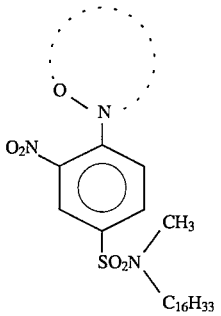 | 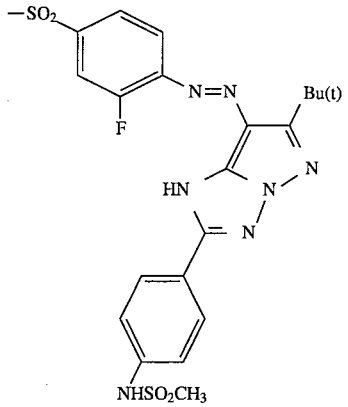 |
| M-9 | 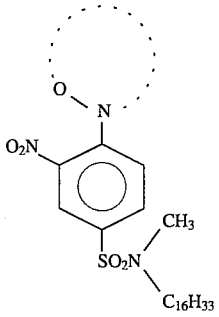 | 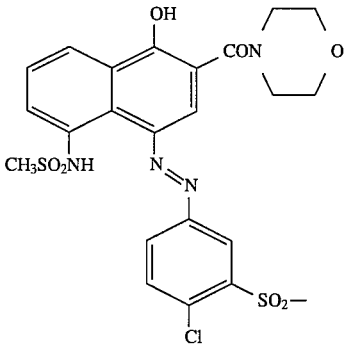 |
| C-15 | 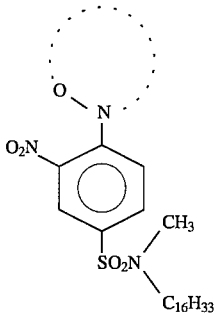 | 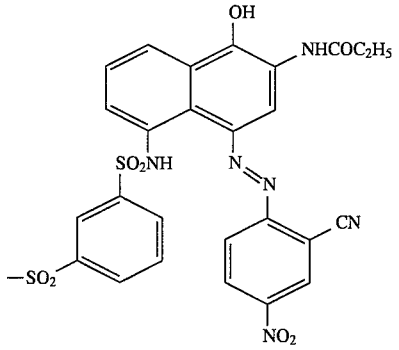 |

TABLE 1-continued
| Compound No. | Structure other than D | Structure of D |
|---|---|---|
| C-16 | 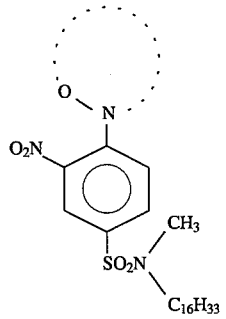 | 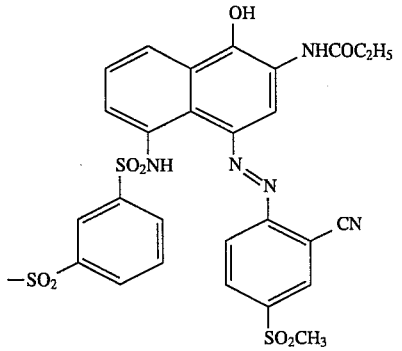 |
| Y-12 | 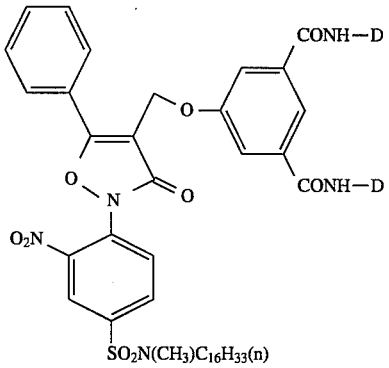 | 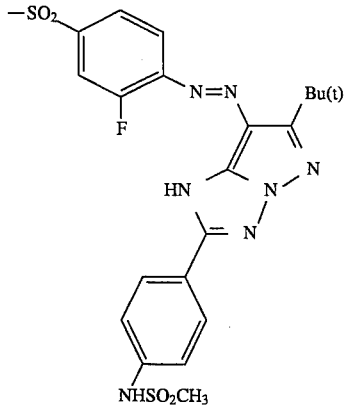 |
| M-10 | 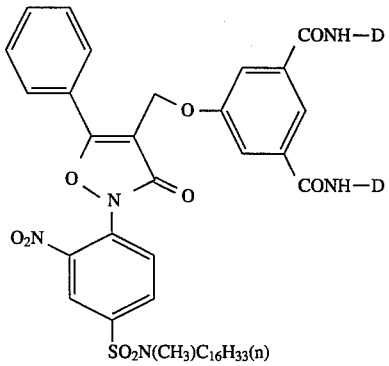 | 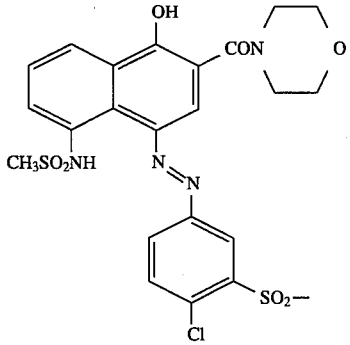 |
| C-17 | 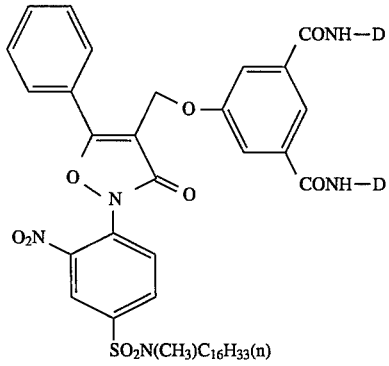 | 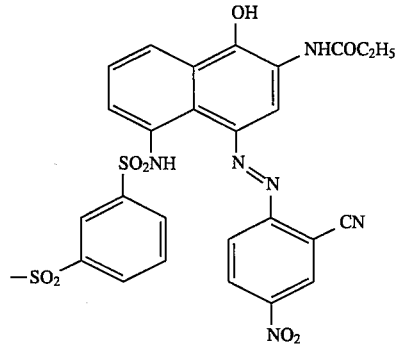 |

TABLE 1-continued
| Compound No. | Structure other than D | Structure of D |
|---|---|---|
| C-18 | 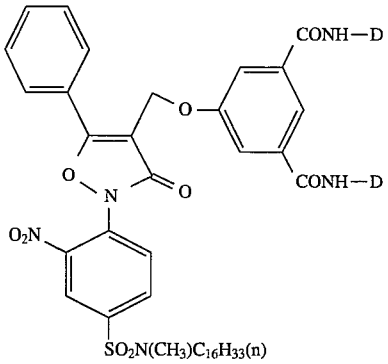 | 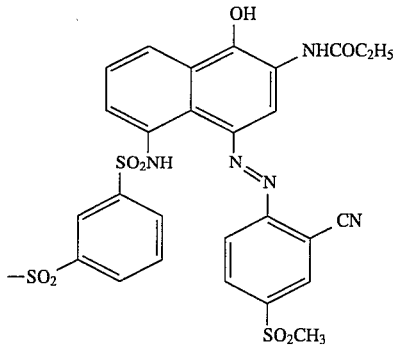 |
| Y-13 | 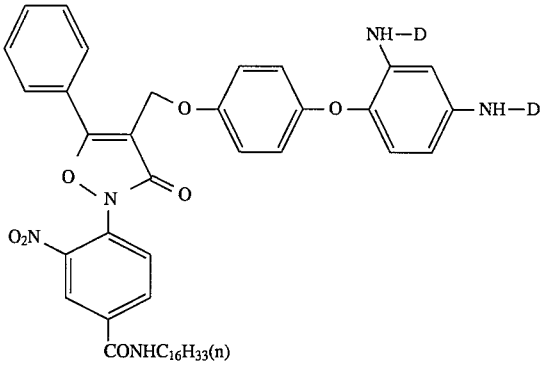 | 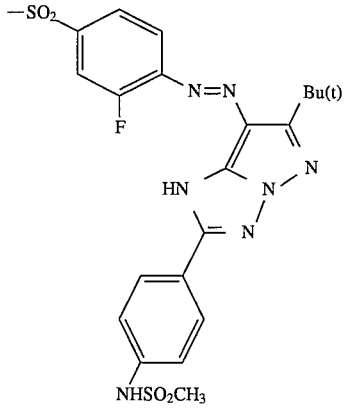 |
| M-11 | 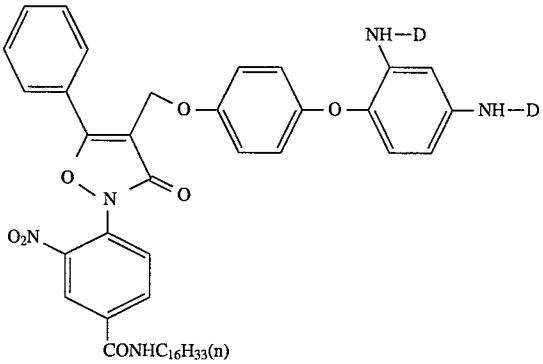 | 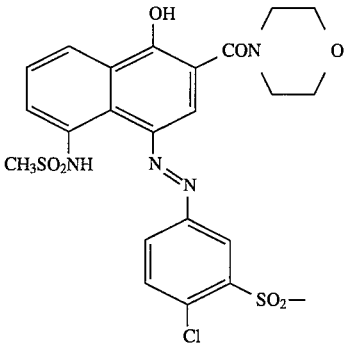 |
| C-19 | 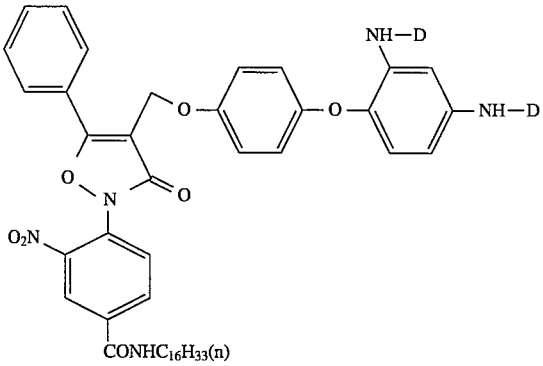 | 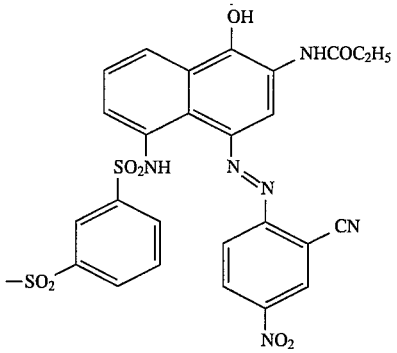 |

TABLE 1-continued
| Compound No. | Structure other than D | Structure of D |
|---|---|---|
| C-20 | 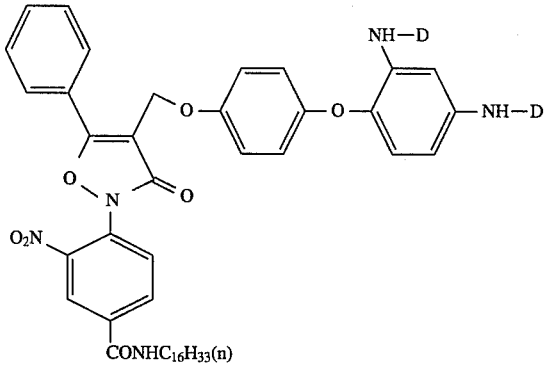 | 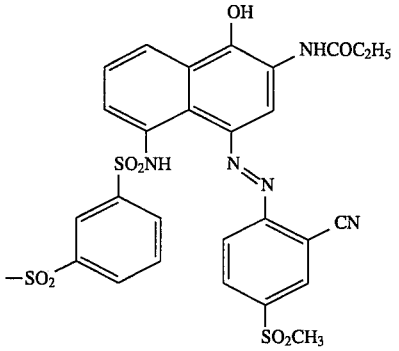 |
| Y-14 | 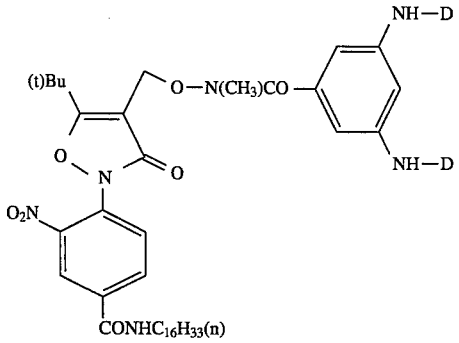 | 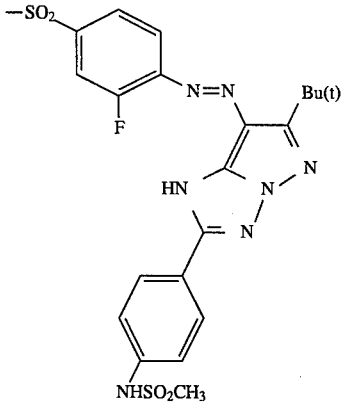 |
| M-12 | 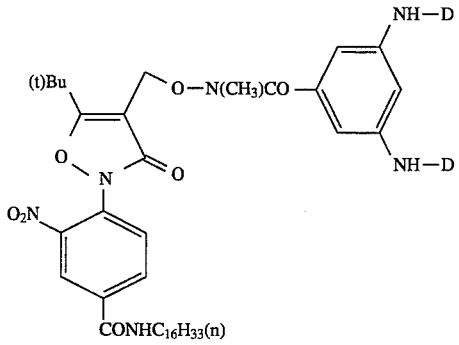 | 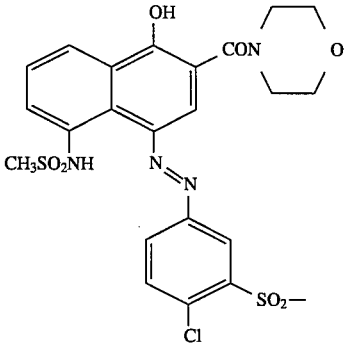 |
| C-21 | 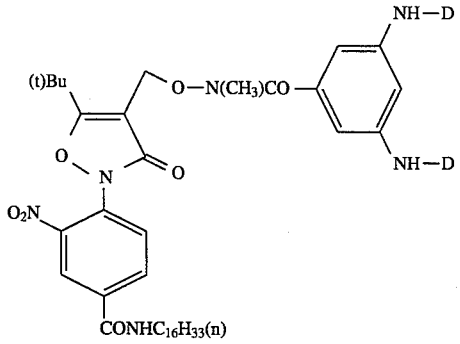 | 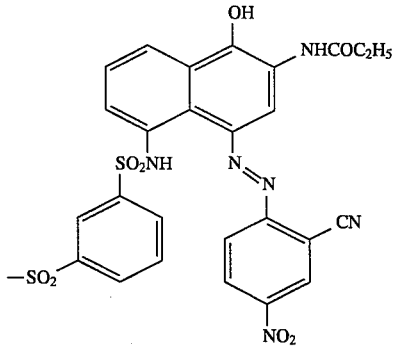 |

TABLE 1-continued
| Compound No. | Structure other than D | Structure of D |
|---|---|---|
| C-22 | 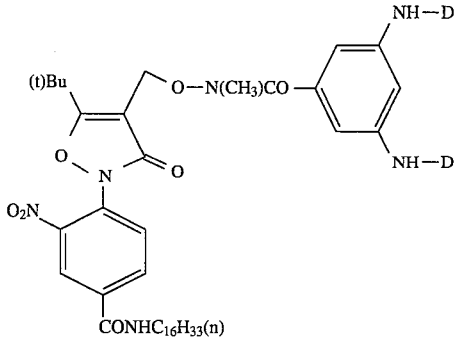 | 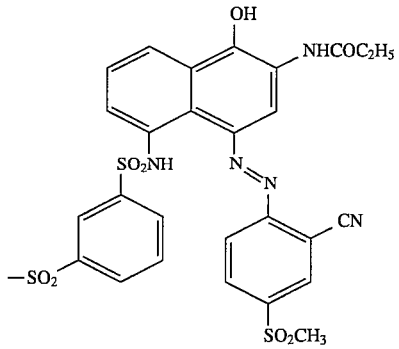 |
| Y-15 | 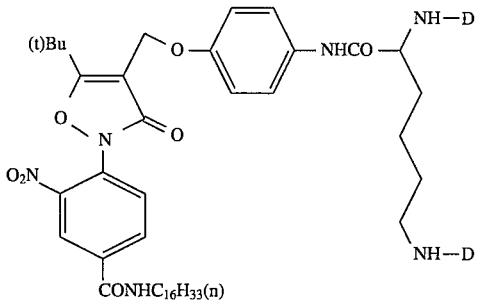 | 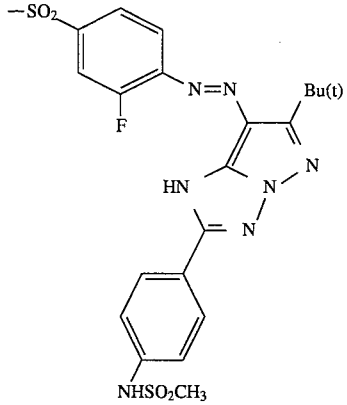 |
| M-13 | 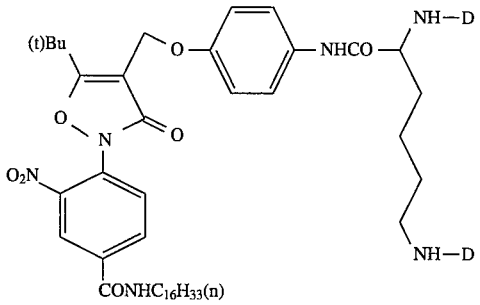 | 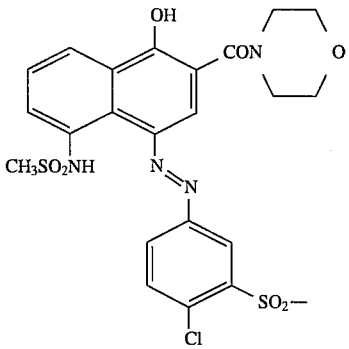 |
| C-23 | 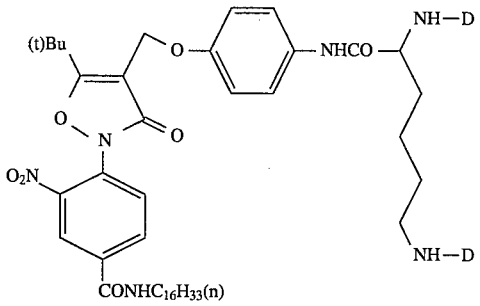 | 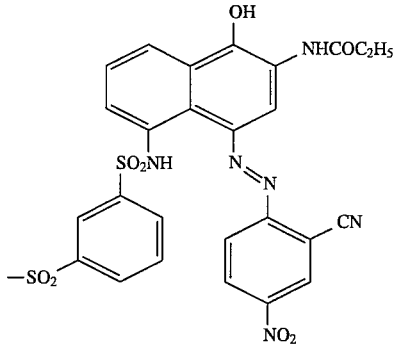 |

TABLE 1-continued
| Compound No. | Structure other than D | Structure of D |
|---|---|---|
| C-24 | 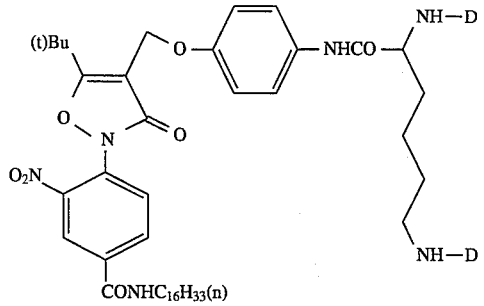 | 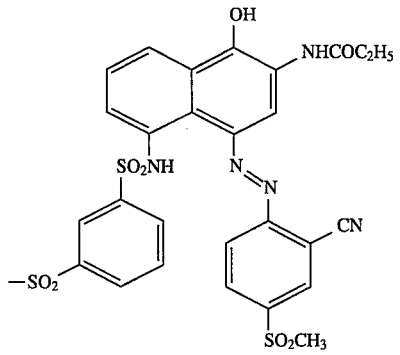 |
| C-25 | 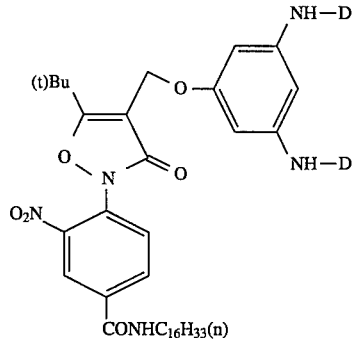 | 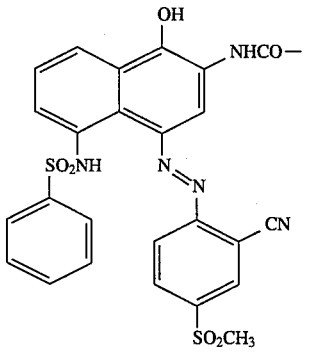 |
| Y-16 | 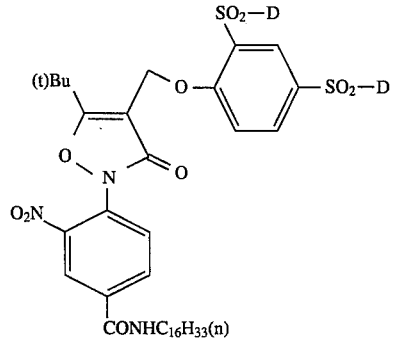 | 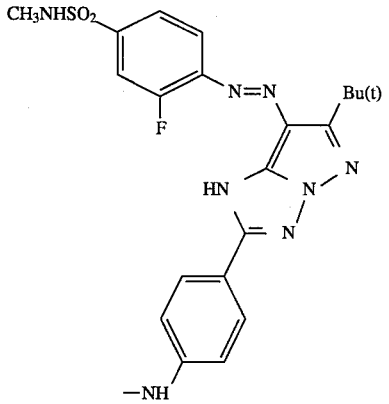 |
| M-14 | 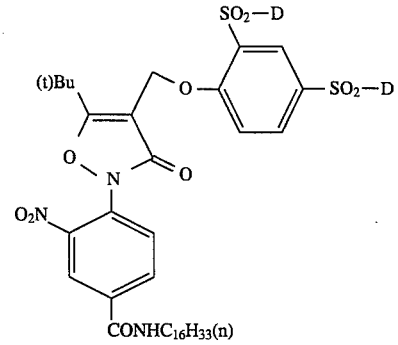 | 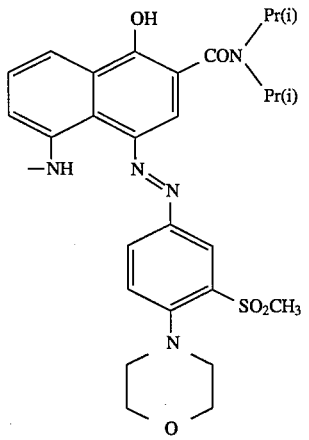 |

TABLE 1-continued
| Compound No. | Structure other than D | Structure of D |
|---|---|---|
| C-26 | 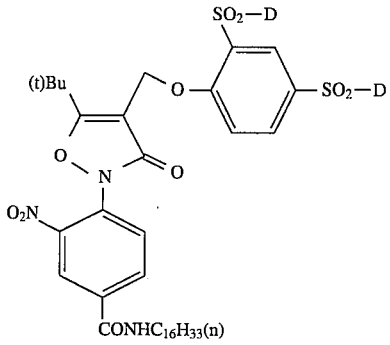 | 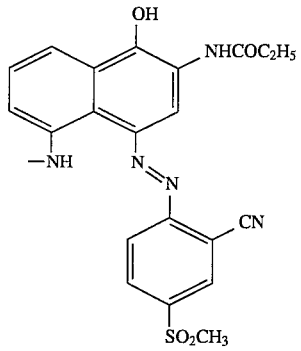 |
| C-27 | 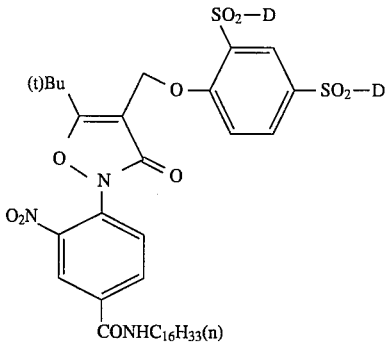 | 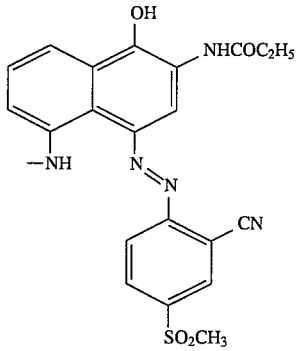 |
| C-28 | 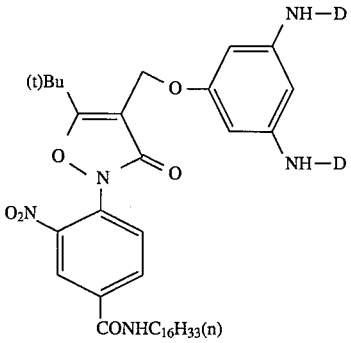 | 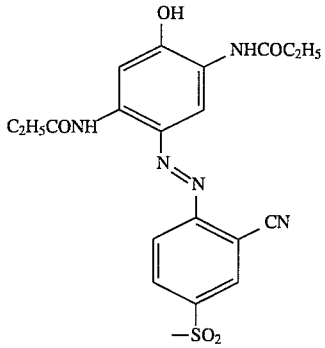 |
Next, the synthetic examples of the compound of the present invention will be shown.
Synthesis of the specific compound example Y-1
Synthesis of intermediate (A)
(Synthetic route)
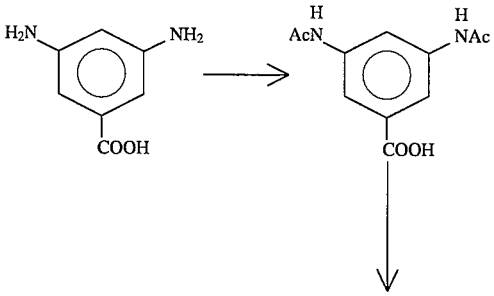

-continued

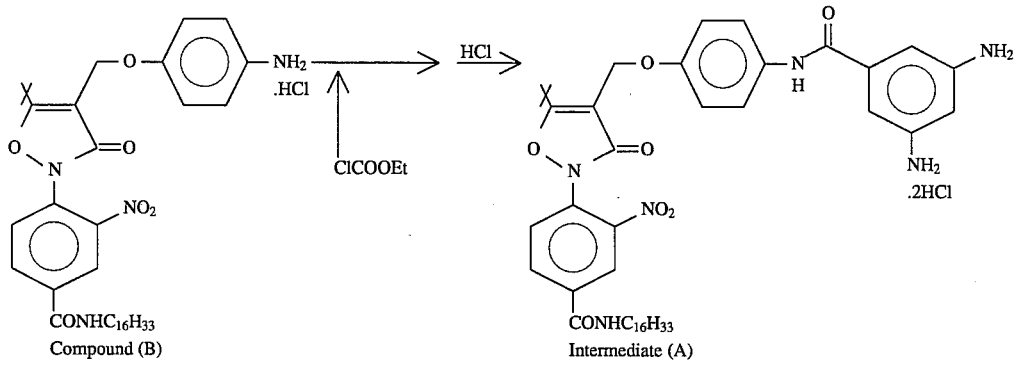

(i) Synthesis of 3,5-diacetylaminobenzoic acid:

Water 2.0 liter was added to 3,5-diaminobenzoic acid 100 g and stirring was applied while cooling with ice, followed by dropping acetic anhydride 314 ml while maintaining a temperature at 20° to 25° C. Further, after carrying out a reaction at a room temperature for one hour, crystal was filtered off and washed with water, followed by drying, whereby 3,5-diacetylaminobenzoic acid 148 g was obtained. (Yield: 95%).

(ii) Synthesis of intermediate (A):

Acetonitrile 600 ml and triethylamine 29.5 ml were added to 3,5-diacetylaminobenzoic acid 50 g for dissolution and stirring was applied while cooling with ice. Ethyl chlorocarbonate 20.2 ml was dropped while maintaining a temperature at 10° C. or lower, and then compound (B) 124 g was added, followed by further continuing a reaction at a temperature of 30° to 40° C. for 4 hours while dropping triethylamine 30 ml. After the reaction, crystal was filtered off and washed with water, followed by further washing with methanol and drying.

After drying, ethanol 750 ml and conc. sulfuric acid 250 ml were added to the crystal and heated for refluxing for one hour. After the reaction, a solution was cooled down to 0° C. and crude crystal formed was filtered off. The crystal was dissolved in methanol 300 ml by heating and then acetonitrile 1.0 liter was added for crystallization, whereby crystal 102 g of intermediate (A) was obtained. (Yield: 66%). m.p.: 188° to 192° C. (changed to a blackish brown color).

Synthesis of the specific compound example Y-1

Dimethylacetoamide 500 ml and α-picoline 60 ml were added to intermediate (A) 100 g and stirring was applied while cooling with ice. Yellow dye acid chloride (C) 95 g was added over a period of about one hour while maintaining a temperature at 10° C. or lower, and a reaction was further carried out at a room temperature for 2 hours. After the reaction, pyridine 10 ml and water 10 ml were added and heated to 60° C. in order to remove by-products, followed by adding water and ethyl acetate for extraction. An extract was washed with diluted hydrochloric acid and saturated aqueous salt, followed by adding magnesium sulfate for drying and concentrating with a rotary evaporator, Dimethylacetoamide 400 ml, acetonitrile 800 ml, methanol 1000 ml, and pyridine 20 ml were added to a concentrate, and heating was applied for dissolution. Then, acetone 100 ml and water 30 ml were added and stood for cooling. About 15 hours later, water 20 ml was added and stirring was carried out for further 2 hours to obtain crystal by filtering. This crystal was recrystallized further twice at the same crystallization condition, whereby the high purity specific compound example Y-1 58 g was obtained. (Yield: 34%).

Yellow dye acid chloride

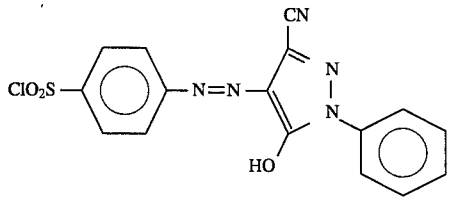

Physical values of specific compound example Y-1:

$^1$H-NMR data (in a heavy. DMSO solution): δ10.67 (2H, s), δ10.20 (1H, s), δ8.85 (1H, t), δ8.55 (1H, d), δ8.30 (1H, dd), δ8.05 to 7.70 (14H, m), δ7.60 (2H, d), δ7.55 to 7.20 (10H, m), δ7.02 (2H, d), δ4.84 (2H, s), δ3.30 (2H, dt), δ1.40 (9H, s), δ1.62 to 1.10 (28H, m), δ0.86 (3H, t). m. p.: 159° to 162° C.

Synthesis of specific compound example M-9

(i) Synthesis of intermediate (D):

(Synthetic route)

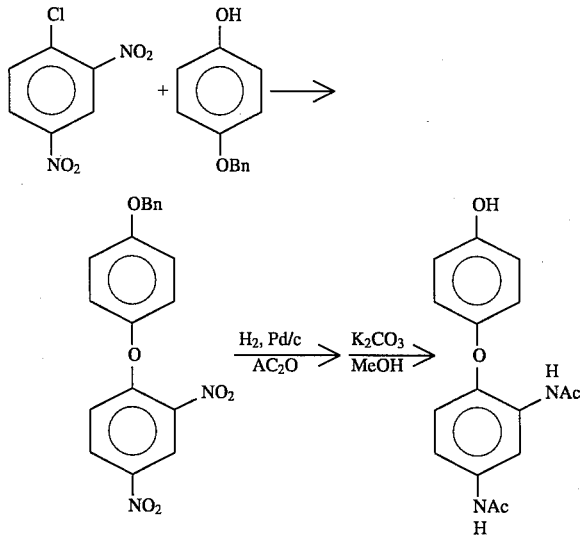

Intermediate (D)

Dimethylacetoamide 250 ml was added to 2,4-dinitrochlorobenzene 25.3 g, hydroquinone monobenzyl ether 25.0 g, and potassium carbonate 50 g, and a reaction was carried out at 100° C. for 40 minutes. After the reaction, water-ethyl acetate were added for extraction and magnesium sulfate was added to the extract for drying, followed by concentrating with a rotary evaporator.

Ethyl acetate 250 ml and 10%-palladium carbon 3.0 g were added to the concentrate and a mixture was put in an autoclave of 1.0 liter. Hydrogen was charged thereinto at 100 atm and a reaction was carried out at a room temperature for 2 hours, further followed by heating to 75° C. to carry out the reaction for 2 hours.

After finishing the reaction, acetic anhydride 70 ml and pyridine 30 ml were added to the contents and stirring was applied at a room temperature for one hour. Then, cellaite filtration was carried out to remove palladium-carbon and water was added to the filtrate for extraction. The extract was washed with saturated aqueous salt and magnesium sulfate was added for drying, followed by concentrating with the rotary evaporator.

Methanol 300 ml and potassium carbonate 80 g were added to the concentrate and stirring was applied while cooling with ice, followed by further carrying out a reaction at a room temperature for 2 hours. After finishing the reaction, potassium carbonate was removed by cellaite filtration and the filtrate was concentrated with a rotary evaporator. Ethyl acetate 500 ml, water 300 ml, and acetic acid 30 ml were added to the concentrate for extraction, and the extract was washed with saturated aqueous salt, followed by adding magnesium sulfate for drying and concentrating with a rotary evaporator. The concentrate was refined with a column chromatography to thereby obtain intermediate (D). A yield was 62 g and a yield was 80%.

(ii) Synthesis of intermediate (E):

(Synthetic route)

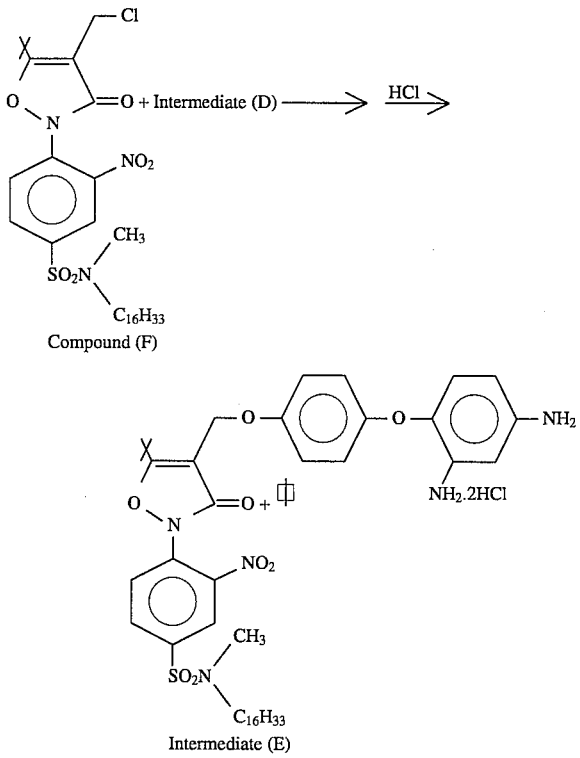

Acetone 600 ml, potassium carbonate 50 g, sodium iodide 3 g, and trismethoxyethoxyethylamine 3 ml were added to intermediate (D) 62.0 g and the compound (F) 109 g and heating for refluxing was carried out for 2.5 hours. After a reaction, the solution was concentrated with a rotary evaporator under reduced pressure, and water 500 ml and ethyl acetate 600 ml were added for extraction. An ethyl acetate layer was concentrated with a rotary evaporator. Ethanol 600 ml and 12N-HCl 200 ml were added to the concentrate and heating for refluxing was carried out for one hour. After completion, the solution was cooled down to 0° C. to form crystal and this was filtered off, whereby intermediate (E) 140 g was obtained. (m. p.: 75° to 77° C.).

(iii) Synthesis of specific compound example M-9:

Dimethylacetoamide 120 ml and sodium bicarbonate 18 g were added to intermediate (E) 26 g and stirring was applied at a temperature of 40° C. Magenta dye acid chloride (G) 38 g was added over a period of 2 hours while maintaining the temperature at 40° to 45° C., and a reaction was continued for further 3 hours after finishing addition. After pyridine 5 ml and water 5 ml were added to the reaction solution and stirring was carried out at 50° to 60° C. for one hour, ethyl acetate 1.0 liter and water 1.0 liter were added for extraction and a 2%-sodium bicarbonate aqueous solution 500 ml was added to an ethyl acetate layer for washing, followed by adding 1N-hydrochloric acid 500 ml for washing and further adding saturated aqueous salt 500 ml for washing. Magnesium sulfate was added to the extracte for drying, and then the solution was concentrated with a rotary evaporator under reduced pressure. The concentrate was refined with a column chromatography (solvent: $CH_2Cl_2$—MeOH), whereby specific compound example M-9 (42 g) was obtained. (Yield: 73%). Magenta dye acid chloride (G)

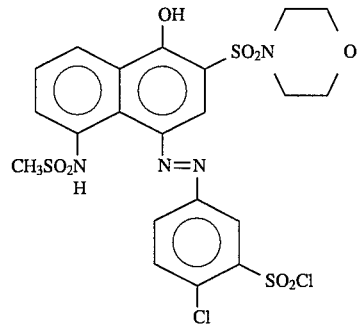

Physical value of the specific compound example M-9:

$^1$H-NMR data (in a heavy DMSO solution): δ12.54 (1H, bs), δ12.46 (1H, bs), δ10.53 (1H, s), δ9.97 (1H, s), δ8.88 to 8.75 (3H, m), δ8.52 (1H, s), δ8.29 (1H, d), δ8.12 (2H, bs), δ8.03 (2H, bs), δ7.90 (1H, d), δ7.80 to 7.67 (4H, m), δ7.53 (1H, d), δ7.46 (1H, d), δ7.40 to 7.20 (3H, m), δ6.96 to 6.83 (3H, m), δ6.68 to 6.51 (3H, m), δ4.68 (2H, bs), δ3.58 (8H, m), δ3.17 (8H, m), δ3.07 (6H, s), δ1.34 (9H, s), δ1.62 to 1.16 (30H, m), δ0.86 (3H, t). In the light-sensitive material of the present invention, the dye-providing compound of the present invention, that is, the compound of formula (I) may be used for all of three colors (yellow, magenta and cyan), or the dye-providing compound of the present invention may be used for any one or two colors and a conventional dye-providing compound may be used for the others.

A positive working dye releasing redox compound represented by formula (V) can be used as the dye-providing compound used in combination:

$$\text{DYE–Y} \qquad \text{(V)}$$

wherein DYE represents a dye or the precursor thereof, and Y represents a component which is reduced under alkaline condition to release Dye. The descriptions at page 16, a left upper column to page 17, a right lower column, line 7 of JP-A-2-32335 can be applied for the representative examples of Y and the compounds of the positive type. A reducing agent (described as an electron-providing product in some cases) is used to release dyes from the reducible dye-providing compounds of the present invention and those used in combination.

The reducing agent may be supplied from an outside, or it may be incorporated in advance into a light-sensitive material. Further, there can be used as well a reducing agent precursor which does not have a reducibility in itself but reveals the reducibility by an action of a nucleophilic reagent and heat in the course of a development.

The examples of the electron-providing material used in the present invention include the electron-providing materials and the electron-providing material precursors described in columns 49 and 50 of U.S. Pat. No. 4,500,626, columns 30 and 31 of U.S. Pat. No. 4,483,914, and U.S. Pat. Nos. 4,330,617 and 4,590,152, at pages 17 and 18 of JP-A-60-140335, JP-A-57-40245, JP-A-56-138736, JP-A-59-178458, JP-A-59-53831, JP-A-59-182449, JP-A-59-182450, JP-A-60-119555, JP-A-60-128436 to JP-A-60-128439, 60-198540, 60-181742, 61-259253, 60-244044, and 62-131253 to 62-131256, and at pages 78 to 96 of European Patent 220,746A2.

A combination of such various electron-providing materials as those described in U.S. Pat. No. 3,039,869 can be used as well.

In the case where the dye-providing compound of the present invention is nondiffusible, or a reducing agent used in combination with the reducible dye-providing compound of the present invention is nondiffusible, an electron transfer agent may be used.

The electron transfer agent or the precursor thereof can be selected from the electron-providing materials or the precursors thereof described above. The electron transfer agent or the precursor thereof has preferably a larger mobility than that of a nondiffusible dye-providing material. The particularly useful electron transfer agent is 1-phenyl-3-pyrazolidones or aminophenols.

The nondiffusible dye-providing material used in combination with the electron transfer agent may be any one of the reducing agents described above as long as they do not substantially move in a layer of a light-sensitive material. There can preferably be enumerated hydroquinones, sulfonamidophenols, sulfonamidonaphthols, and the compounds described in JP-A-53-110827 as the electron-providing material. The electron transfer agent may be supplied from an outside, or it may be incorporated in advance into a light-sensitive material.

The dye-providing compound of the present invention is incorporated preferably into the same layer as that containing a light-sensitive silver halide emulsion but it may be incorporated into any layer if it is kept in a reactive condition directly or via an electron transfer agent. For example, the presence of a colored dye-providing compound in a layer lower than a silver halide emulsion layer can prevent reduction of a sensitivity.

The dye-providing compound of the present invention can be used for a diffusion transfer type color photographic light-sensitive material, and there can be applied as a developing and image-forming process therefor, a process in which a processing composition is spread in a vicinity of a room temperature and a process in which a trace of water is supplied or a heat solvent is incorporated to carry out a heat development.

First, the color diffusion transfer process will be described.

A representative form of a film unit used for the color diffusion transfer process is a form in which an image receiving element (a dye-fixing element) and a light-sensitive element are laminated on a transparent support and it is not necessary to peel off the light-sensitive element from the image receiving element after completing a transferred image. To describe further specifically, the image-receiving element consists of at least one mordant layer. Meanwhile, in a preferred embodiment of the light-sensitive element, a combination of a blue-sensitive emulsion layer, a green-sensitive emulsion layer and a red-sensitive emulsion layer or a combination of a green-sensitive emulsion layer, a red-sensitive emulsion layer and an infrared-sensitive emulsion layer is combined with a yellow dye-providing material, a magenta dye-providing material and a cyan dye-providing material for the above respective emulsion layers to constitute the light-sensitive element (wherein "the infrared-sensitive emulsion layer" means an emulsion layer having a sensitivity to light of 700 nm or more, particularly 740 nm or more). A white color reflection layer containing a solid pigment such as titanium oxide is provided between the above mordant layer and light-sensitive layer or dye-providing material-containing layer so that a transferred image can be enjoyed through the transparent support.

Further, a light-shielding layer may be provided between the white color reflection layer and the light-sensitive layer so that a development processing can be completed under a daylight. A peeling layer may be provided at a suitable portion so that all or a part of the light-sensitive element can be peeled off from the image-receiving element (such an embodiment is described in, for example, JP-A-56-67840 and Canadian Patent 674,082).

Further, an another embodiment of a laminating and peeling type includes a color diffusion transfer photographic film unit characterized by comprising a light-sensitive element having at least (a) a layer having a neutralizing function, (b) a dye-receiving layer, (c) a peeling layer, and (d) at least one silver halide emulsion layer combined with a dye image-forming material each provided in order on a white color support, an alkali processing composition containing a light shielding agent, and a transparent cover sheet, and having a layer having a light shielding function on the side opposite to the side on which the emulsion layer and processing composition are provided, as disclosed in JP-A-63-226649.

In another form in which peeling is not necessary, the above light-sensitive element is provided on one transparent support and a white color reflection layer is provided thereon. Further, an image-receiving layer is provided thereon. There is described in U.S. Pat. No. 3,730,718, an embodiment in which an image-receiving layer, a white color reflection layer, a peeling layer, and a light-sensitive element are provided on the same support and the light-sensitive element is intentionally peeled from the image-receiving element.

Meanwhile, a representative form in which a light-sensitive element and an image-receiving element are independently provided on the two supports, respectively, is divided roughly into two categories; one is a peeling type and the other is a non-peeling type. To explain these in detail, in a preferred embodiment of a peeling type film unit, at least one image-receiving layer is provided on one support and a light-sensitive element is provided on a support having a light-shielding layer, wherein it is designed so that while a light-sensitive layer-coated face and a mordant layer-coated face are not opposite before finishing an exposure but the light-sensitive layer-coating face is upset after finishing the exposure (for example, during a development processing) to be superposed on the image-receiving layer-coating face. After a transferred image is completed on the mordant layer, the light-sensitive element is immediately peeled from the image-receiving element.

Meanwhile, in a preferred embodiment of a non-peeling type film unit, at least one mordant layer is provided on a transparent support and a light-sensitive element is provided on a transparent support or a support having a light-shielding layer, wherein a light-sensitive layer-coated face and a mordant layer-coated face are face with each other. Further, a pressure-breakable vessel (a processing element) containing an alkali processing composition may be combined with the forms mentioned above. Among them, in the non-peeling type film unit in which an image-receiving element and a light-sensitive element are provided on one support, this processing element is provided preferably between the light-sensitive element and a cover sheet superposed thereon. In the form in which a light-sensitive element and an image-receiving element are independently provided on two supports, respectively, the processing element is preferably provided between the light-sensitive element and the image-receiving element at latest in a development processing. The processing element contains preferably a light shielding agent (for example, carbon black and a dye, the color of which changes according to pH) and/or a white pigment (titanium oxide and others) according to a form of a film unit. Further, in a film unit of a color diffusion transfer system, a neutralization timing mechanism consisting of the combination of a neutralizing layer and a neutralization timing layer is preferably incorporated into a cover sheet, an image-receiving element or a light-sensitive element.

The image-receiving element in the color diffusion transfer process will be explained below in more details. The image-receiving element in the color diffusion transfer process has preferably at least one layer containing a mordant (a mordant layer). The publicly known compounds can be used as the mordant agent. The specific examples thereof are described in British Patents 2,011,912, 2,056,101, and 2,093,041, U.S. Pat. Nos. 4,115,124, 4,273,853, and 4,282,305, and JP-A-59-232340, JP-A-60-118834, JP-A-60-128443, JP-A-60-122940, JP-A-60-122921, and JP-A-60-235134.

In addition thereto, various additives can suitably be used for the image-receiving element used for a color diffusion transfer process, which will be explained together in an item of a dye-fixing element (an image receiving element) used for the heat development color diffusion transfer process.

Next, a light-sensitive element in the color diffusion transfer process will be explained. The descriptions in a right lower column, line 8 at page 17 to a right lower column, line 19 at page 20 of JP-A-2-32335 are applied to a silver halide emulsion, a spectral sensitizing dye, an emulsion layer, a full color multilayer constitution, a processing composition, and a color diffusion transfer process film unit and the constituent layer thereof each used for the color diffusion transfer process.

Next, a peeling layer in the color diffusion transfer process will be explained.

The peeling layer used in the present invention can be provided at an arbitrary position of a light-sensitive sheet in a unit after processing. There can be used as a material for peeling, those described in, for example, JP-A-47-8237, JP-A-59-220727, and JP-A-49-4653, U.S. Pat. Nos. 3,220,835 and 4,359,518, JP-A-49-4334, JP-A-56-65133, and JP-A-45-24075, and U.S. Pat. Nos. 3,227,550, 2,759,825, 4,401,746, and 4,366,227. To be specific, a water soluble (or alkali soluble) cellulose derivative can be enumerated. It includes, for example, hydroxyethyl cellulose, cellulose acetate phthalate, plasticized methyl cellulose, ethyl cellulose, cellulose nitrate, and carboxymethyl cellulose. Further, it includes various natural polymers, for example, alginic acid, pectin, and gum arabic. There are used as well various modified gelatins, for example, acetylated gelatin and phthalized gelatin. Further, there are included polyvinyl alcohol, polyacrylate, polymethyl methacrylate, or the copolymers thereof. Of them, the cellulose derivative is preferably used as a material for peeling and hydroxyethyl cellulose is particularly preferably used.

Further, in addition to a water soluble cellulose derivative, a grainy material of an organic polymer can be used as the material for peeling.

There can be enumerated as the organic polymer used in the present invention, the polymer latexes of polyethylene, polystyrene, polymethyl methacrylate, polyvinylpyrrolidone, and polybutyl acrylate each having an average particle size of 0.01 to 10 μm. Herein, preferably used is a light reflective hollow polymer latex including a material containing air at an inside and consisting of an organic polymer at an outside, as described below. The above light reflective hollow polymer latex can be synthesized by the process described in JP-A-61-151646.

Next, a heat developing color diffusion transfer process will be explained. In order to use the three primary colors, yellow, magenta and cyan, to obtain a color of a wide range in a chromaticity diagram, at least three silver halide emulsion layers each having a sensitivity in a different spectral region are used in combination. There are available, for example, the combination of the three layers, for example, a blue-sensitive layer, a green-sensitive layer and a red-sensitive layer and the combination of a green-sensitive layer, a red-sensitive layer and an infrared-sensitive layer. The respective light-sensitive layers can take various arrangement orders known in a conventional type color light-sensitive material. Further, these respective light-sensitive layers may be divided into two or more layers as needed.

The heat developing light-sensitive material can be provided with various auxiliary layers such as a protective layer, a subbing layer, an intermediate layer, a yellow color filter layer, an anti-halation layer, and a back layer.

Silver halide capable of being used in the present invention may be any of silver chloride, silver bromide, silver bromoiodide, silver bromochloride, silver chloroiodide, and silver bromochloroiodide.

The silver halide emulsion used in the present invention may be either a surface latent image type emulsion or an inner latent image type emulsion. The inner latent image type emulsion is used as a direct reversal emulsion in combination with a nucleus-forming agent and a fogging agent. It may be a so-called core/shell emulsion in which a grain inside and a grain surface have the different phases. The silver halide emulsion may be monodispersed or polydispersed, and the monodispersed emulsions may be used in a mixture. A grain size is preferably 0.1 to 2 μm, particularly preferably 0.2 to 1.5 μm. A crystal habit of a silver halide grain may be any of cube, octahedron, tetradecahedron, plate having a high aspect ratio, and others.

Specifically, there can be used any of the silver halide emulsions described in column 50 of U.S. Pat. Nos. 4,500,626, and 4,628,021, Research Disclosure (hereinafter abbreviated as RD) 17029 (1978), and JP-A-62-253159, JP-A-3-110555, JP-A-2-236546, and JP-A-1-167743.

A silver halide emulsion may be used as it is non-postripening but it is usually subjected to a chemical sensitization before use. There can be used singly or in combination a sulfur sensitization process, a reduction sensitization process, a novel metal sensitization process, and selenium sensitization process, each publicly known in an emulsion for a conventional type light-sensitive material. These chemical sensitizations can be carried out as well in the presence of a nitrogen-containing heterocyclic compound (JP-A-62-253159).

A coating amount of the light-sensitive silver halide used in the present invention falls in the range of 1 mg to 10 g/m$^2$ in terms of the amount of silver.

In the present invention, an organic metal salt can also be used as an oxidizing agent in combination with light-sensitive silver halide. Of such the organic metal salts, an organic silver salt is particularly preferably used. The organic compounds which can be used for forming the above organic silver salt oxidizing agent include benzotriazoles described in U.S. Pat. No. 4,500,626, columns 52 to 53, aliphatic acid, and other compounds. Further, also useful are a silver salt of carboxylic acid having an alkynyl group, such as silver pheylpropiolate described in JP-A-60-113235, and acetylene silver described in JP-A-61-249044. The organic silver salts may be used in combination of two or more kinds.

The above silver salts can be used in combination in the amount of 0.01 to 10 moles, preferably 0.01 to 1 mole per mole of light-sensitive silver halide. The total coated amount of the light-sensitive silver halide and the organic silver salt is suitably 50 mg to 10 g/m$^2$ in terms of the amount of silver.

In the present invention, various anti-fogging agents or photographic stabilizers can be used. There can be used as the example thereof, azoles and azaindenes described in RD 17643 (1978), pages 24 to 25, carboxylic acid containing nitrogen and phosphoric acids described in JP-A-59-168442, the mercapto compounds and the metal salts thereof described in JP-A-59-111636 and JP-A-4-73649, and the acetylene compounds described in JP-A-62-87957 and JP-A-4-255845.

Silver halides used in the present invention may be spectrally sensitized with methine dyes and others. There are included in the dyes used, a cyanine dye, a merocyanine dye, a composite cyanine dye, a composite merocyanine dye, a holopolarcyanine dye, a hemicyanine dye, a styryl dye, and a hemioxonol dye.

Specifically, there can be enumerated the sensitizing dyes described in U.S. Pat. No. 4,617,257, JP-A-59-180550 and JP-A-60-140335, and RD 17029 (1978) pages 12 to 13. These sensitizing dyes may be used either singly or in combination thereof. The combination of the sensitizing dyes is used particularly for the purpose of a supersensitization in many cases.

In addition to the sensitizing dyes, there may be contained in an emulsion the dyes having no spectral sensitization action by themselves or the compounds which do not substantially absorb visible rays and show a supersensitization (for example, the compounds described in U.S. Pat. No. 3,615,641, and JP-A-63-23145).

Timing when these sensitizing dyes are added to an emulsion may be in a chemical ripening or before or after that, or before or after a nucleus formation of a silver halide grain according to U.S. Pat. Nos. 4,183,756 and 4,225,666. In general, an addition amount is $10^{-8}$ to $10^{-2}$ mole per mole of silver halide.

A hydrophilic compound is preferably used for a binder contained in a constitutional layer of a light-sensitive material and a dye-fixing element. The compounds described at the pages 26 to 28 of JP-A-62-253159 can be enumerated as the example thereof. Specifically, a transparent or translucent hydrophilic binder is preferred, and there can be enumerated, for example, a natural compound such as protein including gelatin and a gelatin derivative, and polysaccharides including a cellulose derivative, starch, gum arabic, dextran, and pluran, and a synthetic high molecular compound such as polyvinyl alcohol, polyvinyl pyrrolidone, and an acrylamide polymer, and others. Further, there can be used a high water absorptive polymer described in JP-A-62-245260, that is, a homopolymer of a vinyl monomer having —COOM or —$SO_3M$ (M is a hydrogen atom or an alkali metal), or a copolymer of these vinyl monomers themselves or with the other vinyl monomers (for example, sodium methacrylate, ammonium methacrylate, and Sumika Gel L-5H manufactured by Sumitomo Chemical Ind. Co., Ltd.). These binders can be used as well in combination of two or more kinds.

In the case where the system in which a trace of water is supplied to carry out a heat development is applied, the use of the above high water absorptive polymer makes it possible to rapidly absorb water. Further, the use of the high water absorptive polymer can prevent a dye from retransferring from a dye-fixing element to the others after transferring. In the present invention, a coating amount of a binder is preferably 20 g or less, particularly 10 g or less, and suitably 7 g or less per m$^2$.

Various polymer latexes can be incorporated into a constitutional layer (including a back layer) of a light-sensitive material or a dye-fixing element for the purposes of an improvement in a film physical property such as a dimension stability, a curling prevention, a sticking prevention, a cracking prevention of a film, and a pressure sensitization or desensitization prevention. Specifically, there can be used any of the polymer latexes described in JP-A-62-245258, JP-A-62-136648 and JP-A-62-110066. In particular, the use of a polymer latex having a low glass transition point (40° C. or lower) for a mordant layer can prevent cracking of the mordant layer and the use of a polymer latex having a high glass transition point can provide a curling prevention effect.

In the present invention, a development inhibitor-releasing redox compound can be used. There can be used, for example, those described in JP-A-61-213,847, JP-A-62-260,153, JP-A-2-68,547, JP-A-2-110,557, JP-A-2-253,253, and JP-A-1-150,135.

The synthetic processes of the development inhibitor-releasing redox compounds used in the present invention are described in JP-A-61-213,847 and JP-A-62-260,153, U.S. Pat. No. 4,684,604, JP-A-1-269936, U.S. Pat. Nos. 3,379,529, 3,620,746, 4,377,634, and 4,332,878, and JP-A-49-129,536, JP-A-56-153,336, and JP-A-56-153,342.

The development inhibitor-releasing redox compound of the present invention is used in a range of $1\times10^{-6}$ to $5\times10^{-2}$ mole, more preferably $1\times10^{-5}$ to $1\times10^{-2}$ mole per mole of silver halide.

The development inhibitor-releasing redox compound of the present invention can be used dissolving in a suitable water miscible organic solvent, for example, alcohols (methanol, ethanol, propanol, and fluorinated alcohol), ketones (acetone and methyl ethyl ketone), dimethylformamide, dimethylsulfoxide, and methyl cellosolve.

Further, they can be used dissolving by aid of oil such as dibutyl phthalate, tricresyl phthalate, glyceryl triacetate, or diethyl phthalate, and an auxiliary solvent such as ethyl acetate and cyclohexanone by a process already known well, to mechanically prepare an emulsified dispersion. Or, powder of the development inhibitor-releasing redox compound can be dispersed in water with a ball mill, a colloid mill, or a supersonic wave by a process known as a solid matter dispersion process to use them.

The development inhibitor-releasing redox compound can be used in combination with a releasing aid. Those described in, for example, JP-A-3-293666 can be used.

In dispersing a hydrophobic compound in a hydrophilic colloid, various surface active agents can be used. For example, those listed as the surface active agent at pages 37 to 38 of JP-A-59-157636 can be used.

In the present invention, there can be used a compound which provides the light-sensitive material with a stabilization of an image as well as an activation of a development. The specific compounds capable of being preferably used are described at the columns 51 to 52 of U.S. Pat. No. 4,500,626.

In a system in which an image is formed by a diffusion transfer of a dye, a dye-fixing element is used together with a light-sensitive material. The dye-fixing element may be either of a form in which the dye fixing-element is independently coated on a support different from that for the light-sensitive material, or a form in which it is coated on the same support as that for the light-sensitive material. With respect to the relationships of the light-sensitive element with the dye-fixing element, a support and a white color reflection layer, the relationships described at the 57th column of U.S. Pat. No. 4,500,626 can be applied as well to the present invention.

The dye-fixing element preferably used in the present invention has at least one layer containing a mordant and a binder. The compounds known in a photographic field can be used as the mordant and there can be enumerated as the specific example thereof, the mordants described at the columns 58 to 59 of U.S. Pat. No. 4,500,626 and the pages 32 to 41 of JP-A-61-88256, and those described in JP-A-62-244043 and 62-244036. Further, the dye-receivable high molecular compound described in U.S. Pat. No. 4,463,079 may be used as well. The dye-fixing element can be provided with an auxiliary layer such as a protective layer, a peeling layer, and an anti-curling layer according to necessity. In particular, the provision of the protective layer is useful.

There can be used for the constitutional layers for the light-sensitive material and the dye-fixing element, a plasticizer, a sliding agent, or a high boiling solvent as a peeling improver for the light-sensitive material and the dye-fixing element. The specific examples include those described in JP-A-62-253159, page 25 and JP-A-62-245253.

Further, there can be used for the above purpose, various silicon oils (all silicon oils from a dimethyl silicon oil to a modified silicon oil obtained by introducing various organic groups into dimethyl siloxane). Effective as the example thereof are various modified silicon oils described in "Modified Silicon Oil" technical literature P6-18B published by Shinetsu Silicon Co., Ltd., particularly carboxy-modified silicon oil (trade name: X-22-3710).

Silicon oils described in JP-A-62-215953 and JP-A-63-46449 are effective as well.

An anti-fading agent may be used for the light-sensitive material and the dye-fixing element. The anti-fading agent includes, for example, an antioxidant agent, a UV absorber, or some kind of a metal complex. The antioxidant includes, for example, a chroman series compound, a coumarane series compound, a phenol series compound (for example, hindered phenols), a hydroquinone derivative, a hindered amine derivative, and a spiroindane series compound. Further, the compounds described in JP-A-61-159644 are effective as well.

The UV absorber includes a benzotriazole series compound (U.S. Pat. No. 3,533,794), a 4-thiazolidone series compound (U.S. Pat. No. 3,352,681), a benzophenone series compound (JP-A-46-2784), and the other compounds described in JP-A-54-48535, JP-A-62-136641 and JP-A-61-88256. Further, the UV absorptive polymers described in JP-A-62-260152 are effective as well.

The metal complex includes the compounds described in U.S. Pat. Nos. 4,241,155, 4,245,018, columns 3 to 36, and U.S. Pat. No. 4,254,195, columns 3 to 8, and JP-A-62-174741, JP-A-61-88256, pages 27 to 29, JP-A-63-199248, JP-A-1-75568, and JP-A-1-74272.

Examples of the useful anti-fading agent are described in JP-A-62-215272, pages 125 to 137. The anti-fading agent used for preventing fading of a dye transferred to the dye-fixing element may be incorporated in advance into the dye-fixing element or may be supplied to the dye-fixing element from an outside such as the light-sensitive material The above antioxidant, UV absorber and metal complex may be used in combination of themselves.

A fluorescent whitening agent may be used for the light-sensitive material and the dye-fixing element. In particular, the fluorescent whitening agent is preferably incorporated into the dye-fixing element or preferably supplied from an outside such as the light-sensitive material. There can be enumerated as the examples thereof, the compounds described in "The Chemistry of Synthetic Dyes" edited by K. Veenkataraman, vol. V, chapter 8, and JP-A-61-143752. To be more specific, there can be enumerated a stilbene series compound, a coumarin series compound, a biphenyl series compound, a benzoxazolyl series compound, a napthalimide series compound, a pyrazoline series compound, and a carbostyryl series compound.

The fluorescent whitening agent can be used in combination with the anti-fading agent.

The hardeners described in U.S. Pat. No. 4,678,739, column 41, and JP-A-59-116655, JP-A-62-245261, and JP-A-61-18942 can be enumerated as a hardener used for the constitutional layers in a light-sensitive material and a dye-fixing element. More specifically, there can be enumerated an aldehyde series hardener (formaldehyde), an aziridene series hardener, an epoxy series hardener, a vinyl sulfone series hardener (N,N'-ethylene-bis(vinylsulfonylacetoamide)ethane), an N-methylol series hardener (dimethylolurea), and a polymer series hardener (the compounds described in JP-A-62-234157). The vinyl suofone series hardeners described in JP-A-3-114,043 are particularly preferably used.

Various surface active agents can be used for the constitutional layers in the light-sensitive material and the dye-fixing element for the purposes of a coating aid, improvement in a peeling performance, improvement in a sliding performance, anti-electrification, and development acceleration. The specific examples of the surface active agent are described in JP-A-62-173463 and JP-A-62-183457.

An organic fluoro compound may be incorporated into the constitutional layers in the light-sensitive material and the dye-fixing element for the purposes of improvement in a sliding performance, anti-electrification, and improvement in a peeling performance. There can be enumerated as the representative examples of the organic fluoro compound, a hydrophobic fluorine compound such as the fluorine series surface active agents described in JP-B-57-8083, the 8th to 17th columns, and JP-A-61-20944 and JP-A-62-135826, an oily fluorine series compound including fluorine oil, or a solid fluorine compound resin including a tetrafluoroethylene resin.

A matting agent can be used for the light-sensitive material and the dye-fixing element. The matting agent includes the compounds described in JP-A-63-274944 and JP-A-63-274952, such as benzoguanamine resin beads, polycarbonate resin beads, and AS resin beads, as well as the compounds described in JP-A-61-88256, page 29, such as silicon dioxide, polyolefin, or polymethacrylate.

In addition thereto, a heat solvent, a defoaming agent, an anti-fungous and anti-mold agent, and colloidal silica may be incorporated into the constitutional layers in the light-sensitive material and the dye-fixing element. The specific examples of these additives are described in JP-A-61-88256, pages 26 to 32.

In the present invention, an image-forming accelerator can be used for the light-sensitive material and/or the dye-fixing element. The image-forming accelerator has the functions such as acceleration of an oxidation-reduction reaction of a silver salt oxidizing agent with a reducing agent, acceleration of a reaction such as preparation of a dye from a dye-providing material, decomposition of a dye, or releasing of a diffusible dye, and acceleration of transfer of a dye from a light-sensitive material layer to a dye-fixing layer. From a viewpoint of a physical chemical function, it is classified to a base or base precursor, a nucleophilic compound, a high boiling organic solvent (oil), a heat solvent, a surface active agent, and a compound having an interaction with silver or a silver ion. In general, however, these material groups have a composite function and usually have some of the acceleration effects described above in combination. The details thereof are described in U.S. Pat. No. 4,678,739, columns 38–40.

The base precursor includes a salt of an organic acid and a base, which is decarboxylated by heat, and the compounds releasing amines by an intermolecular nucleophilic substitution reaction, a Lossen rearrangement, or a Beckmann rearrangement. The specific examples thereof are described in U.S. Pat. No. 4,511,493 and JP-A-62-65038.

In a system in which a heat development and a transfer of a dye are carried out at the same time under the presence of a little amount of water, a base and/or a base precursor are preferably incorporated into a dye-fixing element in a sense that a storing performance of a light-sensitive material is raised.

In the present invention, there is used a combination of the scarcely soluble metal compounds described in European Patent Publication 210,660 and U.S. Pat. No. 4,740,445 and the compounds (referred to as a complex-forming compound) capable of carrying out a complex-forming reaction with a metal ion constituting this scarcely soluble metal compound. To be specific, it is described in JP-A-2-269,338, pages 2 to 6. The compounds particularly preferred as the scarcely soluble metal compound are zinc hydroxide, zinc oxide, and a mixture of the both.

In the present invention, various development stoppers can be used for the light-sensitive material and/or the dye-fixing element for the purpose of obtaining an always constant image against the variations in a processing temperature and a processing time in a development.

The development stopper as called herein is a compound quickly neutralizing or reacting with a base after an optimum developing to lower a base concentration in a layer to stop the development, or a compound controlling the development by an interaction with silver or a silver salt. To be specific, there can be enumerated an acid precursor releasing acid by heating, an electrophilic compound causing a displacement reaction with coexisting base by heating, a nitrogen-containing heterocyclic compound, and a mercapto compound and a precursor thereof. More details are described at the pages 31 to 32 of JP-A-62-253159.

A material which can endure a processing temperature is used as a support for the light-sensitive material and the dye-fixing element in the present invention. In general, a paper and a synthetic polymer (film) are enumerated. To be specific, there are used polyethylene terephthalate, polycarbonate, polyvinyl chloride, polystyrene, polypropylene, polyimide, celluloses (for example, triacetyl cellulose), or those obtained by incorporating a pigment such as titanium oxide into those films, a film process synthetic paper made of polypropylene and others, a mixed paper made of a synthetic resin pulp such as polyethylene and a natural pulp, a Yankee paper, a baryta paper, a coated paper (particularly a cast coat paper), metal, cloths, and glasses. They can be used either singly or in a form of a support laminated on one side or both sides thereof with a synthetic polymer such as polyethylene. In addition thereto, the supports described at pages 29 to 31 of JP-A-62-253159 can be used as well.

A hydrophilic binder, semiconductive metal oxide such as alumina sol and tin oxide, and an anti-static agent such as carbon black and others may be coated on the surfaces of these supports.

A process by which an image is exposed and recorded on a light-sensitive material includes a process in which a scenery and a person are directly photographed, for example, with a camera, a process in which exposing is carried out through a reversal film and a negative film with a printer and an enlarger, a process in which an original picture is subjected to a scanning exposure through a slit with an exposing equipment of a copying machine, a process in which an image information is exposed by emitting a light emitting diode and various lasers via an electric signal, and a process in which an image information is output on an image display equipment such as CRT, a liquid crystal display, an electroluminescence display, and a plasma display to expose directly or through an optical system.

As described above, the light sources described in the 56th column of U.S. Pat. No. 4,500,626, such as natural light, a tungsten lump, light emitting diode, a laser light source, and a CRT light source can be used as a light source for recording an image on a light-sensitive material.

Further, an image exposure can be carried out by using a wavelength conversion element obtained by combining a non-linear optical material and a coherent light source such as a laser ray. Herein, the non-linear optical material means a material capable of revealing a non-linearity between a polarization generating when giving a strong photoelectric field such as a laser ray and an electric field, and preferably used are an inorganic compound represented by lithium niobate, potassium dihydrogenphosphate (KDP), lithium iodate, and $BaB_2O_4$, a urea derivative, a nitroaniline derivative, for example, a nitropyridine-N-oxide derivative such as 3-methyl-4-nitropyridine-N-oxide (POM), and the compounds described in JP-A-61-53462 and JP-A-62-210432. A single crystal optical waveguide type and a fiber type are known as the wavelength conversion element, and every one of them is useful.

There can be utilized as the image information described above, an image information obtained from a video camera and an electronic still camera, a TV signal represented by Nippon television signal standard (NTSC), an image signal obtained by dividing an original picture into a lot of picture elements such as scanner, and an image signal formed with a computer, represented by CG and CAD.

A light-sensitive material and/or a dye-fixing element may be of a form having a conductive exothermic body layer as a heating means for a heat development or a diffusion transfer of a dye. In this case, those described in JP-A-61-145544 can be utilized for a transparent or opaque exothermic element. These conductive layers function also as an anti-static layer. With respect to a heating temperature in a heat developing process, the development is possible at about 50° to about 250° C. In particular, about 80° to about 180° C. is useful. A diffusion transfer process of a dye may be carried out at the same time as a heat development or may be carried out after finishing the heat developing process. In the latter case, with respect to a heating temperature in the transfer process, the transfer is possible in a range of a temperature in the heat developing process to a room temperature. In particular, 50° C. or higher to a temperature lower by about 10° C. than a temperature in the heat developing process is more preferred.

Transfer of a dye is caused only by heat but a solvent may be used in order to accelerate a dye transfer. Further, as described in detail in JP-A-59-218443 and JP-A-61-238056, a process in which heating is applied under the presence of a small amount of a solvent (particularly water) to carry out a development and a transfer at the same time or in succession is useful as well. In this process, a heating temperature is preferably 50° C. or higher and a boiling point of a solvent or lower. In the case where the solvent is, for example, water, it is preferably 50° C. or higher and 100° C. or lower. Water or a base aqueous solution containing inorganic alkali metal salt and organic base (those described in the item of an image-forming accelerator can be used as these bases) can be enumerated as a solvent used for accelerating a development and/or transferring a diffusible dye to a dye-fixing layer. Further, there can be used as well a low boiling solvent or a mixed solution of a low boiling solvent and water or a base aqueous solution. A surface active agent, an anti-fogging agent, a scarcely soluble metal salt, and a complex-forming compound may be incorporated into the solvent.

These solvents can be used by a process in which they are incorporated into a dye-fixing element, a light-sensitive material, or both of them. The use amount thereof may be as small amount as a weight or less of a solvent corresponding to a maximum swollen volume of the whole coated layer (in particular, an amount obtained by deducting the weight of the whole coated layer from the weight of the solvent corresponding to the maximum swollen volume of the whole coated layer, or less).

The process for incorporating the solvent into the light-sensitive layer or the dye-fixing layer includes, for example, the process described in, for example, JP-A-61-147244, pp. 26. Further, the solvent can be used by incorporating in advance into the light-sensitive material or the dye-fixing element or both of them in the form of a microcapsule in which the solvent is charged.

In order to accelerate a dye transfer, a process in which a hydrophilic heat solvent which is a solid matter at an ordinary temperature and is dissolved at a high temperature is built in the light-sensitive material or the dye-fixing element can be applied as well. The hydrophilic heat solvent may be built in either of the light-sensitive material and the dye-fixing element or both of them. A layer which it is built in may be any of an emulsion layer, an intermediate layer, a protective layer, and a dye-fixing layer. It is preferably built in the dye-fixing layer and/or a layer adjacent thereto. The examples of the hydrophilic heat solvent include ureas, pyridines, amides, sulfonamides, imides, alcohols, oximes, and the other heterocycles.

In order to accelerate a dye transfer, a high boiling organic solvent may be incorporated into the light-sensitive material and/or the dye-fixing element.

A heating process in a developing and/or transfer process includes contacting to a heated block and plate, contacting to a hot plate, a hot presser, a hot roller, a halogen lamp heater, and infrared and far infrared lamp heaters, and passing through an environment of a high temperature.

The process described in JP-A-61-147244, page 27 can be applied for a pressure condition and a process for exerting a pressure in superposing the light-sensitive material and the dye-fixing element to tightly contact them.

Every one of various heat developing equipments can be used for processing the photographic element of the present invention. There can preferably be used the equipments described in, for example, JP-A-59-75247, JP-A-59-177547, JP-A- 59-181353, JP-A-60-18951, JP-A-U-62-25944 (the term "JP-A-U" as used herein means an unexamined published Japanese utility model application), JP-A-3-131856 and JP-A-3-131851.

EXAMPLES

The present invention will be explained below with reference to the examples but the present invention will not be limited thereto.

Example 1

A preparation process for a dispersion of zinc hydroxide will be described.

Zinc hydroxide 19.0 g having an average particle size of 0.07 mm, carboxymethyl cellulose 1 g as a dispersant, and poly(sodium acrylate) 0.1 g were added to a 5% gelatin aqueous solution 100 ml and pulverized for 30 minutes with a mill using glass beads having an average particle size of 0.75 mm. The glass beads were separated to obtain the dispersion of zinc hydroxide.

Next, a preparing process for a dispersion of an electron transfer agent will be described.

The following electron transfer agent 11 g, polyethylene glycol nonylphenyl ether 0.5 g as a dispersant, and the following anionic surface active agent (1) 0.5 g were added to a 5% gelatin aqueous solution 100 ml and pulverized for 60 minutes with a mill using glass beads having an average particle size of 0.75 mm. The glass beads were separated to obtain the dispersion of the electron transfer agent having an average particle size of 0.35 μm.

Electron transfer agent

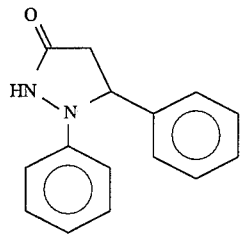

Anionic surface active agent

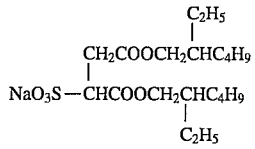

Next, a preparing process for a dispersion of a dye trapping agent will be described.

A mixed solution of the following polymer latex (a solid content: 13%) 108 ml, the following surface active agent 20 g, and water 1232 ml was added to a 5% aqueous solution 600 ml of the above anionic surface active agent (1) over a period of 10 minutes while stirring. The dispersion thus prepared was concentrated to 500 ml and desalted with a ultrafiltration module. Then, water 1500 ml was added and the same procedure was repeated once again, whereby the dispersion 500 g of the dye trapping agent was obtained.

Polymer latex

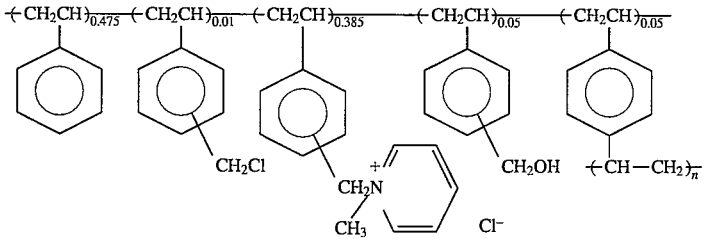

Surface active agent

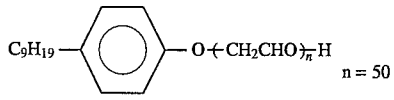

Next, a preparing process for a gelatin dispersion of a hydrophobic additive will be described. The gelatin dispersions of the cyan, magenta and yellow dye-providing materials and an electron-providing material were prepared, respectively, according to the compositions shown in Table 2. That is, the respective oil phase components were heated to about 60° C. and dissolved to prepare a uniform solution. This solution and the aqueous phase components heated to about 60° C. were added, stirred and mixed and then were dispersed with a homogenizer at 12000 rpm for 13 minutes. Water was added thereto and stirring was carried out to obtain a uniform dispersion.

TABLE 2

| | Cy-1 | M-1 | Y-1 | EPM* |
|---|---|---|---|---|
| Oil phase | | | | |
| Dye-providing material (A) | 9.05 g | — | — | — |
| Dye-providing material (B) | 6.19 g | — | — | — |
| Dye-providing material (C) | — | 15.5 g | — | — |
| Dye-providing material (D) | — | — | 13.0 g | — |
| Electron-providing material (1) | 4.84 g | 5.61 g | 4.53 g | — |
| Electron-providing material (2) | — | — | — | 13.87 g |
| Inhibitor-releasing redox compound (1) | — | — | — | 2.62 g |
| Electron transfer agent precursor | 1.42 g | 1.42 g | 0.86 g | — |
| Compound (1) | 0.40 g | 0.44 g | 0.40 g | — |
| Compound (2) | 1.53 g | 1.94 g | — | — |
| Compound (3) | 1.52 g | 1.94 g | — | — |
| High boiling solvent (1) | 1.91 g | 1.94 g | 5.20 g | — |
| High boiling solvent (2) | — | — | 3.90 ml | — |
| High boiling solvent (3) | 5.72 g | 5.81 g | — | 2.93 g |
| High boiling solvent (4) | — | — | — | 2.94 g |
| Surface active agent (2) | 1.55 g | 0.52 g | 1.50 g | 0.45 g |
| Ethyl acetate | 34.5 ml | 34.5 ml | 25.0 ml | 18.0 ml |
| Methyl ethyl ketone | 47.5 ml | 47.5 ml | — | — |
| Aqueous phase | | | | |
| Lime-treated gelatin | 10.0 g | 10.0 g | 10.0 g | 10.0 g |
| Citric acid | — | — | 0.14 g | 0.14 g |
| Sodium hydrogensulfite | — | — | — | 0.15 g |
| 3-Benzoisothiazolone | 0.06 g | 0.07 g | 0.05 g | 0.10 g |
| Water | 130 ml | 130 ml | 120 ml | 100 ml |
| Water | 130 ml | 140 ml | 120 ml | 60 ml |

*Electron-providing material

Dye-providing compound (A)

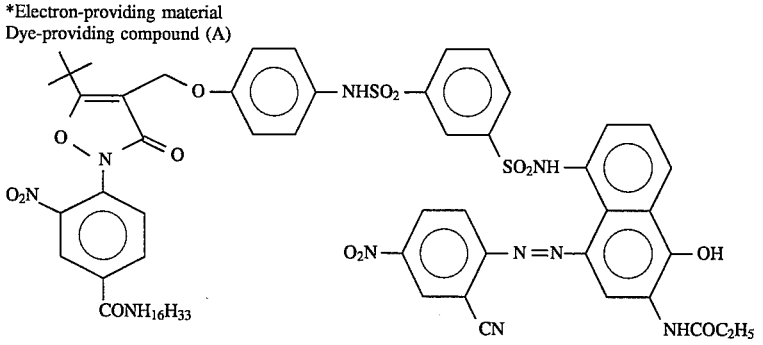

Dye-providing compound (B)

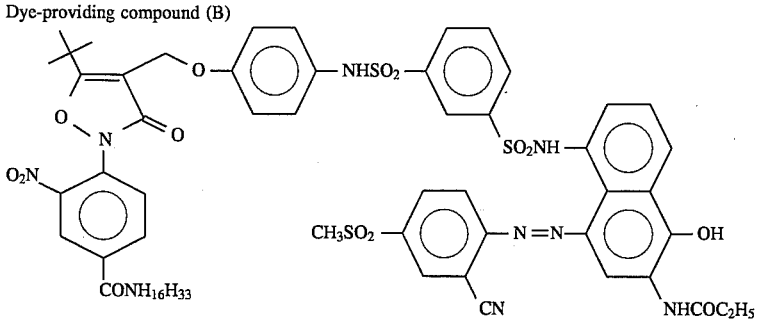

Dye-providing compound (C)

TABLE 2-continued
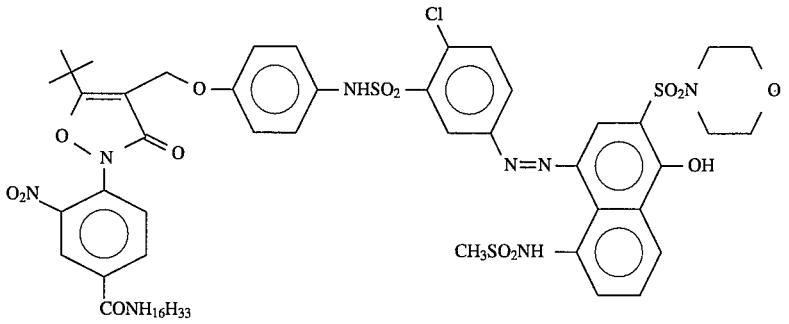
Dye-providing compound (D)
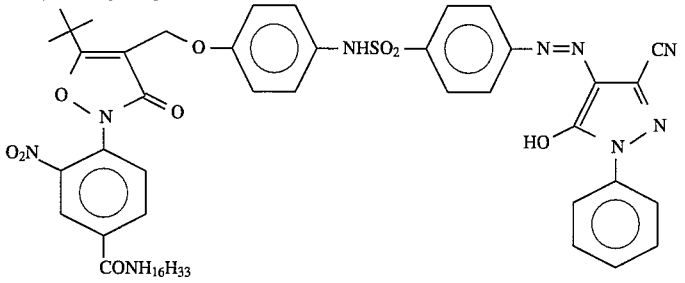
Electron-providing material (1)
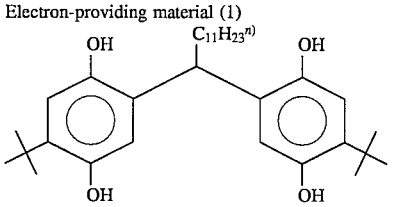
Electron-providing material (2)
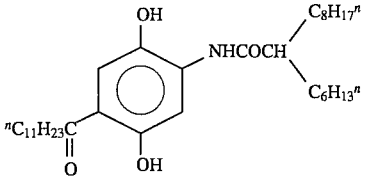
Development inhibitor-releasing redox compound
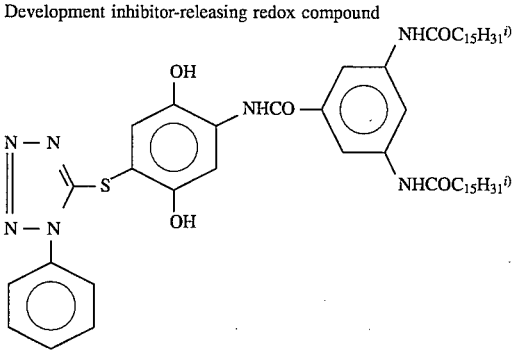
Electron transfer agent precursor TABLE 2-continued
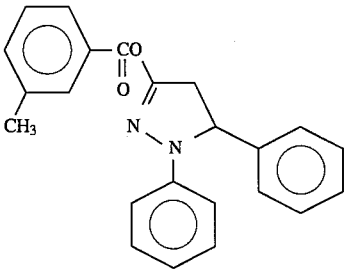
Compound (1)
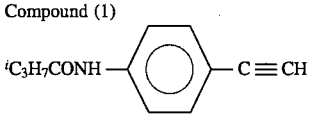
Compound (2)
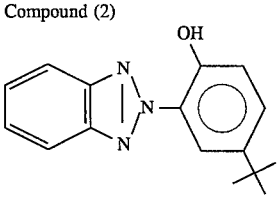
Compound (3)
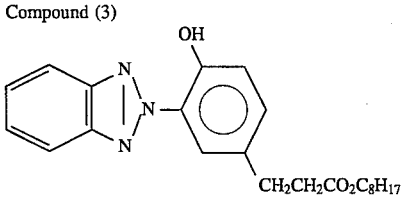
High boiling solvent (1)
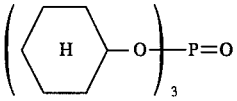
High boiling solvent (2)
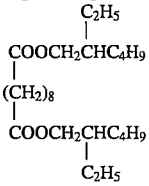
High boiling solvent (3)
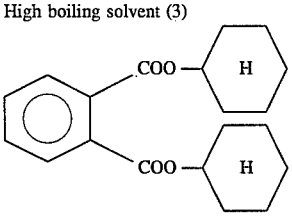
High boiling solvent (4)
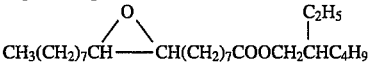
Surface active agent (2)
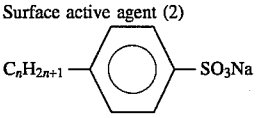

Next, a preparing process for a light-sensitive emulsion will be described.

Light-sensitive silver halide emulsion (1) (for a red-sensitive emulsion layer)

Solution (I) and solution (II) each shown in Table 3 were simultaneously added to a gelatin aqueous solution (prepared by adding gelatin 20 g, potassium bromide 0.5 g, sodium chloride 3 g, and the following chemical (A) 30 mg to water 500 ml and maintained at a temperature of 45° C.) in the same flow rate over a period of 20 minutes while vigorously stirring. Further, six minutes later, solution (III) and solution (IV) each shown in Table 3 were simultaneously added in the same flow rate over a period of 25 minutes. Ten minutes after the addition of solution (III) and solution (IV) was started, an aqueous solution of a gelatin dispersion of a dye (containing gelatin 1 g, the following dye (a) 70 mg, the following dye (b) 139 mg, and the following dye (c) 5 mg in water 105 ml and maintained at a temperature of 45° C.) was added over a period of 20 minutes.

After the emulsion was washed and desalted by an ordinary process, lime-treated osein gelatin 22 g was added and pH and pAg were adjusted to 6.2 and 7.8, respectively, followed by adding 4-hydroxy-6-methyl-1,3,3a,7-tetrazaindene and then sodium thiosulfate and chlorauric acid to provide an optimum chemical sensitization at 68° C. Subsequently, the following anti-fogging agent (2) was added and then the emulsion was cooled down, whereby a monodispersed cubic silver chlorobromide emulsion 635 g having an average grain size of 0.30 μm was obtained.

TABLE 3

| | Solution | | | |
|---|---|---|---|---|
| | (I) | (II) | (III) | (IV) |
| $AgNO_3$ | 50.0 g | — | 50.0 g | — |
| $NH_4NO_3$ | 0.19 g | — | 0.19 g | — |
| KBr | — | 28.0 g | — | 35.0 g |
| NaCl | — | 3.45 g | — | — |
| Water to make | 250 ml | 250 ml | 200 ml | 200 ml |

Chemical (A)

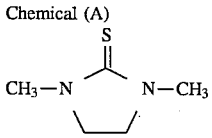

Dye (a)

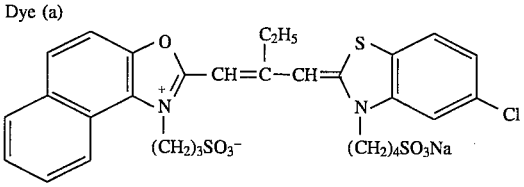

Dye (b)

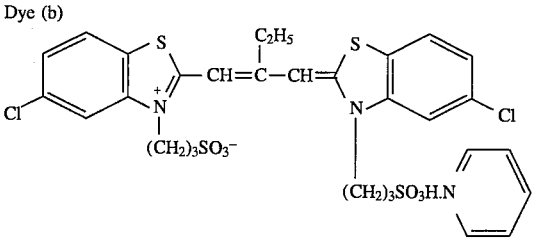

Dye (c)

TABLE 3-continued

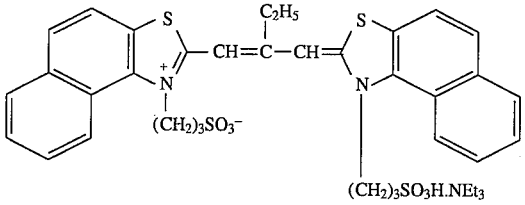

Light-sensitive silver halide emulsion (2) (for a red-sensitive emulsion layer)

Solution (I) and solution (II) each shown in Table 4 were simultaneously added to a gelatin aqueous solution (prepared by adding gelatin 20 g, potassium bromide 0.5 g, sodium chloride 6 g, and the above chemical (A) 30 mg to water 800 ml and maintained at a temperature of 65° C.) in the same flow rate over a period of 30 minutes while vigorously stirring. Further, five minutes later, solution (III) and solution (IV) each shown in Table 4 were simultaneously added in the same flow rate over a period of 15 minutes. Two minutes after the addition of solution (III) and solution (IV) was started, an aqueous solution of a gelatin dispersion of a dye (containing gelatin 1.1 g, the above dye (a) 76 mg, the above dye (b) 150 mg, and the above dye (c) 5 mg in water 95 ml and maintained at a temperature of 50° C.) was added over a period of 18 minutes.

After the emulsion was washed and desalted by an ordinary process, lime-treated osein gelatin 22 g was added and pH and pAg were adjusted to 6.2 and 7.8, respectively, followed by adding 4-hydroxy-6-methyl-1,3,3a,7-tetrazaindene and then sodium thiosulfate and chlorauric acid to provide an optimum chemical sensitization at 68° C. Subsequently, the following anti-fogging agent (1) was added and then the emulsion was cooled down, whereby a monodispersed cubic silver chlorobromide emulsion 635 g having an average grain size of 0.50 μm was obtained.

TABLE 4

| | Solution | | | |
|---|---|---|---|---|
| | (I) | (II) | (III) | (IV) |
| $AgNO_3$ | 50.0 g | — | 50.0 g | — |
| $NH_4NO_3$ | 0.19 g | — | 0.19 g | — |
| KBr | — | 28.0 g | — | 35.0 g |
| NaCl | — | 3.45 g | — | — |
| Water to make | 200 ml | 140 ml | 145 ml | 155 ml |

Light-sensitive silver halide emulsion (3) (for a green-sensitive emulsion layer)

Solution (I) and solution (II) each shown in Table 5 were simultaneously added to a gelatin aqueous solution (prepared by adding gelatin 20 g, potassium bromide 0.5 g, sodium chloride 4 g, and the above chemical (A) 15 mg to water ml and maintained at a temperature of 47° C.) in the same flowing amount over a period of 8 minutes while vigorously stirring. Further, ten minutes later, solution (III) and solution (IV) each shown in Table 5 were simultaneously added in the same flow rate over a period of 32 minutes. One minute after the addition of solution (III) and solution (IV) was finished, an aqueous solution of a gelatin dispersion of a dye (containing gelatin 2.5 g and the following dye (d) 250 mg in water 100 ml and maintained at a temperature of 45° C.) was added in one lump.

After the emulsion was washed and desalted by an ordinary process, lime-treated osein gelatin 32 g was added and pH and pAg were adjusted to 6.0 and 7.6, respectively, followed by adding 4-hydroxy-6-methyl-1,3,3a,7-tetrazaindene and then sodium thiosulfate to provide an optimum chemical sensitization at 68° C. Subsequently, the following anti-fogging agent (1) was added and then the emulsion was cooled down, whereby a monodispersed cubic silver chlorobromide emulsion 635 g having an average grain size of 0.27 μm was obtained.

TABLE 5

| | Solution | | | |
|---|---|---|---|---|
| | (I) | (II) | (III) | (IV) |
| $AgNO_3$ | 20.0 g | — | 80.0 g | — |
| $NH_4NO_3$ | 0.13 g | — | 0.38 g | — |
| KBr | — | 9.8 g | — | 44.8 g |
| NaCl | — | 2.06 g | — | 5.51 g |
| Water to make | 110 ml | 110 ml | 245 ml | 245 ml |

Dye (d)

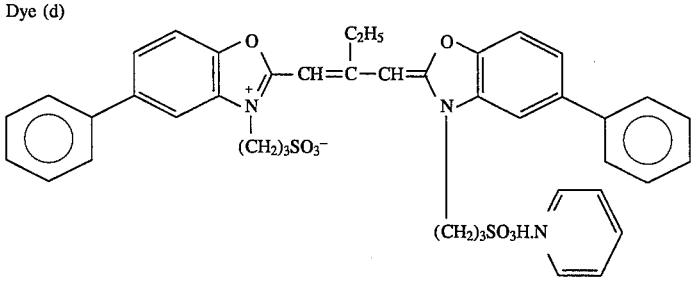

Light-sensitive silver halide emulsion (4) (for a green-sensitive emulsion layer)

Solution (I) and solution (II) each shown in Table 6 were simultaneously added to a gelatin aqueous solution (prepared by adding gelatin 20 g, potassium bromide 0.3 g, sodium chloride 6 g, and the-above chemical (A) 15 mg to water 700 ml and maintained at a temperature of 60° C.) in the same flow rate over a period of 20 minutes while vigorously stirring. Further, ten minutes later, solution (III) and solution (IV) each shown in Table 6 were simultaneously added in the same flow rate over a period of 20 minutes. One minute after the addition of solution (III) and solution (IV) was finished, an aqueous solution of a gelatin dispersion of a dye (containing gelatin 1.8 g and the above dye (d) 180 mg in water 75 ml and maintained at a temperature of 45° C.) was added in one lump.

After the emulsion was washed and desalted by an ordinary process, lime-treated osein gelatin 22 g was added and pH and pAg were adjusted to 6.0 and 7.7, respectively, followed by adding 4-hydroxy-6-methyl-1,3,3a,7-tetrazaindene and then sodium thiosulfate to provide an optimum chemical sensitization at 68° C. Subsequently, the following anti-fogging agent (1) was added and then the emulsion was cooled down, whereby a monodispersed cubic silver chlorobromide emulsion 635 g having an average grain size of 0.45 μm was obtained.

TABLE 6

| | Solution | | | |
|---|---|---|---|---|
| | (I) | (II) | (III) | (IV) |
| $AgNO_3$ | 20.0 g | — | 80.0 g | — |
| $NH_4NO_3$ | 0.19 g | — | 0.38 g | — |
| KBr | — | 9.8 g | — | 44.8 g |
| NaCl | — | 2.06 g | — | 5.51 g |
| Water to make | 165 ml | 165 ml | 205 ml | 205 ml |

Light-sensitive silver halide emulsion (5) (for a blue-sensitive emulsion layer)

Solution (I) and solution (II) each shown in Table 7 were simultaneously added to a gelatin aqueous solution (prepared by adding gelatin 20 g, potassium bromide 0.5 g, sodium chloride 5 g, and the above chemical (A) 15 mg to water 690 ml and maintained at a temperature of 51° C.) in the same flow rate over a period of 8 minutes while vigorously stirring. Further, ten minutes later, solution (III) and solution (IV) each shown in Table 7 were simultaneously added in the same flow rate over a period of 32 minutes. One minute after the addition of solution (III) and solution (IV) was finished, an aqueous solution of a gelatin dispersion of a dye (containing the following dye (e) 235 mg and the following dye (f) 120 mg in water 95 ml and methanol 5 ml and maintained at a temperature of 45° C.) was added in one lump.

After the emulsion was washed and desalted by an ordinary process, lime-treated osein gelatin 22 g was added and pH and pAg were adjusted to 6.0 and 7.7, respectively, followed by adding 4-hydroxy-6-methyl-1,3,3a,7-tetrazaindene and then sodium thiosulfate to provide an optimum chemical sensitization at 68° C. Subsequently, the following anti-fogging agent (1) was added and then the emulsion was cooled down, whereby a monodispersed cubic silver chlorobromide emulsion 635 g having an average grain size of 0.30 μm was obtained.

TABLE 7

| | Solution | | | |
|---|---|---|---|---|
| | (I) | (II) | (III) | (IV) |
| $AgNO_3$ | 20.0 g | — | 80.0 g | — |
| $NH_4NO_3$ | 0.13 g | — | 0.38 g | — |
| KBr | — | 9.8 g | — | 44.8 g |
| NaCl | — | 2.06 g | — | 5.52 g |
| Water to make | 110 ml | 110 ml | 240 ml | 240 ml |

Dye (e)

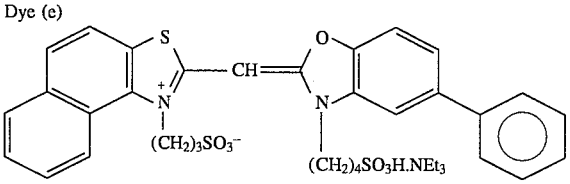

Dye (f)

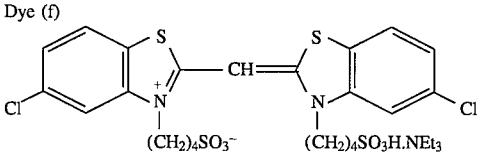

Light-sensitive silver halide emulsion (6) (for a blue-sensitive emulsion layer)

Solution (I) and solution (II) each shown in Table 8 were simultaneously added to a gelatin aqueous solution (prepared by adding gelatin 20 g, potassium bromide 0.3 g, sodium chloride 9 g, and the above chemical (A) 15 mg to water 695 ml and maintained at a temperature of 63° C.) in the same flow rate over a period of 10 minutes while vigorously stirring. Further, ten minutes later, solution (III) and solution (IV) each shown in Table 8 were simultaneously added in the same flow rate over a period of 30 minutes. One minute after the addition of solution (III) and solution (IV) was finished, an aqueous solution of a dye (containing the above dye (e) 155 mg and the above dye (f) 78 mg in water 66 ml and methanol 4 ml and maintained at a temperature of 60° C.) was added in one lump.

After the emulsion was washed and desalted by an ordinary process, lime-treated osein gelatin 22 g was added and pH and pAg were adjusted to 6.0 and 7.7, respectively, followed by adding 4-hydroxy-6-methyl-1,3,3a,7-tetrazaindene and then sodium thiosulfate to provide an optimum chemical sensitization at 68° C. Subsequently, the following anti-fogging agent (1) was added and then the emulsion was cooled down, whereby a monodispersed cubic silver chlorobromide emulsion 635 g having an average grain size of 0.52 μm was obtained.

TABLE 8

| | Solution | | | |
|---|---|---|---|---|
| | (I) | (II) | (III) | (IV) |
| $AgNO_3$ | 25.0 g | — | 75.0 g | — |
| $NH_4NO_3$ | 0.13 g | — | 0.37 g | — |
| KBr | — | 12.3 g | — | 42.0 g |
| NaCl | — | 2.58 g | — | 5.18 g |
| Water to make | 120 ml | 120 ml | 225 ml | 225 ml |

The foregoing materials were used to prepare the light-sensitive material 101 shown in Table 9.

TABLE 9

Constitution of light-sensitive material 101

| Layer No. | Layer name | Additive | Coated amount (mg/m²) |
|---|---|---|---|
| 7th layer | Protective layer II | Acid-treated gelatin | 340 |
| | | PMMA latex (size: 3 μm) | 20 |
| | | Colloidal silver | 0.7 |
| | | Anionic surface active agent (1) | 8 |
| | | Surface active agent (3) | 22 |
| 6th layer | Protective layer I | Lime-treated gelatin | 230 |
| | | Dispersion of zinc hydroxide | 2590 |
| | | Gelatin dispersion of the electron-providing material | 1050 |
| | | Dispersion of the dye-trapping agent | 740 |
| | | Dextran | 15 |
| | | Water soluble polymer (1) | 2 |
| 5th layer | Blue-sensitive emulsion layer | Light-sensitive silver halide emulsion (5) | 3080 |
| | | Light-sensitive silver halide emulsion (6) | 940 |
| | | Dispersion of the yellow dye-providing compound | 8310 |
| | | Water soluble polymer (1) | 10 |
| 4th layer | Intermediate layer | Lime-treated gelatin | 390 |
| | | Gelatin dispersion of the electron transfer agent | 780 |
| | | Gelatin dispersion of the electron-providing material | 2360 |
| | | Dispersion of the dye-trapping agent | 1040 |
| | | Dextran | 40 |
| | | Water soluble polymer (1) | 18 |
| | | Hardener (1) | 39 |
| 3rd layer | Green-sensitive emulsion layer | Light-sensitive silver halide emulsion (3) | 2460 |
| | | Light-sensitive silver halide emulsion (4) | 1000 |
| | | Dispersion of the magenta dye-providing compound | 8690 |
| | | Water soluble polymer (1) | 13 |
| 2nd layer | Intermediate layer | Lime-treated gelatin | 410 |
| | | Dispersion of zinc hydroxide | 4870 |
| | | Gelatin dispersion of the electron-providing material | 1940 |
| | | Dispersion of the dye-trapping agent | 1370 |
| | | Dextran | 29 |
| | | Water soluble polymer (1) | 4 |
| 1st layer | Red-sensitive emulsion layer | Light-sensitive silver halide emulsion (1) | 1080 |
| | | Light-sensitive silver halide emulsion (2) | 580 |
| | | Dispersion of the cyan dye- providing compound | 7580 |
| | | Water soluble polymer (1) | 7 |
| | | Surface active agent (4) | 54 |

Support (1)

| Layer name | Composition | Layer thickness (μm) |
|---|---|---|
| Surface subbing layer | Gelatin | 0.1 |
| Surface PE layer (glossy) | Low density polyethylene (density 0.923): 89.2 parts, Surface-treated titanium | 36.0 |

TABLE 9-continued

| | | |
|---|---|---|
| | oxide: 10.0 parts, | |
| Pulp layer | Wood free paper (LBKP/ NBKP = 1/1, density: 1.080) | 64.0 |
| Back face PE layer (mat) | High density polyethylene (density: 0.960) | 31.0 |
| Back face subbing layer | Gelatin | 0.05 |
| | Colloidal silica | 0.05 |
| | | 131.2 |

Surface active agent (3)

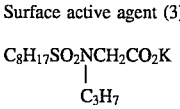

Anti-fogging agent (1)

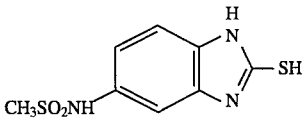

Anti-fogging agent (2)

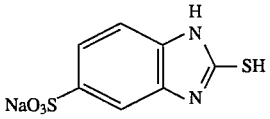

Water soluble polymer (1)

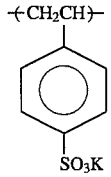

Hardener (1)
$CH_2{=}CHSO_2CH_2SO_2CH{=}CH_2$

Suppot (1) Paper support laminated with polyethylene(thickness: 131 μm)

Dispersions EY-2 to EY-4 of the yellow dye-providing compounds, dispersions EM-2 to EM-4 of the magenta dye-providing compounds, and dispersions EC-2 to EC-5 of the cyan dye-providing compounds each shown in Table 10 were prepared in the same manners as that for the gelatin dispersion of the hydrophobic additive described above, except that the dye-providing materials were changed and that the amounts of the electron-providing material (1) and the high boiling solvents (1) to (3) were changed.

TABLE 10

| Disper- | Dye-providing compound | | Electron- | High boiling solvent | | |
|---|---|---|---|---|---|---|
| sion | Compound | Amount | material (1) | (1) | (2) | (3) |
| EY-2 | Y-1 | 9.67 g | 2.27 g | 3.9 g | 2.9 ml | — |
| EY-3 | Y-2 | 11.83 g | 2.27 g | 4.7 g | 3.5 ml | — |
| EY-4 | Y-4 | 11.06 g | 2.27 g | 4.4 g | 3.3 ml | — |
| EM-2 | M-1 | 11.05 g | 2.81 g | 1.4 g | — | 4.1 g |
| EM-3 | M-3 | 13.51 g | 2.81 g | 1.7 g | — | 5.1 g |
| EM-4 | M-5 | 11.35 g | 2.81 g | 1.4 g | — | 4.3 g |
| EC-2 | C-1 | 6.76 g | 2.42 g | 1.4 g | — | 4.3 g |
| | C-2 | 4.67 g | | | | |
| EC-3 | C-3 | 6.76 g | 2.42 g | 1.4 g | — | 4.3 g |
| | C-4 | 4.67 g | | | | |
| EC-4 | C-7 | 6.93 g | 2.42 g | 1.5 g | — | 4.4 g |
| | C-8 | 4.78 g | | | | |
| EC-5 | C-15 | 7.14 g | 2.42 g | 1.5 g | — | 4.4 g |
| | C-16 | 4.92 g | | | | |

Light-sensitive materials 102 to 105 shown in Table 11 were prepared in the same manner as described for light-sensitive material 101, except that the gelatin dispersions of the dye-providing compounds and the reducing agents each contained in the first layer, the third layer and the fifth layer were changed to the gelatin dispersions of the dye-providing compounds shown in Table 10 described above and that the amount of the electron-providing agent contained in an intermediate layer and the amounts of the light-sensitive silver halide emulsions contained in the first layer, the third layer and the fifth layer were changed, as shown in Table 12.

TABLE 11

| Light-sensitive material | 1st layer | 3rd layer | 5th layer |
|---|---|---|---|
| 101 (Comp.) | EC-1 | EM-1 | EY-1 |
| 102 (Inv.) | EC-1 | EM-1 | EY-2 |
| 103 (Inv.) | EC-2 | EM-2 | EM-3 |
| 104 (Inv.) | EC-3 | EM-3 | EM-4 |
| 105 (Inv.) | EC-4 | EM-4 | EY-5 |

TABLE 12

| Light- | 1st layer emulsion | | 2nd layer emulsion | | 5th layer emulsion | | 4th layer electron- |
|---|---|---|---|---|---|---|---|
| sensitive material | (1)* | (2)* | (3)* | (4)* | (5)* | (6)* | transfer agent dispersion** |
| 101 | 1080 | 580 | 2460 | 1000 | 3080 | 940 | 780 |
| 102 | 1080 | 580 | 2460 | 1000 | 1540 | 470 | 780 |
| 103 | 540 | 290 | 1230 | 500 | 1540 | 470 | 390 |
| 104 | 540 | 290 | 1230 | 500 | 1540 | 470 | 390 |
| 105 | 540 | 290 | 1230 | 500 | 1540 | 470 | 390 |

*$mg/m^2$ (as silver)
**$mg/m^2$

The above light-sensitive materials 101 to 105 and a PS paper PS-SG manufactured by Fuji Photo Film Co., Ltd. as an image-receiving material were used for processing with Pictrostat 200 as an image recording equipment manufactured by Fuji Photo Film Co., Ltd.

That is, the light-sensitive material was subjected to a scanning exposure via an original picture (a test chart on which the wedges of Y, M, Cy and gray each having a continuously changed density are recorded) through a slit. After the light-sensitive material thus exposed was dipped in water maintained at 40° C. for about 2.5 seconds, it was squeezed with rollers and immediately superposed on the image receiving material so that the film faces thereof were contacted. Then, heating was applied for 17 seconds with a heat drum which was adjusted to such a temperature that a temperature of a film face absorbing water became 80° C., and the light-sensitive material was peeled off from the image-receiving material, whereby a sharp color image corresponding to the original picture was obtained on the image-receiving material.

Further, the processing was carried out in the same manner as that described above, except that in order to forcibly change a developing condition, a temperature was settled so that the temperature of a layer face absorbing water became 85° C., whereby an image was obtained on the image-receiving material.

With respect to the density measurement, the densitometer X Light 404 manufactured by X Light Co., Ltd. was used to measure a reflection density, and the respective differences between the maximum densities and the minimum densities of the images obtained in the above two conditions were designated as ΔDmax and ΔDmin, respectively to evaluate the performances (the smaller the values of ΔDmax and ΔDmin are, the less the light-sensitive materials are susceptible to an influence of a fluctuation in the developing condition).

Further, adjustment was carried out using a Fuji CC filter manufactured by Fuji Photo Film Co., Ltd. so that a gray density of 0.7 was met and then the respective light-sensitive materials were similarly exposed and processed. The densities of Y, M and Cy of an image at an M density of 1.2 of an original were measured to evaluate a color reproducibility. With respect to the density measurement, the densitometer X Light 404 manufactured by X Light Co., Ltd. was used to measure a reflection density.

The results are shown in Table 13 and Table 14.

TABLE 13

| Light-sensitive | Dmin | | | Dmax | | | M density 1.2 in original | | |
|---|---|---|---|---|---|---|---|---|---|
| material | Cy | M | Y | Cy | M | Y | Cy | M | Y |
| 101 (Comp.) | 0.08 | 0.13 | 0.12 | 2.45 | 2.40 | 2.24 | 0.12 | 0.91 | 0.31 |
| 102 (Inv.) | 0.08 | 0.12 | 0.06 | 2.45 | 2.39 | 2.30 | 0.12 | 1.15 | 0.29 |
| 103 (Inv.) | 0.08 | 0.14 | 0.10 | 2.41 | 2.38 | 2.26 | 0.13 | 1.13 | 0.31 |
| 104 (Inv.) | 0.07 | 0.13 | 0.11 | 2.45 | 2.41 | 2.25 | 0.12 | 1.14 | 0.30 |
| 105 (Inv.) | 0.08 | 0.12 | 0.11 | 2.44 | 2.40 | 2.43 | 0.12 | 1.15 | 0.30 |

TABLE 14

| Light-sensitive material | Relative* sensitivity | | | ΔDmin | | | ΔDmax | | |
|---|---|---|---|---|---|---|---|---|---|
| | Cy | M | Y | Cy | M | Y | Cy | M | Y |
| 101 (Comp.) | 110 | 115 | 120 | 0.03 | 0.02 | 0.02 | 0.04 | 0.03 | 0.04 |
| 108 (Inv.) | 110 | 115 | 100 | 0.02 | 0.02 | 0.02 | 0.02 | 0.03 | 0.02 |
| 111 (Inv.) | 100 | 105 | 105 | 0.02 | 0.03 | 0.02 | 0.04 | 0.04 | 0.03 |
| 112 (Inv.) | 105 | 110 | 110 | 0.01 | 0.03 | 0.02 | 0.05 | 0.06 | 0.05 |
| 113 (Inv.) | 105 | 115 | 115 | 0.02 | 0.02 | 0.03 | 0.06 | 0.05 | 0.04 |

*Relative sensitivity is a sensitivity at a processing temperature of 85° C. relative to each of the sensitivities, which are taken as 100, of the respective layers of the respective light-sensitive materials at a processing temperature of 80° C. at a portion having a density of 0.7.

As apparent from the results shown in Table 13, the light-sensitive materials using the dye-providing compounds of the present invention can provide Dmax of about the same level as those provided with the comparative light-sensitive materials using the conventional dye-providing compounds even with the reduced amounts of the dye-providing compounds, the electron-providing agents, the silver halide emulsions and the electron transfer agents.

Further, in comparative light-sensitive material 101, magenta (M) density on a image becomes lower than the M density on an original. Accordingly, a color fading is large and a color reproducibility is inferior. On the contrary, in light-sensitive materials 102 to 105 of the present invention, the M density is increased without increase in a color turbidity of yellow (Y) and cyan (Cy). As was described in the detailed description of the invention, a positive system of a diffusion transfer type had a problem that a single color (particularly the M density) having a high density free of turbidity was difficult to be provided due to a phenomenon called a crosstalk. It is an unexpected result that such the fundamental problem on a positive image-forming system has been improved to a large extent in the light-sensitive materials using the compounds of the present invention.

The change in the photographic performances due to the change in a processing temperature is shown in Table 14. It can be seen that light-sensitive materials 102 to 105 of the present invention have a small fluctuation in a sensitivity even at an elevated processing temperature as compared with the comparative light-sensitive material 101.

Example 2

A preparing method for red-sensitive silver halide emulsion (I) will be described.

Solution (I) and solution (II) each described in the following Table A were simultaneously added to a gelatin aqueous solution (prepared by adding 20 g of gelatin, 0.3 g of potassium bromide, 6 g of sodium chloride, and 30 mg of the following chemical A to water 800 ml and maintained at a temperature of 50° C.) in the same flow rate over a period of 30 minutes while vigorously stirring. Thereafter, solution (III) and solution (IV) each described in the following Table B were simultaneously added over a period of 30 minutes. Three minutes after the addition of solution (III) and solution (IV) was started, the following dye solution was added over a period of 20 minutes.

After washing and desalting, 22 g of lime-treated osein gelatin was added and pH and pAg were adjusted to 6.2 and 7.7, respectively, followed by adding sodium thiosulfate, 4-hydroxy-6-methyl-1,3,3a,7-tetraazaindene and chlorauric acid to provide an optimum chemical sensitization at 60° C. Thus, a monodispersed cubic silver chlorobromide emulsion having an average grain size of 0.38 μm was obtained. The yield was 635 g.

TABLE A

| | Solution (I) Water was added to make 200 ml | Solution (II) Water was added to make 200 ml |
|---|---|---|
| $AgNO_3$ | 50.0 g | — |
| KBr | — | 28.0 g |
| NaCl | — | 3.4 g |

TABLE B

| | Solution (III) Water was added to make 200 ml | Solution (IV) Water was added to make 200 ml |
|---|---|---|
| $AgNO_3$ | 50.0 g | — |
| KBr | — | 35.0 g |

Chemical A

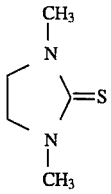

Dye solution:

The following dye (g) 67 mg and dye (h) 133 mg were dissolved in 100ml of methanol to prepare the solution.

Dye (g)

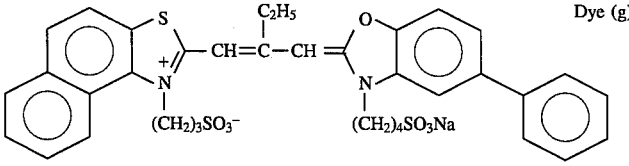

-continued

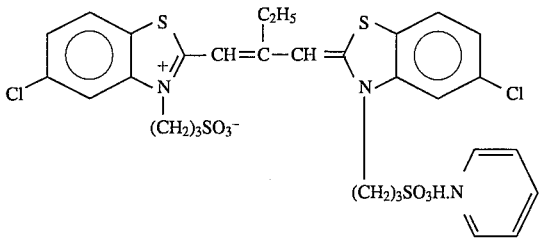

(Dye (h)

Next, a preparing method for green-sensitive silver halide emulsion (II) will be described.

A gelatin aqueous solution (Table C) was maintained at 50° C. and solution (I) and solution (II) each shown in Table D were added thereto over a period of 30 minutes while vigorously stirring. Then, solution (III) and solution (IV) each described in Table D were added over a period of 30 minutes. One minute after finishing the addition, the dye solution shown in Table E was added.

TABLE D

| | (I) | (II) | (III) | (IV) |
|---|---|---|---|---|
| $AgNO_3$ | 50 g | — | 50 g | — |
| KBr | — | 21 g | — | 28 g |
| NaCl | — | 6.9 g | — | 3.5 g |
| $H_2O$ to make | 200 ml | 200 ml | 200 ml | 200 ml |

TABLE E (Composition of a dye solution)

| | |
|---|---|
| 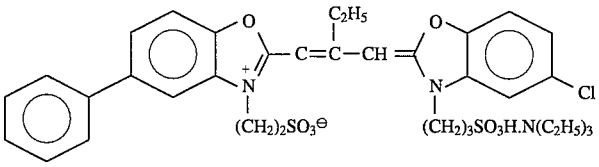 | 0.18 g |
| 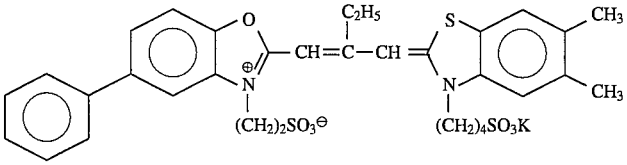 | 0.02 g |
| 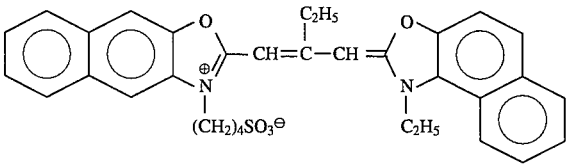 | 0.035 g |
| Methanol | 154 ml |

TABLE C

| | |
|---|---|
| Gelatin | 20 g |
| NaCl | 6 g |
| KBr | 0.3 g |
| 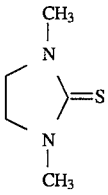 | 0.015 g |
| $H_2O$ | 730 ml |

After washing and desalting, 20 g of gelatin was added and pH and pAg were adjusted, followed by adding triethylthiourea, chlorauric acid and 4-hydroxy-6-methyl-1,3,3a,7-tetraazaindene to provide an optimum chemical sensitization. The emulsion thus obtained was a monodispersed cubic silver chlorobromide emulsion having an average grain size of 0.40 μm and the yield thereof was 630 g.

Next, a preparing method for blue-sensitive silver halide emulsion (III) will be described.

Solution (1) and solution (2) each shown in the following Table F were simultaneously added to a gelatin aqueous solution (prepared by adding 20 g of gelatin, 3 g of potassium bromide, 0.03 g of chemical A, and 0.25 g of $HO(CH_2)_2S(CH_2)_2S(CH_2)_2OH$ to water 800 ml and maintained at a temperature of 50° C.) over a period of 30 minutes while vigorously stirring. Thereafter, solution (3) and solution (4) each shown in the following Table F were simultaneously added over a period of 20 minutes. Five minutes after the addition of solution (3) was started, the following dye solution was added over a period of 18 minutes.

After washing and desalting, 20 g of lime-treated osein gelatin was added and pH and pAg were adjusted to 6.2 and 8.5, respectively, followed by adding sodium thiosulfate, 4-hydroxy-6-methyl-1,3,3a,7-tetraazaindene and chlorauric acid to provide an optimum chemical sensitization. Thus, 600 g of a monodispersed cubic silver chlorobromide emulsion having an average grain size of 0.40 μm was obtained.

TABLE F

| | Solution | | | |
|---|---|---|---|---|
| Water to make | (I) 180 ml | (II) 180 ml | (III) 350 ml | (IV) 350 ml |
| $AgNO_3$ | 30 g | — | 70 g | — |
| KBr | — | 17.8 g | — | 49 g |
| NaCl | — | 1.6 g | — | — |

Dye solution:

The following dye (i) 0.18 g and dye (j) 0.06 g were dissolved in 160 ml of methanol to prepare the solution.

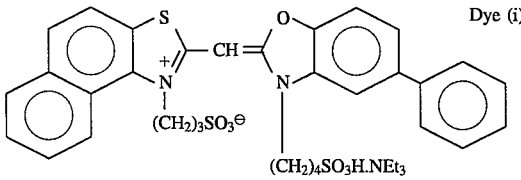

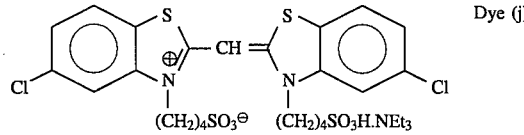

Next, a method for preparing a dispersion of the cyan dye-providing material will be described.

Thirteen g of the cyan dye-providing compound (D) used in Example 1, 7.2 g of electron-providing agent precursor (1), and 6.5 g of high boiling solvent (1) were measured off and 37 ml of ethyl acetate was added thereto. Then, heating was applied at about 60° C. to dissolve them to a bomogeneous solution. This solution was mixed with 100 g of a 10% solution of lime-treated gelatin, 30 ml of water, and 30 ml of a 5% aqueous solution of surface active agent (2) used in Example 1 and then dispersed with a homogenizer at 10000 rpm for 10 minutes. This dispersing solution is designated as dispersion EY-11 of the yellow dye-providing compound.

The dispersions of the magenta and cyan dye-providing compounds were prepared in the same manner as described for the dispersion of the yellow dye-providing compound, except that dye-providing compound (D) was replaced with magenta dye-providing compound (C) and cyan dye-providing compound (E) each used in Example 1, respectively. They are designated as EM-10 and EC-10, respectively.

Next, a method for preparing a dispersion of an anti-diffusion reducing agent for an intermediate layer will be described.

Electron-providing material (3) 20.0 g, 5.9 g of the same developing inhibitor-releasing redox compound as that used in Example 1, 1.8 g of compound (1), and 8.5 g of high boiling solvent (1) were dissolved in 26 ml of ethyl acetate and 13 ml of cyclohexanone at about 60 ° C. to prepare a uniform solution. This solution was mixed with 100 g of a 10% solution of lime-treated gelatin, 15 ml of a 5% aqueous solution of surface active agent (2), and 15 ml of a 1.7% aqueous solution of sodium hydrogensulfite and then dispersed with a homogenizer at 10,000 rpm for 10 minutes. This dispersing solution is designated as the dispersion of the anti-diffusion reducing agent for an intermediate layer.

These were used to prepare the light-sensitive element 201 having the structure shown in the following Tbale 15.

TABLE 15

| Layer No. | Layer name | Additive | Coated amount ($g/m^2$) |
|---|---|---|---|
| 11th layer | Protective layer | Gelatin | 0.43 |
| | | Matting agent (1) | 0.09 |
| | | Hardener (1) | 0.05 |
| | | Surface active agent (1) | 0.02 |
| | | Surface active agent (3) | 0.07 |
| | | Polyvinyl alcohol (average molecular weight: 2000) | 0.03 |
| | | Water soluble polymer (1) | 0.02 |
| 10th layer | Blue-sensitive layer | Emulsion (III) | 0.46 (as silver) |
| | | Gelatin | 0.32 |
| | | Surface active agent (2) | 0.01 |
| | | Water-soluble polymer (1) | 0.01 |
| 9th layer | Yellow color material layer | Yellow dye-providing compound (D) | 0.40 |
| | | Electron-providing agent precursor (1) | 0.22 |
| | | Gelatin | 0.53 |
| | | High boiling solvent (1) | 0.20 |
| | | Surface active agent (2) | 0.04 |
| | | Water soluble polymer (1) | 0.02 |
| 8th layer | Second inter-mediate layer | Gelatin | 0.32 |
| | | Surface active agent (1) | 0.01 |
| | | Water soluble polymer (1) | 0.01 |
| 7th layer | First inter-mediate layer | Electron-providing agent (3) | 0.32 |
| | | Developing inhibitor precursor (1) | 0.09 |
| | | High boiling solvent (1) | 0.13 |
| | | Surface active agent (2) | 0.01 |
| | | Compound (1) | 0.03 |
| | | Gelatin | 0.63 |
| | | Surface active agent (1) | 0.02 |
| | | Surface active agent (4) | 0.03 |
| | | Dextran (average molecular weight: 80,000) | 0.04 |
| | | Water-soluble polymer (1) | 0.03 |
| 6th layer | Green-sensitive layer | Emulsion (II) | 0.29 (as silver) |
| | | Gelatin | 0.32 |
| | | Surface active agent (2) | 0.01 |
| | | Water soluble polymer (1) | |
| 5th layer | Magenta color material layer | Magenta dye-providing compound (C) | 0.35 |
| | | Electron-providing agent precursor (1) | 0.16 |
| | | Gelatin | 0.37 |
| | | High boiling solvent (1) | 0.18 |
| | | Surface active agent (2) | 0.03 |
| | | Water soluble polymer (1) | 0.03 |
| 4th layer | Second inter-mediate layer | Gelatin | 0.32 |
| | | Surface active agent (1) | 0.01 |
| | | Water soluble polymer (1) | 0.01 |
| 3rd layer | First inter-mediate layer | Electron-providing agent (3) | 0.32 |
| | | Developing inhibitor precursor (1) | 0.09 |
| | | High boiling solvent (1) | 0.13 |
| | | Surface active agent (2) | 0.01 |
| | | Compound (1) | 0.03 |
| | | Gelatin | 0.63 |
| | | Surface active agent (1) | 0.02 |
| | | Surface active agent (4) | 0.03 |
| | | Dextran (average molecular weight: 80,000) | 0.04 |
| | | Water soluble polymer (1) | 0.03 |
| 2nd layer | Red-sensitive | Emulsion (I) | 0.25 (as silver) |

TABLE 15-continued

| Layer No. | Layer name | Additive | Coated amount ($g/m^2$) |
|---|---|---|---|
| | layer | Gelatin | 0.32 |
| | | Surface active agent (2) | 0.01 |
| | | Water soluble polymer (1) | 0.01 |
| 1st layer | Cyan color material layer | Cyan dye-providing compound (E) | 0.33 |
| | | Electron-providing agent precursor (1) | 0.13 |
| | | Gelatin | 0.33 |
| | | High boiling solvent (1) | 0.17 |
| | | Surface active agent (2) | 0.03 |
| | | Water soluble polymer (1) | 0.03 |
| | Support (polyethylene terephthalate 100 μm) | | |
| Back layer | | Carbon black | 4.00 |
| | | Gelatin | 2.00 |

Matting agent (1): polymethyl metacrylate spherical latex (average particle size: 4 μm).

Ultraviolet absorbent (1)

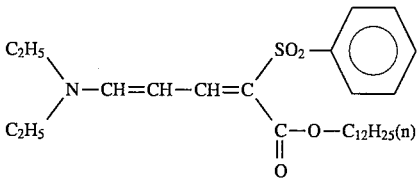

Ultraviolet absorbent (2)

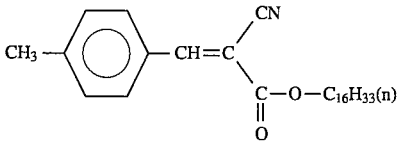

Water soluble polymer

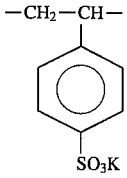

Surface active agent (1): Aerozol OT.

Surface active agent (3)

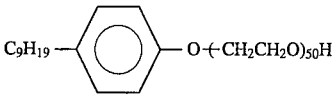

Surface active agent (4)

-continued

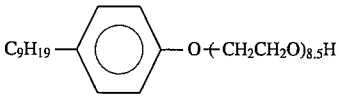

High boiling soluvent (1): tricyclohexyl phosphate.

Hardener (1): 1.2-bis(vinylsulfonylacetamide)ethane.

Electron-providing agent (3)

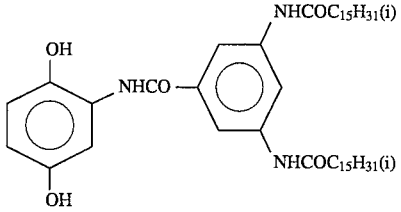

Electron providing agent precursor (1)

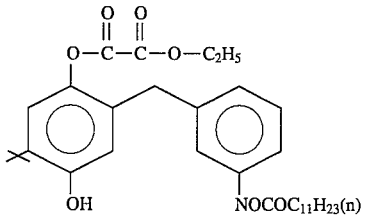

Compound (1)

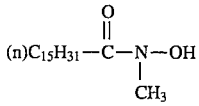

Cyan dye-providing compound (E)

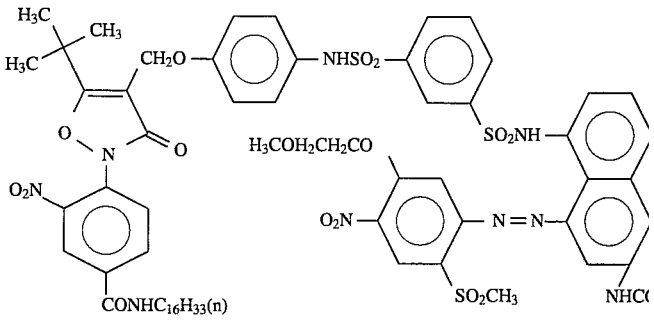

The dispersions EY-12 to EY-17, EM-11 to EM-16, and EC-11 to EC-16 each shown in Table 16 were prepared in the same manners as those in the above dispersions EY-11, EM-10 and EC-10, except that the kind and amount of the dye-providing compound were changed and the amount of the electron-providing agent precursor (1) was halved.

TABLE 16

| Dispersion | Dye-providing compound: Compound | Dye-providing compound: Amount (g) |
|---|---|---|
| EY-12 | RY-1 | 8.55 |
| EY-13 | RY-2 | 8.99 |
| EY-14 | Y-1 | 9.67 |

TABLE 16-continued
| Dispersion | Dye-providing compound | |
|---|---|---|
| | Compound | Amount (g) |
| EY-15 | Y-2 | 11.83 |
| EY-16 | Y-4 | 11.06 |
| EY-17 | Y-7 | 11.37 |
| EM-11 | RM-1 | 10.30 |
| EM-12 | RM-2 | 12.59 |
| EM-13 | M-1 | 11.05 |
| EM-14 | M-3 | 13.51 |
| EM-15 | M-5 | 11.35 |
| EM-16 | M-11 | 11.72 |
| EC-11 | RC-1 | 12.00 |
| EC-12 | RC-2 | 11.43 |
| EC-13 | C-1 | 6.76 |
| | C-2 | 4.67 |
| EC-14 | C-3 | 6.76 |
| | C-4 | 4.67 |
| EC-15 | C-7 | 6.93 |
| | C-8 | 4.78 |
| EC-16 | C-15 | 7.14 |
| | C-16 | 4.92 |
RY-1
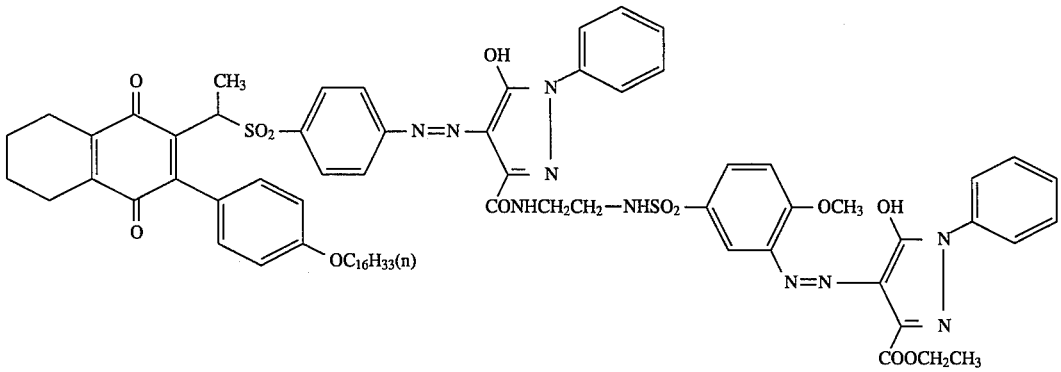
RM-1
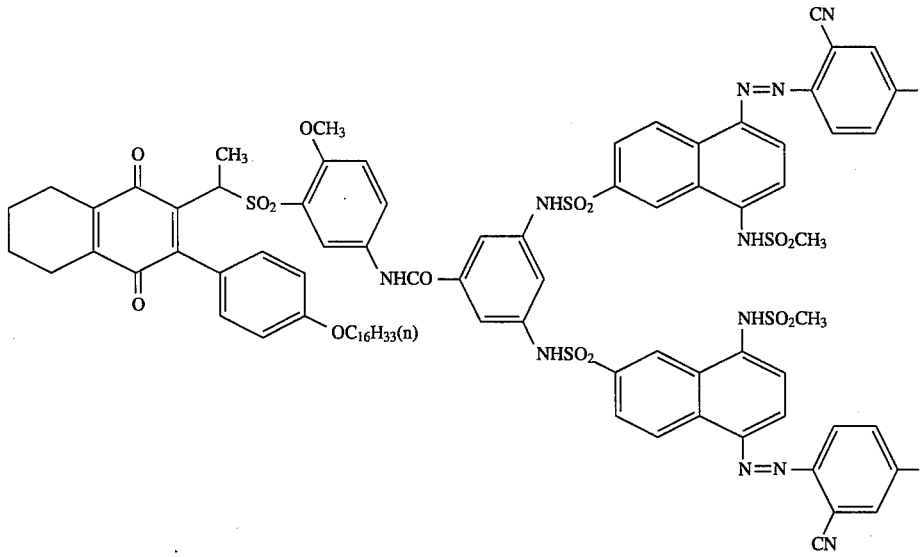
RC-1

TABLE 16-continued
| Dispersion | Dye-providing compound: Compound | Dye-providing compound: Amount (g) |
|---|---|---|
| | 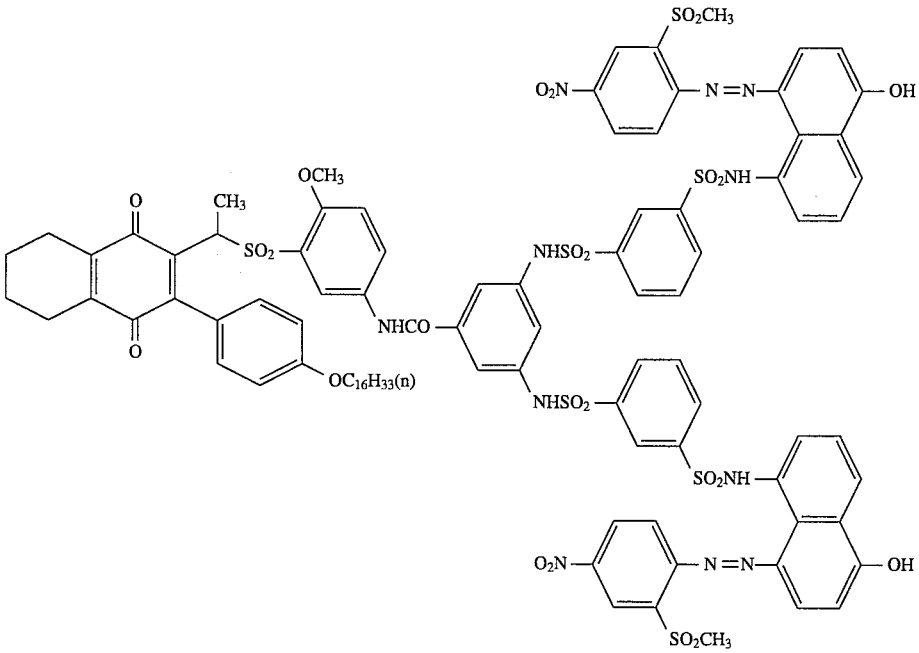 | |
RY-1, RM-1 RC-1 are comparative dye-providing compounds (the same compounds as described in U.S. Pat. No. 4,663,273).
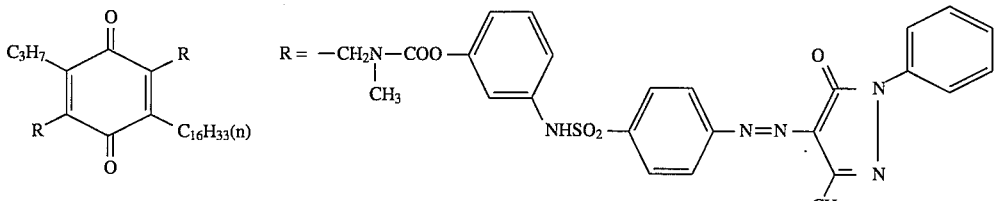
RY-2
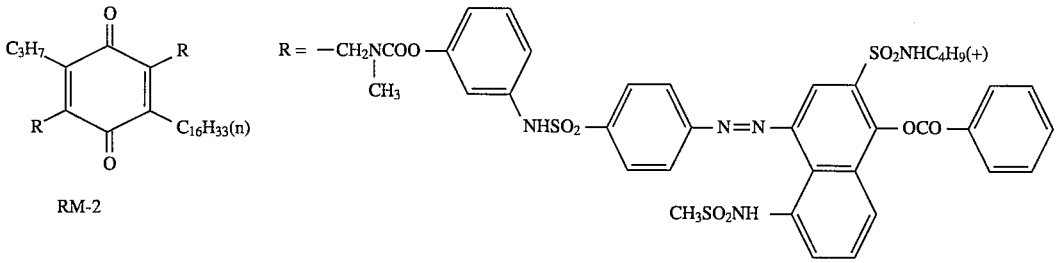
RM-2

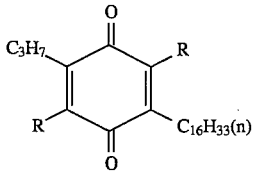

RC-2

-continued

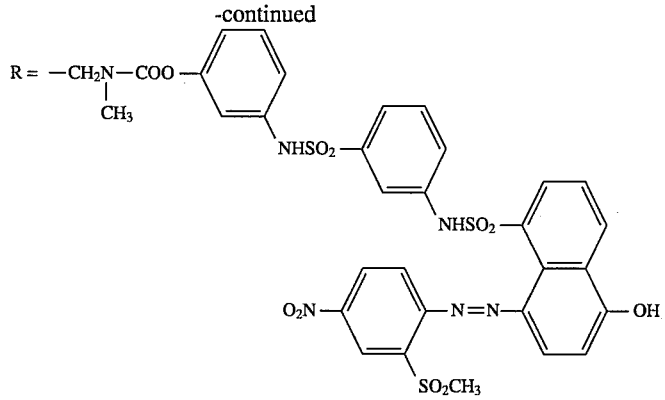

RY-2, RM-2 and RC-2 are comparative dye-providing compounds (the same compounds as described in U.S. Pat. No. 4,139,379).

Light-sensitive elements 202 to 207 shown in Table 17 were prepared in the same manner as that in light-sensitive element 201, except that the dye-providing compounds contained in the first layer, the fifth layer and the ninth layer were changed to the dispersions shown in Table 16 and that the amounts of the light-sensitive silver halide emulsions contained in the second layer, the sixth layer and the tenth layer were changed to the amounts shown in Table 18.

TABLE 17

| Light-sensitive material | 1st layer | 5th layer | 9th layer |
|---|---|---|---|
| 201 (Comp.) | EC-10 | EM-10 | EY-11 |
| 202 (Comp.) | EC-11 | EM-11 | EY-12 |
| 203 (Comp.) | EC-12 | EM-12 | EY-13 |
| 204 (Inv.) | EC-13 | EM-13 | EY-14 |
| 205 (Inv.) | EC-14 | EM-14 | EY-15 |
| 206 (Inv.) | EC-15 | EM-15 | EY-16 |
| 207 (Inv.) | EC-16 | EM-16 | EY-17 |

TABLE 18

| Light-sensitive element | 2nd layer emulsion (I) | 6th layer emulsion (II) | 10th layer emulsion (III) |
|---|---|---|---|
| 201 | 0.25 | 0.29 | 0.46 |
| 202 | 0.25 | 0.29 | 0.46 |
| 203 | 0.25 | 0.29 | 0.46 |
| 204 | 0.125 | 0.145 | 0.230 |
| 205 | 0.125 | 0.145 | 0.230 |
| 206 | 0.125 | 0.145 | 0.230 |
| 207 | 0.125 | 0.145 | 0.230 |

Unit: $g/m^2$ (as silver)

An image-receiving element was prepared in the following manner:

Paper support:

prepared by laminating polyethylene by 30 μm on both sides of a paper having a thickness of 150 μm. A dispersed titanium oxide of 10% by weight based on polyethylene is added to polyethylene provided on an image-receiving layer side.

Back side:

(a) a light-shielding layer comprising 4.0 $g/m^2$ of carbon black and 2.0 $g/m^2$ of gelatin;

(b) a white color layer comprising 8.0 $g/m^2$ of titanium oxide and 1.0 $g/m^2$ of gelatin;

(c) a protective layer comprising 0.6 $g/m^2$ of gelatin; and the layers are coated in order of (a) to (c) and hardened with a hardener.

Image-receiving layer side:

(1) a neutralizing layer containing 22 $g/m^2$ of an acrylic acid-butyl acrylate (mole ratio 8:2) copolymer having average molecular weight of 50,000;

(2) the second timing layer containing 4.5 $g/m^2$ of cellulose acetate having an acetylation rate of 51.3% (a weight of acetic acid released by hydrolysis is 0.513 g per g of a sample) and a styrene-maleic anhydride (mole ratio 1:1) copolymer having an average molecular weight of 10,000 in a proportion of 95:5 in terms of a weight ratio;

(3) an intermediate layer containing 0.4 $g/m^2$ of poly-2-hydroxyethyl methacrylate;

(4) a first timing layer containing 1.6 $g/m^2$ of the total solid matter in which there are blended a polymer latex prepared by emulsion-polymerizing styrene/butyl acrylate/acrylic acid/N-methylol acrylamide in a proportion of 49.7/42.3/4/4 in terms of a weight ratio and a polymer latex prepared by emulsion-polymerizing methyl methacrylate/acrylic acid/N-methylol acrylamide in a proportion of 93/3/4 in terms of a weight ratio;

(5) an image-receiving layer comprising 3.0 $g/m^2$ of a polymer mordant having the following recurring unit and 3.0 $g/m^2$ of gelatin, provided using the following coating aid; and (6) a protective layer comprising 0.6 $g/m^2$ of gelatin.

Coating aid

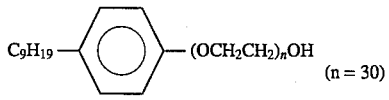

Recurring unit

-continued

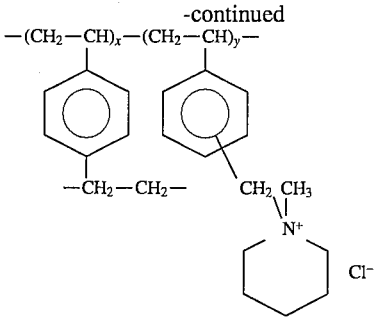

Layers (1) to (6) were provided in this order and hardened with a hardener.

A composition of processing solution (A) will be shown below.

The processing Solution 0.8 g of the following composition was charged in a breakable container:

| | |
|---|---|
| 1-Phenyl-4-hydroxymethyl-4-methyl-3-pyrazolidone (X-12) | 14.0 g |
| Pottasium sulfite (anhydrous) | 4.0 g |
| Hydroxyethyl cellulose | 40 g |
| Pottassium hydroxide | 64 g |
| Benzyl alcohol | 2.0 g |
| Water to make | 1 kg |

The above light-sensitive elements 201 to 207 each was exposed from an emulsion layer side through the color separation filters of B, G, R and gray and then superposed on the image-receiving paper side of the image-receiving element material to spread the above processing solution (A) between the both materials with an aid of pressure rollers so that the thickness thereof became 60 μm. The processing was carried out at 25° C., and the light-sensitive materials were peeled off from the image-receiving materials.

The reflection density of an image transferred on each image-receiving element was measured with a color densitometer. The results are shown in Table 19.

TABLE 19

| Light-sensitive element | (Dmax) Unexposed part | | | (Dmin) Exposed part through | | | (Dmin) Gray exposed part | | |
|---|---|---|---|---|---|---|---|---|---|
| | Cyan | Magenta | Yellow | B filter Yellow | G filter Magenta | R filter Cyan | Cyan | Magenta | Yellow |
| 201 (Comp.) | 2.20 | 2.12 | 1.93 | 0.35 | 0.36 | 0.43 | 0.39 | 0.32 | 0.32 |
| 202 (Comp.) | 2.12 | 2.10 | 1.89 | 0.41 | 0.40 | 0.42 | 0.40 | 0.38 | 0.35 |
| 203 (Comp.) | 1.98 | 2.00 | 1.89 | 0.38 | 0.32 | 0.39 | 0.39 | 0.33 | 0.38 |
| 204 (Inv.) | 2.21 | 2.10 | 1.98 | 0.20 | 0.19 | 0.25 | 0.18 | 0.15 | 0.16 |
| 205 (Inv.) | 2.20 | 2.12 | 1.95 | 0.22 | 0.21 | 0.31 | 0.20 | 0.16 | 0.20 |
| 206 (Inv.) | 2.22 | 2.10 | 1.92 | 0.25 | 0.26 | 0.32 | 0.22 | 0.21 | 0.22 |
| 207 (Inv.) | 2.22 | 2.12 | 1.98 | 0.23 | 0.25 | 0.30 | 0.21 | 0.16 | 0.20 |

It can be seen from the results in Table 19 that light-sensitive elements 204 to 207 using the dye-providing compounds of the present invnetion have an excellent discrimination and can achieve low Dmin and high Dmax.

While the invention has been described in detail and with reference to specific embodiments thereof, it will be apparent to one skilled in the art that various changes and modifications can be made therein without departing from the spirit and scope thereof.

What is claimed is:

1. A silver halide light-sensitive material containing a compound represented by formula (I):

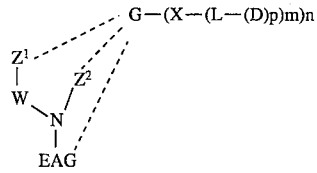

(I)

wherein EAG represents a group receiving an electron from a reducing substance; W represents an oxygen atom, a sulfur atom, or —$NR^1$—, in which $R^1$ represents an alkyl group or an aryl group; $Z^1$ and $Z^2$ each represents a single bond or a substituent other than a hydrogen atom, and $Z^1$ and $Z^2$ may be combined with each other to form a ring; p represents an integer of 1 or more; n represents an integer of 1 or 2; m represents an integer of 2 or more; G represents a group that is combined with any one of $Z^1$, $Z^2$ or EAG and which combination is cleaved after EAG receives an electron; X represents an alkyl group, an aryl group or a group obtained by removing m hydrogen atoms from a heterocyclic group; L represents a group combining X with D; D represents a dye or a dye precursor; m ($(L—(D)_p)$) may be the same or different; when n is 2, n ($(X—(L—(D)_p)_m)$) may be the same or different; when p is 2 or more, p D may be the same or different; and in the formula, a solid line represents a bond and a broken line may represent a bond, provided that at least one broken line is a bond.

2. The silver halide light-sensitive material described in claim 1, wherein the compound represented by formula (I) is represented by formula (II):

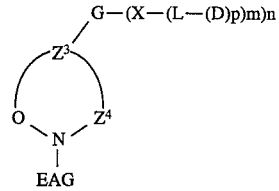

(II)

wherein EAG, G, X, L, D, m, n, and p are synonymous with those defined in formula (I); $Z^3$ represents an atomic group having a nature to break a $Z^3$—G bond after EAG receives an electron and a N—O bond is split; and $Z^4$ represents —CO— or —$SO^2$— which is combined with $Z^3$ and N to form a heterocycle containing N—O.

3. The silver halide light-sensitive material of claim 1, wherein the compound represented by formula (I) is represented by formula (III):

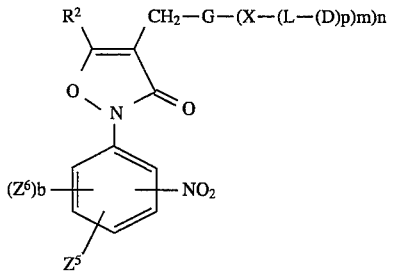

(III)

wherein G, X, L, D, m, n, and p are synonymous with those defined in formula (I); $R^2$ represents an alkyl group or an aryl group; $Z^5$ represents a carbamoyl group or a sulfamoyl group; $Z^6$ represents an alkyl group, an aryl group, an alkoxy group, an alkylthio group, an aryloxy group, an arylthio group, a halogen atom, a cyano group, or a nitro group; b represents an integer of 0 to 3; and a substitution position of the nitro group in the formula is an ortho position or a para position based on a nitrogen atom.

4. The silver halide light-sensitive material of claim 2, wherein in formula (III), G is

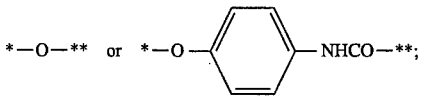

(G-1) (G-4)

X is

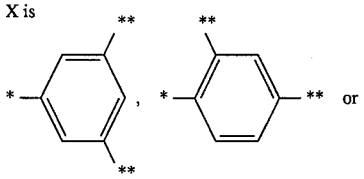

(X-1) (X-2)

-continued

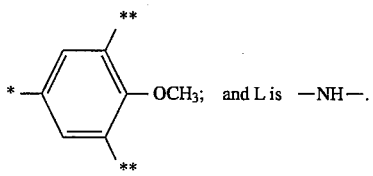

(X-5)

5. The silver halide light-sensitive material of claim 2, wherein in formula (III) a structure obtained by removing D from G—(X—(L—$D_p$)$_m$)$_n$ is

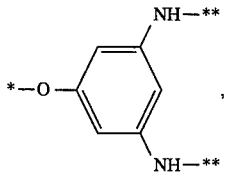

(Q-1)

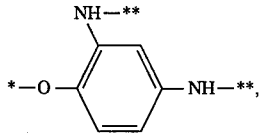

(Q-2)

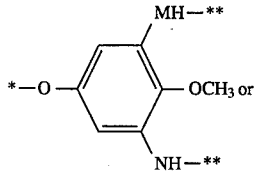

(Q-3)

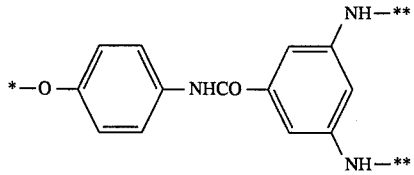

(Q-4)

wherein ** represents the position at which D is bonded, and * represents a terminal of G.

* * * * *